US005360667A

United States Patent [19]

Boles, Jr. et al.

[11] Patent Number: 5,360,667

[45] Date of Patent: Nov. 1, 1994

[54] NYLON FLAT YARNS

[75] Inventors: Raymond L. Boles, Jr., Hixson, Tenn.; Lee W. Keene, Seaford, Del.; Benjamin H. Knox, Wilmington, Del.; Ralph W. Nugent, Seaford, Del.

[73] Assignee: E. I. Du Pont de Nemours & Company, Wilmington, Del.

[21] Appl. No.: 33,600

[22] Filed: Mar. 17, 1993

Related U.S. Application Data

[60] Division of Ser. No. 787,661, Nov. 4, 1991, Pat. No. 5,219,503, which is a continuation-in-part of Ser. No. 541,692, Jun. 21, 1990, abandoned.

[51] Int. Cl.[5] ..... D02G 3/00

[52] U.S. Cl. ..... 428/364; 428/357; 428/395; 57/243; 264/210.8

[58] Field of Search ..... 428/357, 364, 395; 57/243; 264/103, 129, 130, 210.8, 211.15, 211.17

[56] References Cited

U.S. PATENT DOCUMENTS

| | | | |
|---|---|---|---|
| Re. 33,059 | 9/1989 | Chamberlin et al. | 57/243 |
| 3,994,121 | 11/1976 | Adams | 57/140 R |
| 4,407,767 | 10/1983 | Seaborn | 264/40.1 |
| 4,542,063 | 9/1985 | Tanji et al. | 428/364 |
| 4,583,357 | 4/1986 | Chamberlin et al. | 57/243 |
| 4,592,119 | 6/1986 | Bauer et al. | 28/271 |
| 4,669,158 | 6/1987 | Ballarati et al. | 28/172 |
| 4,669,159 | 6/1987 | Bogucki-Land | 28/185 |
| 4,721,650 | 1/1988 | Nunning et al. | 428/369 |

FOREIGN PATENT DOCUMENTS

| | | |
|---|---|---|
| 144617 | 6/1988 | European Pat. Off. . |
| 7729618 | 4/1979 | France . |

OTHER PUBLICATIONS

Mayer warp drawing machine developed further, *Man-made Fiber Year Book CTI,* 1986, pp. 104–105.

Draw warping: the state of the art, Dipl.-Ing. R. Th. Maier, Remscheid/FRG, *Man-Made Fiber Year Book (CTI)* 1986, pp. 106–107.

Draw-warping and draw-warp-sizing system for POY and undrawn yarns, R. C. Mears, *Man-Made Fiber Year Book (CTI)* 1985, pp. 108–110.

Draw Warping-Draw Sizing-Four Years of Practical Experience, B. Bogucki-Land, Karl Mayer Textilmaschinenfabrik GmbH.

Warp-drawing-sizing progress reviewed, R. C. Mears, Cora Engineering, Switzerland, *Textile Month,* Sep. 1987, pp. 108–111.

Draw warping combines processes, cuts costs, McAllister Isaacs III, *Textile World,* May 1985, p. 53.

Practical experiences with draw-warping of partially-oriented filament yarns, Dr.-Ing. F. Maag, Kelkheim, *Chemiefasern/Textilindustrie,* vol. 35/87, May 1985.

Warp-Drawing and Warp-Draw-Sizing, Bruner, Jeff, *International Fibers Journal,* Jun. 1989, pp. 38–48.

Methods for the Production of Warps from Flat Synthetic Filament Yarns, Maag, *J. Textile Technology,* Jun. 1984, pp. 81–84.

*Primary Examiner*—Patrick J. Ryan
*Assistant Examiner*—N. Edwards

[57] ABSTRACT

Flat continuous multifilament nylon apparel yarns suitable for critical dye applications and a process for making such yarns are provided. The process for making the yarns includes spinning nylon polymer with a relative viscosity between about 35 and about 80 and stabilizing to make a feed yarn. The withdrawal speed in spinning is sufficiently high that highly uniform feed yarns are provided. In the process, feed yarn is drawn and subsequently relaxed, preferably in the form of a warp of yarns, so that the resulting drawn yarns have properties suitable for use as flat yarns and have excellent dye uniformity with large molecule acid dyes.

6 Claims, 35 Drawing Sheets

(△LENGTH, %)/(△TEMP., C)

10

NYLON FLAT YARNS

BACKGROUND OF THE INVENTION

This is a division of application Ser. No. 07/787,661, filed Nov. 4, 1991, now U.S. Pat. No. 5,219,503, which is a continuation-in-part of application Ser. No. 07/541,692 filed Jun. 21, 1990 now abandoned.

The present invention relates to improved continuous multifilament nylon apparel yarns and more particularly relates to a warp-draw process for making nylon flat yarns and improved yarn products made thereby.

Nylon flat yarns are used in a variety of woven and warp knit fabrics which are dyed before use. When small molecule dyes are used for these fabrics, uniform dyeing can usually be achieved without great difficulty. However, for some critical dye applications such as fabrics for swimwear and auto upholstery which require excellent wash and/or light fastness, it is desirable to use large molecule acid dyes. In dyeing these fabrics with large molecule acid dyes, even a small amount of non-uniformity in dye uptake of the flat yarns can result in highly-visible non-uniformity in fabric dyeing and thus poor fabric appearance.

Nylon flat yarns generally have break elongations of less than about 60% and thus may be referred to as "fully drawn" yarns. Typically, the high degree of orientation in known flat yarns is imparted by drawing during yarn manufacture in an integrated spin-draw process (speed of withdrawal from the spinneret of between about 1400 and 2000 meters per minute (mpm) and wind-up speeds of between about 2500 and 3500 mpm) or in a split process in which a package of yarn spun at a withdrawal speeds of typically less than 1000 mpm is drawn in a separate process using a single-end draw winder. However, the yarns so produced have often been found to be undesirable for critical dye applications such as swimwear or auto upholstery due to the great care that must be taken during the preparation of such yarns and during the preparation and dyeing of the resulting fabrics to achieve acceptable dye uniformity.

Equipment has been sold which is capable of drawing of a warp of nylon yarns in a hot water bath. However, while processes using this equipment can increase dye uniformity, the equipment is recognized to have a number of inherent disadvantages. Processes using the equipment are messy and produce a waste stream of polluted water since the yarn finish is removed into water during drawing. Moreover, for use of the yarn in knitting, a finish must be reapplied after drawing. Another serious drawback of equipment which has been sold for wet drawing is that the speed of the process is typically limited to approximately 300–350 mpm by the limited capacity of the equipment to dry the yarns before wind-up.

SUMMARY OF THE INVENTION

In accordance with the invention, flat continuous multifilament nylon apparel yarns especially suitable for critical dyed applications and a process for making such yarns are provided. The process for making the yarns includes:

spinning nylon polymer having a relative viscosity (RV) between about 35 and about 80, the spinning being performed at a withdrawal speed ($V_S$) sufficient to form spun yarn with a residual draw ratio $(RDR)_S$ of less than about 2.75;

stabilizing, interlacing, and applying finish to the spun yarn to form a feed yarn having a residual draw ratio $(RDR)_F$ between about 1.55 and about 2.25, the feed yarn having a dynamic length change ($\Delta L$) and shrinkage rate ($\Delta L/\Delta T$) which are both less than 0 between 40° C. and 135° C.;

dry drawing and subsequently dry relaxing the feed yarn to form drawn yarn, the dry drawing being performed at a draw ratio between about 1.05 and about $(RDR)_F/1.25$ and at a yarn draw temperature ($T_D$) between about 20° C. and about the temperature $T_{II,**}$ of said polyamide polymer, the dry relaxing of the drawn feed yarns being performed at a yarn relaxation temperature ($T_R$) between about 20° C. and a temperature about 40° C. less than the melting point ($T_M$) of the polyamide polymer, the relaxation temperature further being defined by the following equation:

$$T_R(°C.) \leqq [1000/(K_1 - K_2(RDR)_D)] - 273$$

wherein $K_1 = 1000/(T_{II,L}+273)+1.25K_2$ and $K_2 = [1000/(T_{II,L}+273) - 1000/(T_{II,}+273)]/0.3$. (The temperature $T_{II,L}$ and $T_{II,}$ are determined by measuring the % change in length versus temperature at constant tension as will be explained in more detail). The dry drawing and the dry relaxing are performed such that the drawn yarn has a boil-off shrinkage (BOS) between about 3% and about 10% and a residual draw ratio $(RDR)_D$ between about 1.25 and about 1.8.

In a preferred form of the invention, the dry drawing and dry relaxing are performed on a warp of said feed yarns.

For feed yarns of nylon 66 polymers, a preferred relaxation temperature range for a given residual draw ratio of the drawn yarns $(RDR)_D$ may be obtained by assigning a value of 4.95 to $K_1$ and 1.75 to $K_2$ in the equation above. For nylon 6 polymers, a $K_1$ of 5.35 and $K_2$ of 1.95 are suitable values to obtain a preferred temperature range.

In accordance with one preferred process, the withdrawal speed in spinning is sufficiently high that the residual draw ratio of the spun yarn is less than about 2.5. In another preferred form of the invention, the spinning speed of the yarn as spun imparts a residual draw ratio of less than 2.25, most preferably, less than 2.0. Usually, a spun yarn with this residual draw ratio has a dynamic length change ($\Delta L$) and shrinkage rate ($\Delta L/\Delta T$) which are both less than 0 between 40° C. and 135° C. Thus, the spinning at the sufficiently high speed thereby stabilizes the spun yarn without additional stabilization treatments and then the yarn as spun can be used as the feed yarn.

In accordance with another preferred process in accordance with the invention, the spinning and the stabilizing are performed such that the feed yarn has a draw tension ($DT_{33\%}$) less than about 1.2 g/d, especially less than about 1 g/d.

In the process of the invention, dry drawing and dry relaxing of the feed yarns is performed, preferably in the form of a warp of yarns treated simultaneously. Preferably, the dry drawing and dry relaxing is done in an inert gaseous atmosphere, e.g., air, of about 50% to about 90% relative humidity (RH), more preferably, about 60% to about 80% RH. In the dry relaxation, a relaxation temperature less than about $T_{II,*}$, especially less than $T_{II,L}$, is used. Preferred conditions in the relaxation result in a boil-off shrinkage (BOS) of the drawn yarns of between about 3% and about 8% and a residual draw ratio $(RDR)_D$ of the drawn yarns of between about 1.25 and about 1.55. Preferably, the process produces yarns with a dye transition temperature $T_{dye}$ of less than about 65° C.

The process in accordance with the invention is useful for most nylon polymers. Preferred nylon polymers include nylon 66 polymer and nylon 6 polymer. Especially preferred nylon polymers are nylon 66 containing a minor amount of bifunctional polyamide comonomer units or non-reactive additive capable of hydrogen bonding with the nylon 66 polymer.

In accordance with the invention, a flat multifilament apparel yarn of nylon 66 polyamide polymer is provided. The polymer of the fiber has a melting point ($T_M$) between about 245° C. and about 265° C., is of relative viscosity (RV) between about 50 and about 80 with about 30 to about 70 equivalent NH2-ends per $10^6$ grams of polymer. The multifilament apparel yarn is further characterized by a residual draw ratio $(RDR)_D$ between about 1.25 and about 1.55 with an initial modulus greater than about 15 g/d, a boil-off shrinkage (S) between about 3% and about 10%, a C.I. Acid Blue 122 dye transition temperature ($T_{DYE}$) less than about 65° C., a C.I. Acid Blue 40 apparent dye diffusion coefficient ($D_A$), measured at 25° C., of at least about $20\times10^{-10}$ cm/sec, and apparent pore mobility (APM) greater than about $[5-0.37\times10^{-4}$ APV], wherein the apparent pore volume (APV) is greater than about $4\times10^4$ cubic angstroms. In a preferred form of the invention, the apparent pore mobility is greater than about 2.

The process of the invention provides highly uniform nylon yarns which are useful in a wide variety of warp knit and woven fabrics which must be uniformly dyeable with large molecule dyes. Yarns in accordance with a preferred form of the invention are especially well suited for this use and have a large molecule dye uniformity rating (LMDR) of at least about 6.

BRIEF DESCRIPTION OF THE DRAWINGS

FIG. 23 (Line B) is a corresponding plot of Line A expressed as percent exhaustion on a logarithimic scale versus the reciprocal of the dye bath temperature expressed as 1000/(T+273).

DETAILED DESCRIPTION

Figure 1:
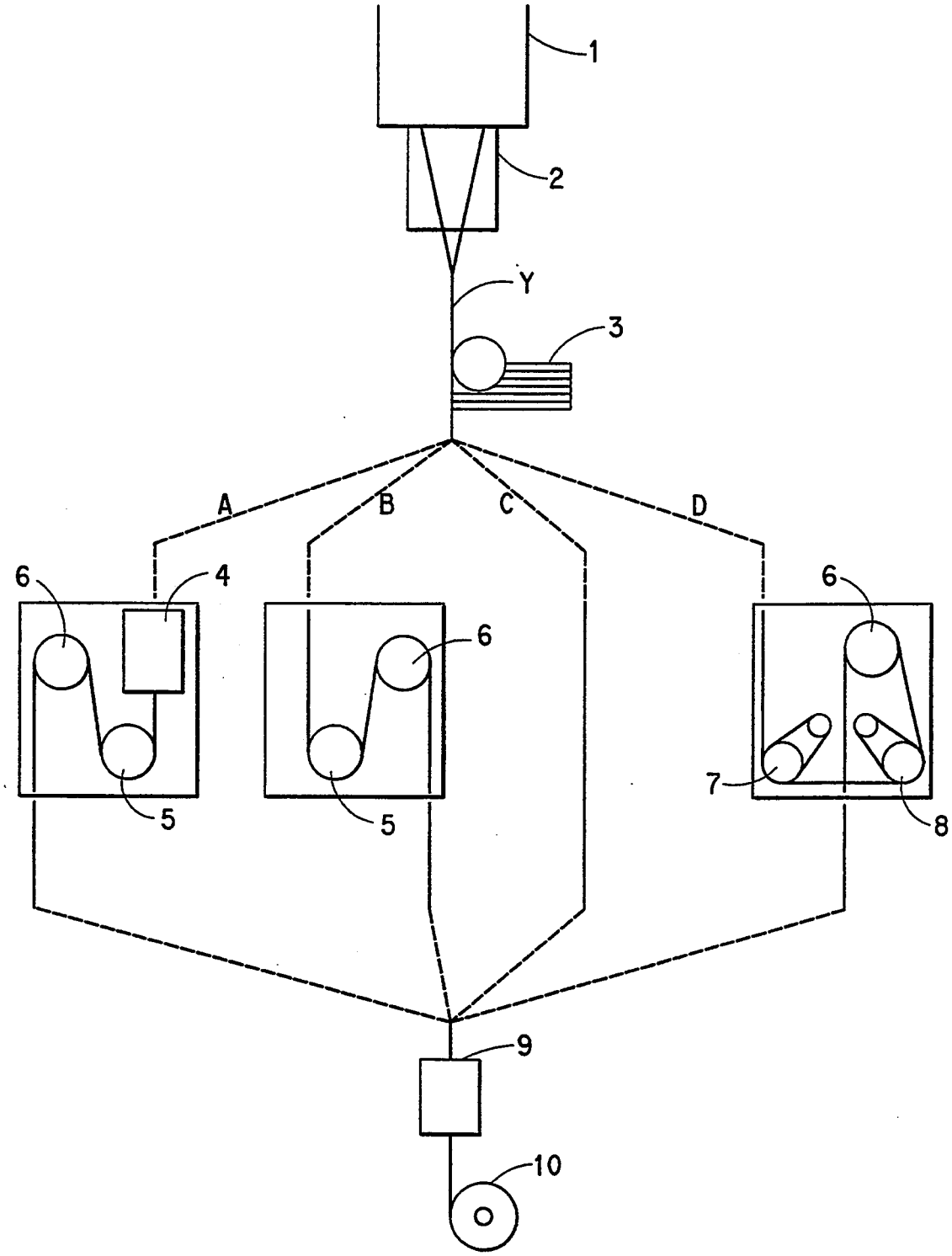
FIG. 1 is a diagrammatical view of equipment useful for making a feed yarn in a process in accordance with the present invention.

Nylon polymer as used in this application refers to any of the various generally linear, aliphatic polycarbonamide homopolymers and copolymers which are typically melt-spinnable to yield fibers having properties suitable for textile applications. Preferred nylon polymers are poly(hexamethylene adipamide) (nylon 66) and poly$\epsilon$-caproamide) (nylon 6). The nylon polymer has a relative viscosity (RV) when spun of between about 35 and about 80.

When nylon 66 polymer is used, it is advantageous for the RV of the polymer to be greater than about 46 as taught in U.S. Pat. No. Re. 33,059 (U.S. Pat. No. 4,583,357), the disclosure of which is hereby incorporated by reference. However, the RV usually should be less than about 65 since the advantages obtained in accordance with U.S. Pat. No. Re. 33,059 do not increase significantly at above an RV of 65. Also when spinning nylon 66, it is advantageous to use nylon 66 including a minor amount of one or more different copolymer units such as $\epsilon$-caproamide and/or 2-methyl-pentamethylene adipamide (Me5-6) or an unreactive additive capable of hydrogen bonding with the nylon 66. For a given set of spinning conditions for spinning the feed yarn, this provides an increase in the elongation to break and, for a given elongation to break, decreases the draw tension which facilitates drawing in the warp draw steps of the process. Due to the ability to obtain the same feed yarn properties with polymer having a lower RV, especially at higher spin speeds, the use of 2-methyl-pentamethylene diamine to provide 2-methyl-pentamethylene adipamide units in the 66 nylon polymer is especially preferred. Using a Me5-6,66 copolymer feed yarn in the warp draw process, the draw tensions decrease at the same draw ratio, an indication that mechanical quality of the drawn yarn should be improved. As the amount of Me5-6 is increased, the dye depth increases. This indicates that the dye rate increases as the amount of Me5-6 is increased or that the structure is more open, which is usually an indication of improved dye uniformity. The shrinkage of the drawn yarn increases as the amount of Me5-6 increases, reaching a level of >10% BOS at 20% Me5-6. This level is difficult to obtain with nylon 66 at draw ratios which give good mechanical quality. Alternately, cross-branching agents as disclosed in U.S. Pat. No. 4,721,650 can be used if desired. As is well known in the art, opacifiers such as titanium dioxide, colorants, antioxidants and other useful additives can be incorporated into the polymer.

Nylon 66 with a bifunctional copolyamide comonomer capable of hydrogen bonding with the 66 nylon polymer can be prepared by condensation polymerization in an aqueous "salt" solution containing the monomers in appropriate proportions. Procedures useful for the production of homopolymer nylon 66 can be applied to the production of the N6,66 with $\epsilon$-caprolactam added to the salt solution. To make Me5-6,66, adipic acid with hexamethylene diamine (HMD) and 2-methyl-pentamethylene diamine (MPMD) in the molar proportions necessary to produce the copolymer with the desired weight percent 2-methyl-pentamethylene adipamide is used to make the salt solution. For Me5-6,66, it is generally necessary, however, to modify the usual nylon 66 procedures to make sure that the MPMD, which is more volatile, stays in solution sufficiently long to react. 2-methyl-pentamethylene diamine is commercially available and is sold by E. I. du Pont de Nemours & CO., Wilmington, Del., under the trademark DYTEK A®.

With reference to FIG. 1 which illustrates the process including alternatives for making feed yarns, yarn Y is spun from spinneret 1 using a high speed melt spinning process. The filaments are cooled in a "quench" chimney using cross-flow air at, for example, 20° C., and are converged at a finish applicator such as a roll or metered finish applicator.

In accordance with the process of the present invention, the withdrawal speed ($V_S$), i.e., the speed of the first roll which acts to pull the yarn away from the spinneret 1, is sufficient to form spun yarn with a "residual draw ratio" $(RDR)_S$ of less than about 2.75. As will be explained hereinafter, the first roll may be any of a number of different rolls depending on the specific equipment used. "Residual draw ratio" as used in this patent application refers to the number of times the length of the yarn may be increased by drawing before the yarn breaks and may be calculated from elongation to break in % ($E_B$) by the following formula:

$$RDR=1+(E_B/100)$$

It has been discovered that the residual draw ratio $(RDR)_S$ must be less than 2.75 in the spun yarn and be combined with the other steps of the process of the method to obtain the improved large molecule dye uniformity in the drawn yarns. Preferably, the residual draw ratio $(RDR)_S$ is less than about 2.5 in the spun yarn, most preferably less than about 2.25.

The withdrawal speed at which the residual draw ratio of less than 2.75 is imparted to the spun yarn depends on a number of factors in the spinning process including the fineness (denier per filament) of the yarns being spun, the relative viscosity of the polymer, the spinning temperature, spinneret capillary dimensions, and the efficiency of the quench as determined by the quench air flow pattern, flow rate, and quench air temperature. A typical minimum withdrawal speed to impart a residual draw ratio $(RDR)_S$ of less than 2.75 is on the order of about 2000 mpm for normal textile yarns. In general, it is preferable to spin the feed yarns at withdrawal speeds above about 3000 mpm where it is not as necessary to carefully control process conditions.

In the process of the invention, the spun yarn is stabilized to provide a feed yarn having residual draw ratio $(RDR)_F$ of between about 1.55 and about 2.25 and a dynamic length change ($\Delta L$) and shrinkage rate ($\Delta L/\Delta T$) which are both less than 0 between 40° C. and 135° C. Preferably, the feed yarn has a residual draw ratio $(RDR)_F$ of between about 1.55 and about 2.0.

As shown in FIG. 1 in broken lines, stabilization may be performed by means of a number of different alternatives. Stabilization can be accomplished as indicated in alternative A by exposing the spun yarn to steam in a steam chamber 4 as disclosed in U.S. Pat. No. 3,994,121 or passing the yarn through a steamless, heated tube as disclosed in U.S. Pat. No. 4,181,697. The yarn then passes through puller and letdown rolls, 5 and 6, respectively, although it is not drawn to any substantial extent. Alternative B indicates a set of puller and letdown rolls 5 and 6 which are driven at essentially the same speed as the wind-up and thus there is no substantial drawing of the yarn between these rolls and the windup. Stabilization is thereby imparted by the high spinning speed as in alternative C, e.g., greater than about 4000 mpm. The rolls 5 and/or 6 could be heated if desired for the purpose of stabilizing the yarn shrinkage if spun at speeds lower than approximately 4000 mpm. Alternative C is a "godetless" process in which the yarn is not contacted by rolls between the spinneret and the wind-up. The windup speed is sufficient that the spin orientation imparted to the yarn in spinning is sufficient to provide a stable feed yarn without other separate stabilization steps being required. Typical speeds to accomplish this are above about 4000 mpm. Yarns produced by alternatives B and C are often referred to as spin-oriented or "SOY" yarns. Alternative D illustrates the use of "partial drawing" to stabilize the yarns. Before the letdown rolls 6, feed rolls 7 and draw rolls 8 draw the yarn sufficiently for stabilization. The amount of draw necessary to accomplish this is between about 1.05 and about 1.8 depending on the orientation in the yarn due to the speed and conditions of spinning. Yarns produced by alternative D are often referred to as "partially-drawn" or "PDY" yarns. Variations of the stabilization alternatives described are possible within the method of this invention.

The yarns are interlaced at interlace jet 9 so that the feed yarn has a sufficient degree of interlace to enable efficient wind-up of feed yarns at wind-up 10 and removal of the feed yarns from the bobbin for warp-drawing. A suitable level of interlace for this purpose, measured by the rapid pin count (RPC) method, is an RPC interlace of not more than about 14. While interlace can be increased such as by employing a "tanglereed", in the case of warp-drawing, as desired for further processing or use in fabric formation, a high degree of interlace in the feed yarns is desirable when practical to eliminate the need for such additional interlacing. Thus, the interlace level in certain preferred feed yarns should be high enough to obtain the desired amount of interlace after the drawing extends the distance between the interlace nodes. The precise amount of interlace for this purpose will generally depend on the yarn filament count and dpf, the type of yarn finish, and the draw ratio and draw tension experienced by the yarn, and on properties desirable in the final fabric containing the drawn yarns, especially for aesthetic purposes. For many feed yarns, it is advantageous to employ an RPC interlace of between about 6 and about 10.

In accordance with the preferred form of the invention, the feed yarns are assembled into a warp after spinning. For this to be accomplished efficiently, it is advantageous to package the feed yarns on a number of generally uniform length packages which can be supplied from a creel to form a warp of the yarns.

In the process of the invention, the feed yarns undergo dry drawing and dry relaxing to provide drawn yarns, preferably as a warp of feed yarns being treated simultaneously. "Dry" drawing and "dry" relaxing as used in this application is intended to indicate that the drawing and relaxation is done in a gaseous environment without the application of liquid water to the yarns. The preferred atmosphere for dry drawing and dry relaxing in accordance with the invention is an inert gaseous atmosphere such as air having a relative humidity between 50 and 90%, preferably between 60 and 80%. The dry drawing and dry relaxing can be done in the presence of other inert gases such as steam which can provide a source of heat as well as an inert atmosphere.

The yarns are drawn at a draw ratio (DR) of between about 1.05 and about $(RDR)_F/1.25$. "Draw ratio" (DR) in this application can be calculated from the "total draw ratio" (TDR) which is defined to be the ratio of the residual draw ratio of the feed yarns $(RDR)_F$ to the residual draw ratio of the drawn yarns $(RDR)_D$ produced by the process, i.e., after they undergo relaxation:

$$TDR=(RDR)_F/(RDR)_D$$

The total draw ratio (TDR) is related to the draw ratio (DR) as expressed in the following equation:

$$TDR=DR(1\text{-}\%\ OF/100)$$

(% OF refers to overfeed discussed in more detail hereinafter.) The draw ratio (DR) may also be calculated from the length change which the yarn is subjected e.g., the ratio of the speeds of draw rolls to feed rolls, respectively. Similarly, the total draw ratio (TDR) may be calculated from the speed of the rolls after relaxation to the feed rolls, respectively.

Figure 7:
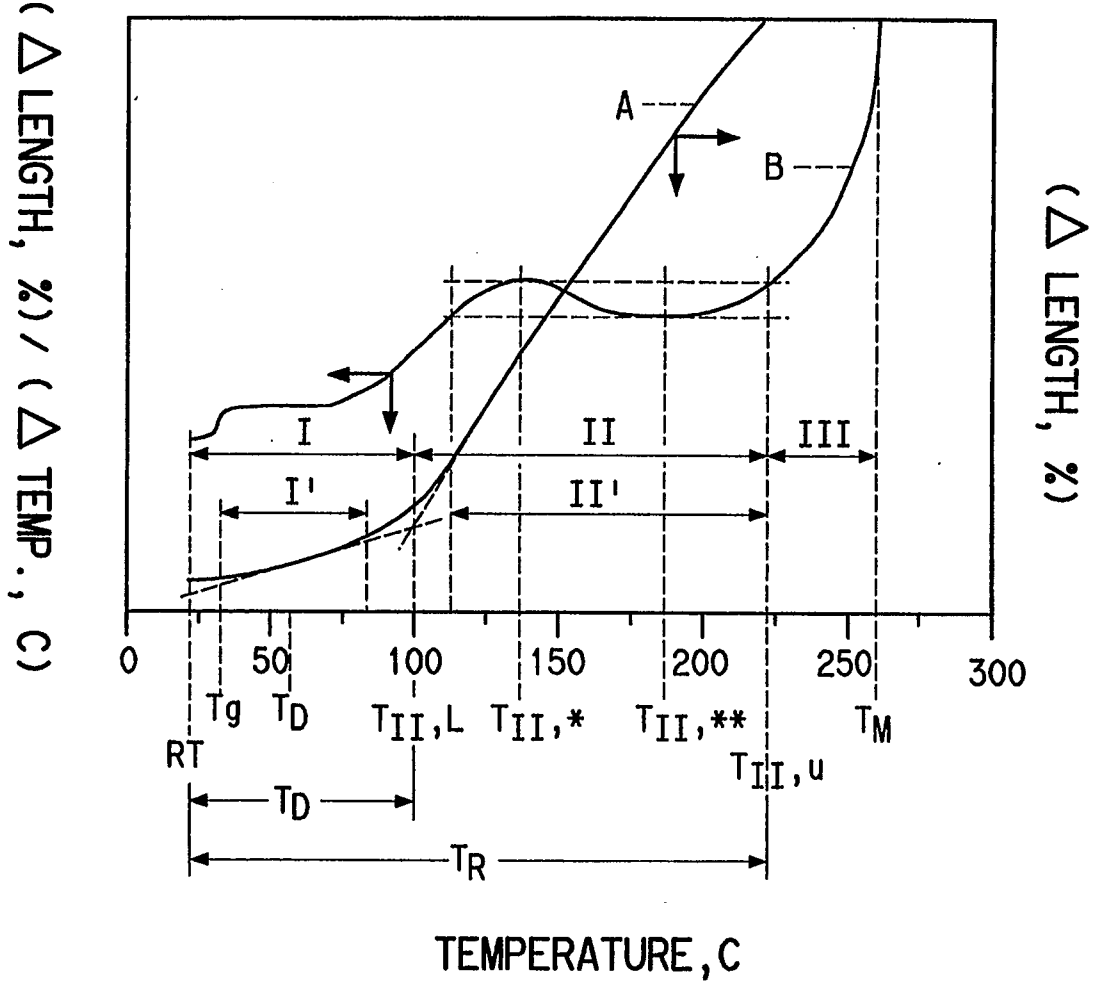
FIG. 7 is a typical plot (line A) of the percent change in length (ΔLength, %) of a nylon feed yarn versus temperature obtained using a Du Pont Thermal Mechanical Analyser at a pre-tension of 300 mg/d; and the corresponding plot (line B) of the dynamic extension rate defined by the instantaneous change in length per degree centigrade (ΔLength, %)/(ΔTemperature, °C.) of line A.

The temperature of the yarn ($T_D$) during drawing is between about 20° C. and about the temperature $T_{II}$,** of the polymer. As illustrated in FIG. 7 and accompanying description hereinafter, and in the test methods, $T_{II,**}$ is a temperature of the nylon polymer defined by measuring the change in length of the yarn versus temperature at constant tension. Heating during the dry drawing can be advantageous to decrease the draw tension in the process of the invention. Preferably, the temperature of the yarn during drawing is most preferably less than about $T_{II,L}$. For nylon 66 and nylon 66 with minor amounts of hydrogen bonding constituents, the temperature of drawing can be up to about 175° C. Preferably, the temperature is between about 20° and about 135° C., most preferably, between about 20° C. and about 90° C. For nylon 6, yarn draw temperature should generally be about 20°–40° C. less than corresponding temperatures for nylon 66. Non-contact or contact heating apparatus such as ovens, radiant heaters, plate heaters, hot rolls, microwave heaters and the like are suitable for heating the yarn during drawing.

The yarn is subjected to a heated relaxation step to control boil-off shrinkage and the relaxation also causes the residual draw ratio of the drawn yarns ($RDR_D$) to increase slightly. The draw ratio (DR) in the dry drawing and the conditions in the dry relaxing are selected such that the drawn yarns have a boil-off shrinkage (BOS) between about 3% and about 10% and a residual draw ratio $(RDR)_D$ between about 1.25 and about 1.8. Preferably, the boil-off shrinkage is between about 3 and about 8% and the residual draw ratio of the drawn yarns $(RDR)_D$ is between about 1.25 and about 1.55. In addition, in the drawing and relaxation in accordance with the invention, other yarn properties can be adjusted for desired end use. The invention is capable of providing a range of break elongations and other desired properties while maintaining uniformity in the yarn which can yield dyed fabrics with good dye uniformity. Preferably, tenacities of the drawn yarns are above about 2 g/d and can be as high as about 6 g/d or higher. Preferred modulus levels are above about 15 g/d and can range up to about 40 g/d or higher.

The % overfeed in the relaxation step of the process, i.e., the amount of length change allowed to occur through shrinking, must be selected to obtain the properties desired. The % overfeed can be set by adjusting the speed of rolls in contact with the yarn before and after the relaxation and the shrinkage is generally decreased with increasing overfeed. Depending on the orientation of the yarn when it reaches relaxation step and the desired drawn yarn properties, the overfeed can be very small and ranges up to about 10%. Preferably, the % overfeed is between about 2 and about 8%. While the % overfeed can vary within these ranges, the % overfeed should not be too high for the particular feed yarn and relaxation temperature or the tension on the yarns in the relaxation step will drop to zero and the process will not run. The appropriate control of overfeed is also important if a tanglereed is used, such as in warp drawing, to impart additional interlace to the yarns since lower relaxation tension gives tighter entanglement. With the tanglereed the overfeed should be adjusted to give a relaxation zone tension of 0.25 to 0.50 grams/drawn denier (g/dd) or preferably 0.30 to 0.375 g/dd. At relaxation zone tension below ~0.25 g/dd, operability with the tanglereed is poor.

In the process of the invention, the temperature of the yarns during relaxation ($T_R$) must be between about 20° C. and a temperature about 40° C. less than the melting point of the nylon polymer ($T_M$). As in the drawing step of the process, non-contact or contact heating apparatus such as ovens, radiant heaters, plate heaters, hot rolls, microwave heaters, and the like are suitable for heating the yarn during relaxation.

It has been discovered that controlling the yarn temperature during relaxation ($T_R$) to correspond in a particular relationship to the residual draw ratio of the drawn yarns ($RDR_D$) provides high large dye molecule dye uniformity ratings. In accordance with the invention, the relaxation temperature ($T_R$) is selected in accordance with following relationship:

$$T_R(°C.) \leqq [1000/(K_1 - K_2(RDR)_D)] - 273$$

wherein $K_1 = 1000/(T_{II,L}+273)+1.25$ $K_2$ and $K_2 = [1000/(T_{II,L}+273) - 1000/(T_{II,}+273)]/0.3$, preferably, the yarn relaxation temperature is less than $T_{II,}$ and is most preferably less than $T_{II,*}$. $T_M$, $T_{II,L}$, $T_{II,**}$ and $T_{II,*}$ are determined on feeds yarns of the nylon polymer being employed as illustrated in FIG. 7 and accompanying text and in the Test Methods which follow.

For feed yarns of nylon 66 polymers, a preferred relaxation temperature range for a given residual draw ratio of the drawn yarns $(RDR)_D$ may be obtained by assigning a value of 4.95 to $K_1$ and 1.75 to $K_2$ in the equation above. Preferred relaxation temperatures are less than about 175° C. and, most preferably, less than about 135° C. for nylon 66 or nylon 66 with a minor amount of a hydrogen bonding constituent. For nylon 6, a preferred temperature range may be defined by assigning the values of 5.35 to $K_1$ and 1.95 to $K_2$, respectively. In general, the preferred temperatures for nylon 6 yarns are 20°–40° C. less than corresponding temperatures for 66 nylon.

Commercially available equipment has been found to be suitable for warp-drawing of appropriate feed yarns in accordance with the invention. A model DSST 50 manufactured by Karl Mayer Textilmaschinenfabrik GmbH, D-6053 Obertshausen, Germany, and a model STF1 manufactured by Barmag Aktiengesellshaft, 5630 Remscheid, Germany, are suitable and the use of both is illustrated in the examples which follow. Typical wind-up speeds for such equipment are in the range of up to about 600 mpm. Since the equipment is similar, only the Barmag STF1 is shown schematically in FIG. 2.

Figure 2:
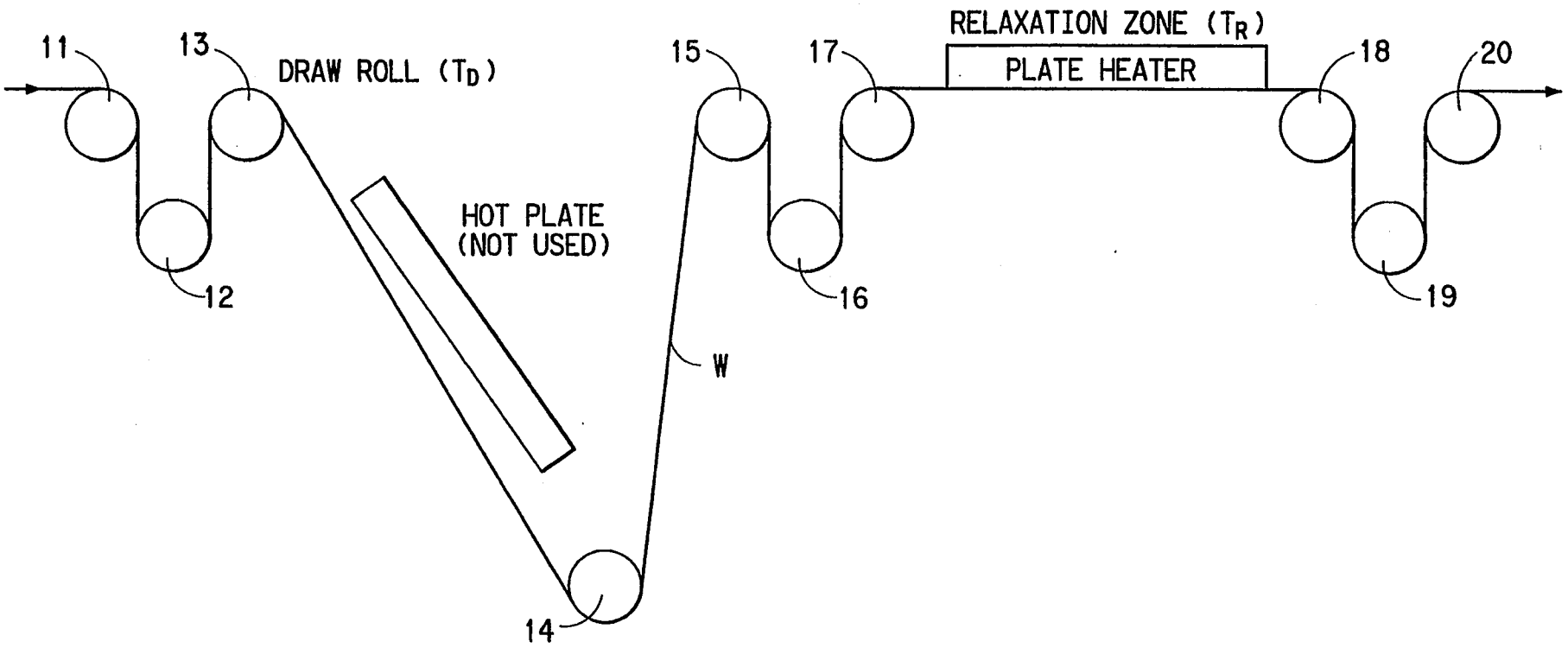
FIG. 2 is a diagrammatical view of typical commercial Warp-draw equipment useful in a process in accordance with the present invention.

With reference to FIG. 2, a warp sheet of feed yarn (indicated by the character W) is pulled by feed rolls 11–13 from a creel (not shown) on the left. Feed roll 13 is heatable and is usually heated to a temperature of between about 50° and about 90° C. An inclined plate heater is provided in this unit and can be used to further heat the yarns if desired. The warp of yarn W is then advanced to unheated draw rolls 14–17. The draw rolls 14 and 15–17 are driven at a greater speed than the feed rolls to impart the desired amount of draw to the warp of yarns.

After passing draw roll 17, the yarns undergo relaxation as they pass in a warp in contact with a plate heater which has the capability, for this particular warp draw model, to be heated up to about 200° C. The amount of relaxation is controlled by exit rolls 18–20 which are driven at a speed appropriately less than that of the draw rolls 14–17 to provide the desired overfeed. The resulting yarns are wound up simultaneously as a beam at a beam winder (not shown).

For the equipment illustrated in FIG. 2, the warp sheet of feed yarns is drawn between rolls 13 and 14 at a draw temperature ($T_D$) with a warp draw ratio (WDR) defined by the ratio of the surface speeds of rolls 13 and 14 (i.e., WDR=V14/V13; heat relaxed between rolls 17 and 18 at a relaxation temperature ($T_R$) and with a percent overfeed, % OF=(1-V18/V17)100, where V18/V17 is the ratio of the surface speeds of rolls 17 and 18; and providing a total warp draw ratio TWDR given by the expression: TWDR=WDR×(1-% OF/100)=(V14/V13)×(V18/V17)=V18/V13, since typically V14=V17.

Yarns produced in accordance with the invention have properties which make them extremely well-suited for critical dye application. A number of physical properties of the yarns are responsible for the uniform dyability and any one or more of which are very important to the uniformity in dying. Two properties which are believed to be characteristic of the process and the yarns produced by the process of the invention are an along-end % CV of less than about 0.7 by denier variation analysis (DVA) for both the feed and drawn yarns and an along-end % CV of draw tension of less than about 1.0 when drawn 1.33X ($DT_{33\%}$) for the feed yarn.

The preferred method in accordance with the invention provides yarns which have a "large molecule dye uniformity rating" (LMDR) of at least about 6. The term "large molecule dye" refers to either Anthraquinone Milling Blue BL (C.I. Acid Blue 122) or Sandolin Milling Blue BL-N (C.I. Acid Blue 80). Both of these dyes are large molecule, wash-fast, rate-sensitive acid dyes. Although not useful for measurement of LMDR in this application, other large molecule acid dyes may be more or less critical. "Large molecule dye uniformity rating" (LMDR) as used in the present application refers to a yarn dye uniformity evaluation made by knitting the yarns into a tricot fabric and dyeing using either of the above large molecule dyes. After dyeing in the evaluation procedure, the fabric is rated by a panel of experts on a scale from 1 to 10 as described in more detail in the test methods which follow using computerized simulations of fabric streaks shown in FIGS. 27–36 as a guide. A rating of 5 or below is considered unacceptable and a rating of 5 to 6 is considered borderline acceptable for some non-critical warp knit fabrics. A rating of 6 or more is considered acceptable for most warp knit fabrics. A rating of 6.5 or more is considered acceptable for critical warp knit fabrics such as those used for swimwear and it is more preferred for yarns in accordance with the present invention to result in a uniformity rating of above about 6.5. A rating of 7 or greater is considered superior and yarns in accordance with the invention which can yield a rating of over 7 are most preferred. Ratings as high as 8.0 and greater are possible in accordance with the present invention.

Figure 3:
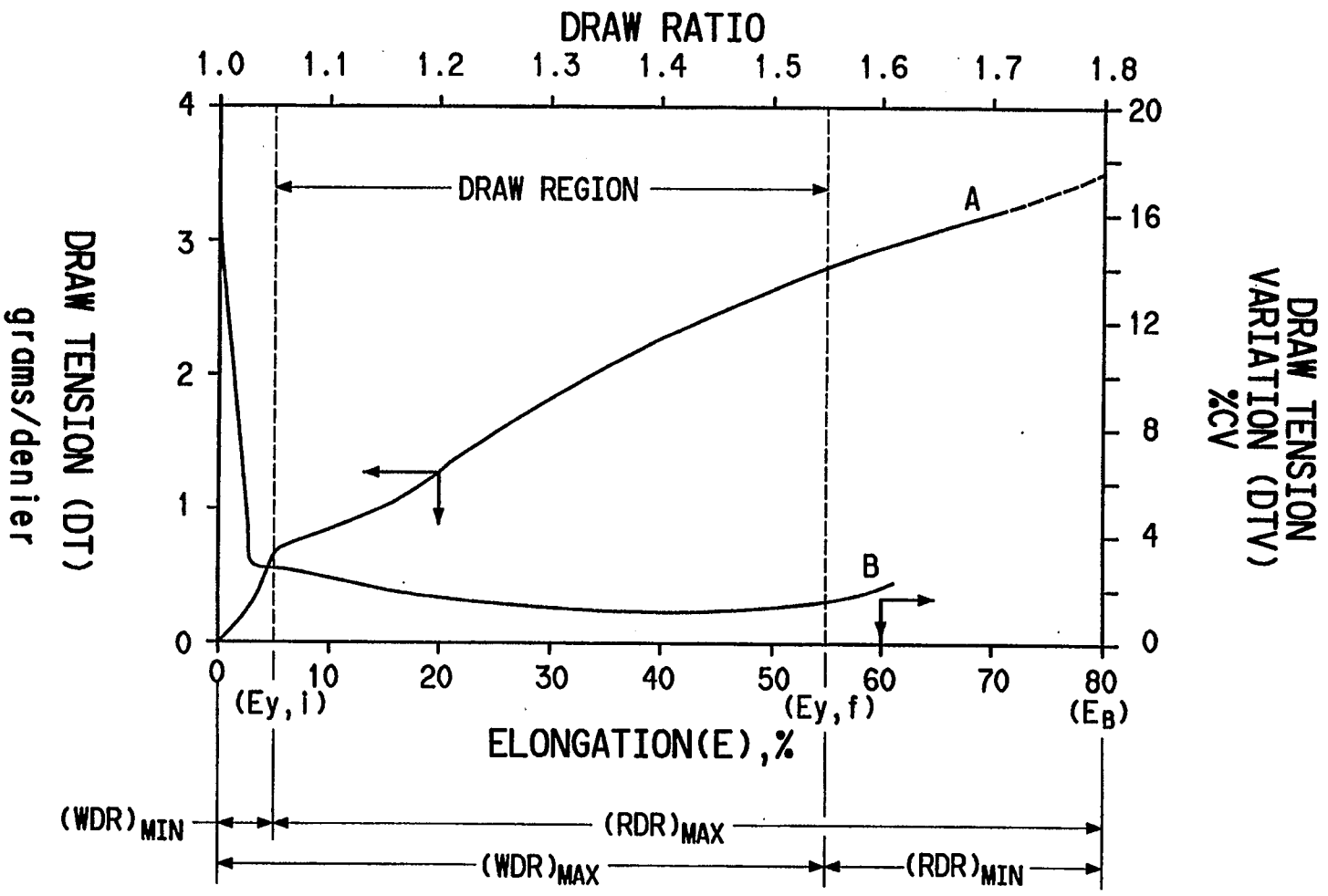
FIG. 3 is a typical plot (line A) of draw tension (DT) and the corresponding plot (line B) of the along-end draw tension variation (DTV), at room temperature versus draw ratio (DR), percent elongation (E) and residual draw ratio $(RDR)_D$.

FIG. 3 is a typical plot of draw tension, DT (line A), measured at room temperature (expressed as grams per original denier), for a nylon feed yarn having an elongation-to-break ($E_b$) of 80% (i.e., a $(RDR)_F=1+80/100=1.80$) plotted versus percent elongation (E), draw ratio (DR=1+E/100), and residual draw ratio of the drawn yarn [$(RDR)_D=(RDR)_f/DR$]; wherein, DT initially increases sharply with draw ratio up to yield point (Ey,i) at about 5% E (i.e., at about 1.05×DR), and increases less with draw ratio upto break at Eb (i.e., RDR=1.0); and of the corresponding plot (line B) of the along-end draw tension variation (DTV), expressed as % CV, which decreases sharply to the initial yield point (Ey,i) and remains essentially constant over the yield region Ey,i to Ey,f and then typically increases until the yarn breaks. The optimum draw zone is defined by Ey,i to Ey,f; that is, in this example by E-values of 5% to 55%, equivalent to a (WDR)min of 1.05 to a (WDR)max of 1.44 (=1.8/1.25), corresponding to a (RDR)max of 1.71 (=1.8/1.05) to a (RDR)min of 1.25, respectively.

Figures 4A, 4B:
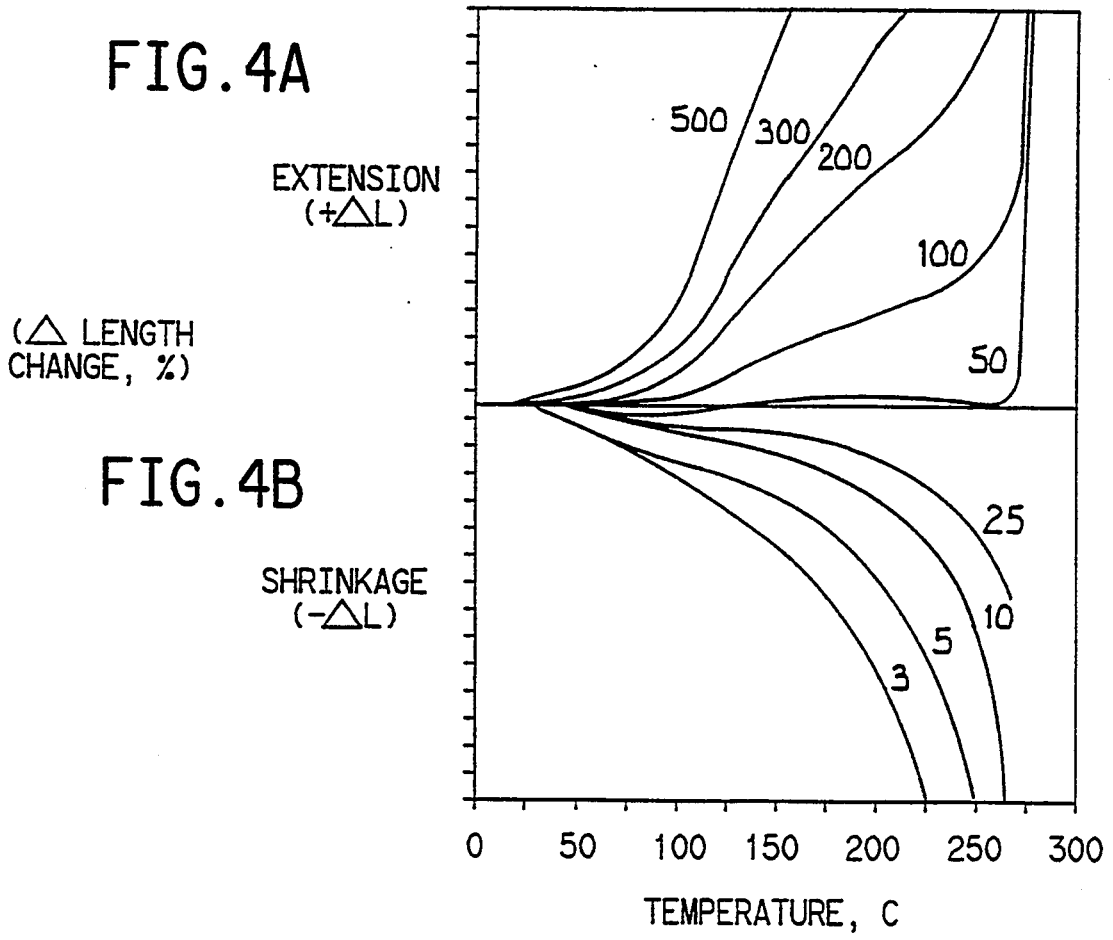
FIG. 4 are representative plots of percent change in length (Δ length, %) of a nylon feed yarn versus temperature obtained using the Du pont Thermal Mechanical Analyser at a constant heating rate of 50° C. per minute and varying the initial pre-tension from 3 mg/denier to 500 mg/denier; wherein, the yarn extends under tensions greater than about 50 mg/d (FIG. 4A—top half) and shrinks under tensions less than about 50 mg/d (FIG. 4B—bottom half).

FIGS. 4A and 4B are representative plots of percent change in length (Δ length, %) of a nylon feed yarn versus temperature obtained using a Dupont Thermal Mechanical Analyzer (TMA) at a constant heating rate of 50° C. per minute (±0.1° C.) and varying the pre-tension (also referred herein as stress, σ, expressed as miligrams per original denier) from 3 mg/denier to 500 mg/denier; wherein, the yarn extends under pre-tensions greater than about 50 mg/d (FIG. 4A—top half) and shrinks under pre-tensions less than about 50 mg/d (FIG. 4B—bottom half).

The instantaneous length change response versus temperature for a give tension, [(ΔLength, %)/(Δ Temperature, °C.)]=[ΔL/ΔT], is herein referred to as the "dynamic shrinkage rate" under shrinkage conditions and as "dynamic extension rate" under extension conditions. The preferred feed yarns used in this invention shrink under an initial tension of 5 mg/d between 40° C. and 135° C., corresponding approximately to the glass transition temperature (Tg) and the onset of major crystallization ($T_{II,*}$); and have a dynamic shrinkage rate less than zero under the same conditions (that is, shrinkage increases with temperature and does not exhibit any spontaneous extension after initial shrinkage between about 40° C. and 135° C.).

Figure 5:
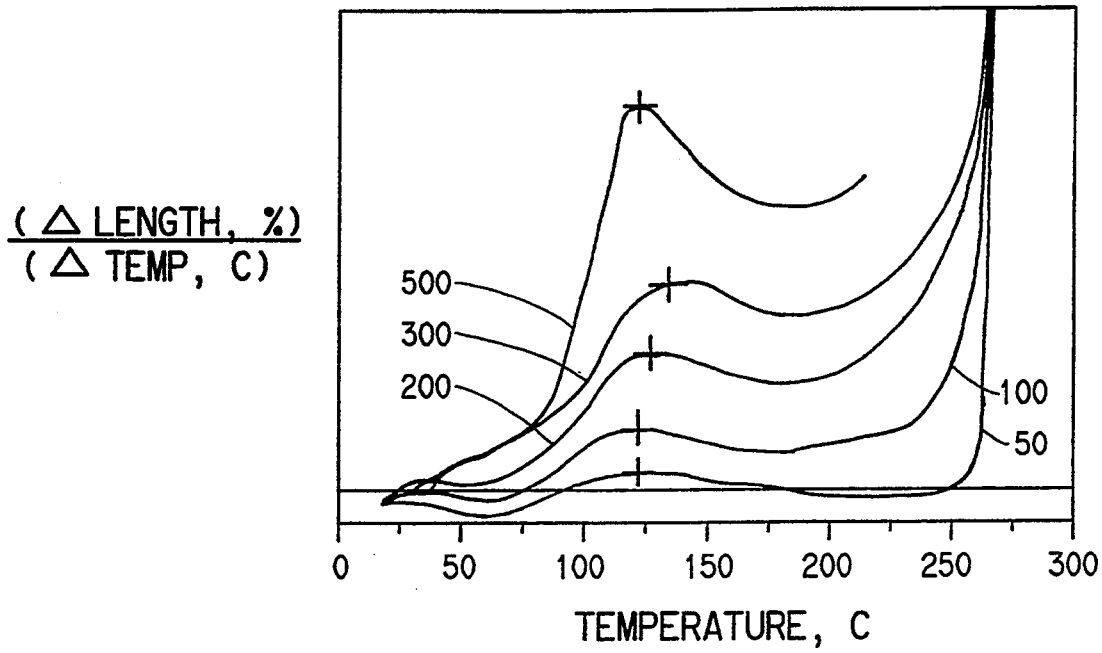
FIG. 5 is representative plots of the dynamic extension rate, $(\Delta L/\Delta T)$, versus temperature for a nylon feed yarn under pre-tensions of 50 to 500 mg/d obtained using the Du pont Thermal Mechanical Analyser at a constant heating rate of 50° C. per minute; wherein, the maximum dynamic extension rate, $(\Delta L/\Delta T)max$, is taken, herein, as the onset of major crystallization and occurs at temperature $T_{II,*}$ (i.e., between about 110°–140° C. for most nylon yarns).

FIG. 5 is a representative plot of the TMA dynamic extension rate, (ΔL/ΔT), versus temperature for a nylon feed yarn under tensions of 50 to 500 mg/d (refer to FIG. 4 for details). The maximum dynamic extension rate, (ΔL/ΔT)max, is taken, herein, as the onset of major crystallization and occurs at temperature $T_{II,**}$. The preferred draw temperature ($T_D$) is less than about $T_{II,*}$.

Figure 6:
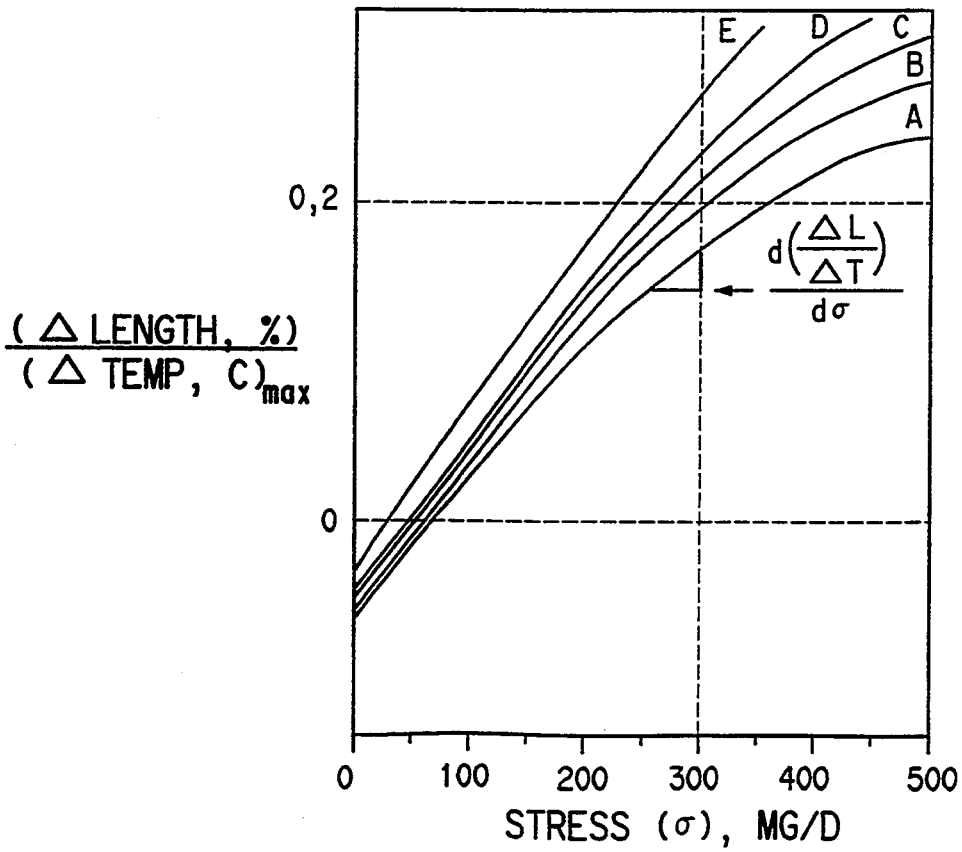
FIG. 6 is representative plots of the dynamic extension rate $(\Delta L/\Delta T)max$ versus pre-tension stress ($\sigma$), as described in FIG. 5; wherein, the slope, $d(\Delta L/\Delta T)max/d(\sigma)$ at 300 mg/d, is taken as a measure of the sensitivity of the drawn feed yarn during the relaxation step to varying stress levels (i.e., to varying % overfeed).

FIG. 6 is a representative plot of the maximum TMA dynamic extension rates, $(\Delta L/\Delta T)_{max}$, versus initial stress, expressed as miligrams per original denier; wherein, the $(\Delta L/\Delta T)_{max}$ increases with increasing stress (σ) as characterized by a positive slope, $d(\Delta L/\Delta T)_{max}/d\sigma$. The value of $d(\Delta L/\Delta T)_{max}/d\sigma$ decreases (Line E to Line A) in general with increasing polymer RV, and increasing spin speed (i.e., decreasing $(RDR)_S$. Preferred feed yarns used in this invention are characterized by $(\Delta L/\Delta T)_{max}$ values less than about 0.20, preferably between about 0.15 and about 0.05%/°C., and $d(\Delta L/\Delta T)_{max}/d\sigma$ values between about $3\times10^{-4}$ and about $7\times10^{-4}$ (%/°C.)/(mg/d) at a stress (σ) of 300 mg/d which is selected to characterize the preferred feed yarns of the invention since it is typically the nominal tension level in the relaxation zone (between rolls 17 and 18 in FIG. 2).

FIG. 7 (Line A) is a typical plot of the percent change in length (ΔLength, %) of a nylon feed yarn versus temperature (°C.) obtained using a Du Pont Thermal Mechanical Analyser at a constant heating rate of 50° C. per minute (+/−0.1° C.) under constant tension of 300 miligrams per original denier. The onset of extension (i.e., ΔL>0) occurs at about the glass transition temperature (Tg) and increases sharply at a temperature $T_{II,L}$ which is believed to be related to the temperature at which the hydrogen bonds begin to break permitting extension of the polymer chains and movement of the crystal lamellae.

FIG. 7 (Line B) is a plot of the corresponding TMA dynamic extension rate to line A, herein defined by the instantaneous change in length per degree centigrade, (Δ length, %)/(Δ temperature, °C.)=(ΔL/ΔT), the dynamic extension rate, (ΔL/ΔT), is relatively constant between Tg and the $T_{II,L}$, and then rises to an initial maximum value at a temperature $T_{II,*}$, which is believed to be associated with the onset of major crystallization. The dynamic extension rate remains essentially constant at the higher level over the temperature range $T_{II,*}$ to $T_{II,U}$ and then rises sharply at $T_{II,U}$ which is associated with the onset of crystal melting and softening of the yarn, until the yarn breaks under tension at a temperature typically less than the melting point ($T_m$); wherein, $T_{II,U}$ is 40° C. less than $T_m$.

Most aliphatic polyamides exhibit the dynamic extension rate versus temperature behavior of line B, wherein, there is a slight reduction in the dynamic extension rate, after the initial maximum at $T_{II,*}$ reaching a minimum at temperature $T_{II,}$, which for nylon 66 polyamides is frequently referred to as the Brill temperature and is associated with the transformation of the less thermally stable Beta-crystalline conformation to the thermally more stable Alpha-crystalline conformation; and for nylon 6 polyamides, temperature $T_{II,}$ is believed to be associated with the transformation of the Gamma-crystalline conformation formed only via spin-orientation to the more stable Alpha-crystalline formation typical of drawn and/or thermally treated yarns.

The preferred draw conditions for critical acid dyeability have been found to relate to the careful balancing of the extent of drawing (as given by DR), the draw temperature ($T_D$), the relaxation temperature ($T_R$), and the extent of relaxation permitted (as given by % overfeed, % OF, or by the extent of relaxation, 1-% OF/100). Herein, the preferred ranges are: DR between about 1.05 X and (RDR)F/1.25; $T_D$ of 20° C. to less than about $T_{II,**}$, preferably less than about $T_{II,*}$ and especially less than about $T_{II,L}$; $T_R$ less than about $T_{II,U}$ (i.e., $T_M$−40° C.), preferably less than about $T_{II,**}$, and especially less than about $T_{II,*}$.

The requirement to reduce $T_R$ with decreasing $(RDR)_D$ (i.e., increasing DR and decreasing % OF) is believed to be associated with the shifting of the distribution of pore sizes between crystallites to smaller values which decreases the rate of dye diffusion (herein expressed by the yarn MBB value) and increases the temperature of the onset of major mobility of the pores (herein related to the dye transition temperature, $T_{DYE}$, and to the temperature at the maximum dynamic modulus ($T_{E'max}$). It is believed that there exists a combination of distribution of pore-sizes and mobility of the pores that defines critical acid dyeability. This combination is believed to be achieved by the proper selection of feed yarn and by the draw process of the invention.

Figure 8:
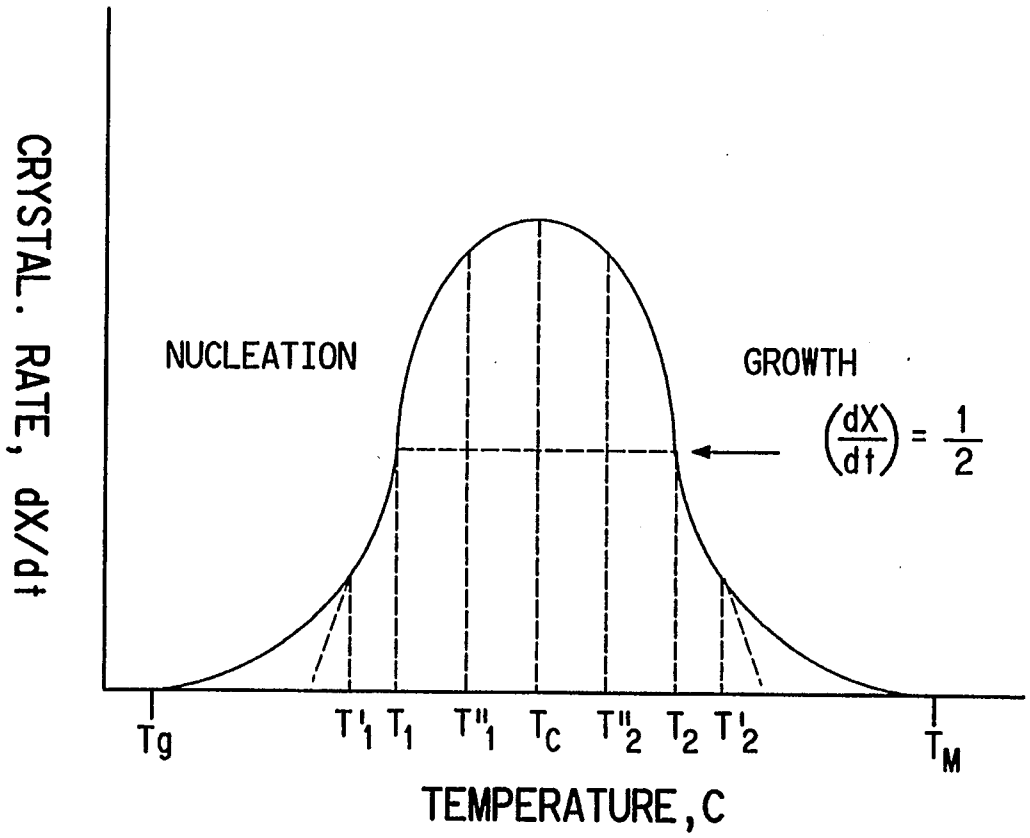
FIG. 8 is a representative plot of the relative crystallization rate, dX/dt, versus treatment temperature; wherein, the value of dX/dt increases, reaching a maximum value at $T_c$.

FIG. 8 is a representative plot of the relative crystallization rate, dX/dt, versus treatment temperature. The value of dX/dt increases, reaching a maximum value at $T_c$ which is approximately 150° C. for nylon 66 and 146° C. for nylon 6. Temperatures $T_1$ and $T_2$ denote treatment temperatures where the relative extent of crystallization X=½. For nylon 66 $T_2$ and $T_1$ are about $T_c$+/−40° C., and for nylon 6 $T_2$ and $T_1$ are about $T_c$+/−20° C. Between the temperature $T_1$, and $T_c$, crystallization proceeds via nucleation and continues via growth of the existing crystals between $T_c$ and $T_2$. Comparing FIGS. 8 and 7, suggests that $T_{II,L}$ and $T_{II,U}$ may correspond to $T_1$, and $T_{2'}$, respectively; and that $T_{II,}$, and $T_{II,}$ may correspond to $T_{1''}$ and $T_{2''}$, respectively. Although this invention is not tied to any particular theory, it is believed that the preferred relaxation temperature in draw is less than about $T_c$, i.e., under conditions of uniform nucleation versus crystal growth, especially as the $(RDR)_D$ of the drawn yarn is reduced.

Figure 9:
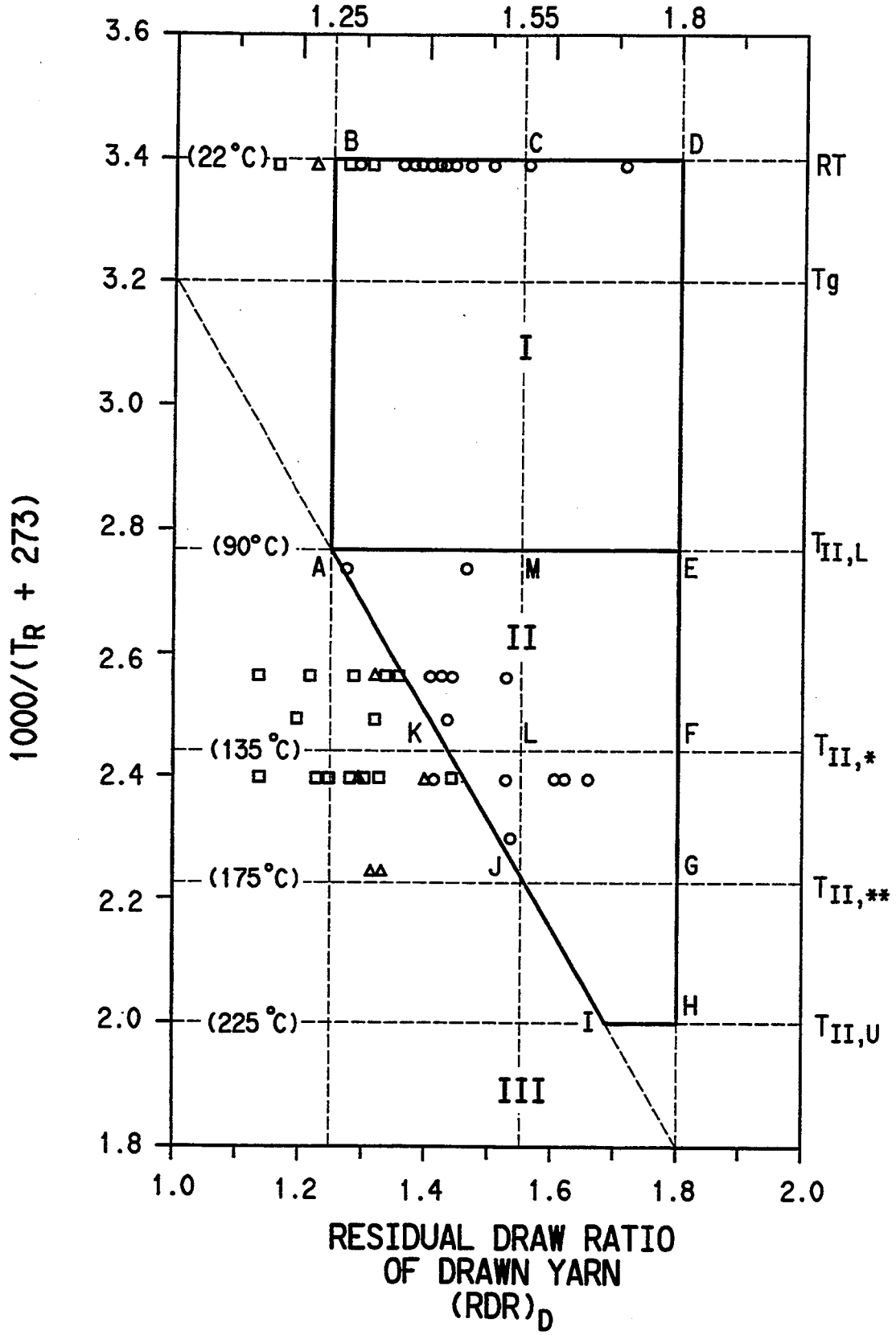
FIG. 9 is a graphical representation of the reciprocal of the relaxation temperature ($T_R$, °C.), as given by the $1000/(T_R+273)$, versus the residual draw ratio of the drawn yarns $(RDR)_D$. The regions I (ABDE) and II (AEHI) enclosed by heavy lines illustrate temperature conditions in the relaxation step ($T_R$) as related to the drawing step $(RDR)_D$ of the process useful to produce yarns with excellent large molecule dye uniformity ratings (LMDR).

FIG. 9 is a graphical representation of the reciprocal of the relaxation temperature ($T_R$, °C.), as given by the $1000/(T_R+273)$, versus the residual draw ratio of the drawn yarns $(RDR)_D$. The regions I (ABDE) and II (AEHI) enclosed by heavy lines illustrate temperature conditions in the relaxation step ($T_R$) as related to the drawing step ($RDR_D$) of the process useful to produce yarns with excellent large molecule dye uniformity ratings (LMDR). Line BCD corresponds to room temperature (RT), line AME corresponds to $T_{II,L}$ (about 90° C.), line KLF corresponds to $T_{II,*}$ (about 135° C.), line JG corresponds to $T_{II,}$ (about 175° C.) and line IH corresponds to $T_{II,U}$ (about 225° C. for nylon 66 polyamides or about TM-40° C. for other polyamides. Line AKJI corresponds to the equation: $[1000/(T_R+273)] \geqq K_1-K_2(RDR)_D$ which may be rearranged to give the expression: $T_R(°C.) \leqq [1000/(K_1-K_2(RDR)_D)]-273$ wherein, $K_1=1000/(T_{II,L}+273)+1.25K_2$ and, $K_2=[1000/(T_{II,L}+273)-1000/(T_{II,}+273)]/0.3$. For most nylons the values of $K_1$ and $K_2$ are about 4.95 and 1.75, respectively. For nylons with lower melting points ($T_M$), such as nylon 6 with a melting point about 40° C. lower than that of nylon 66 homopolymer, the values of $T_{II,L}$ and $T_{II,**}$ are typically lower giving different values for $K_1$ and $K_2$ (see FIG. 18 for comparison of TMA curves for high speed spun nylon 6 and nylon 66 homopolymers).

Figure 10:
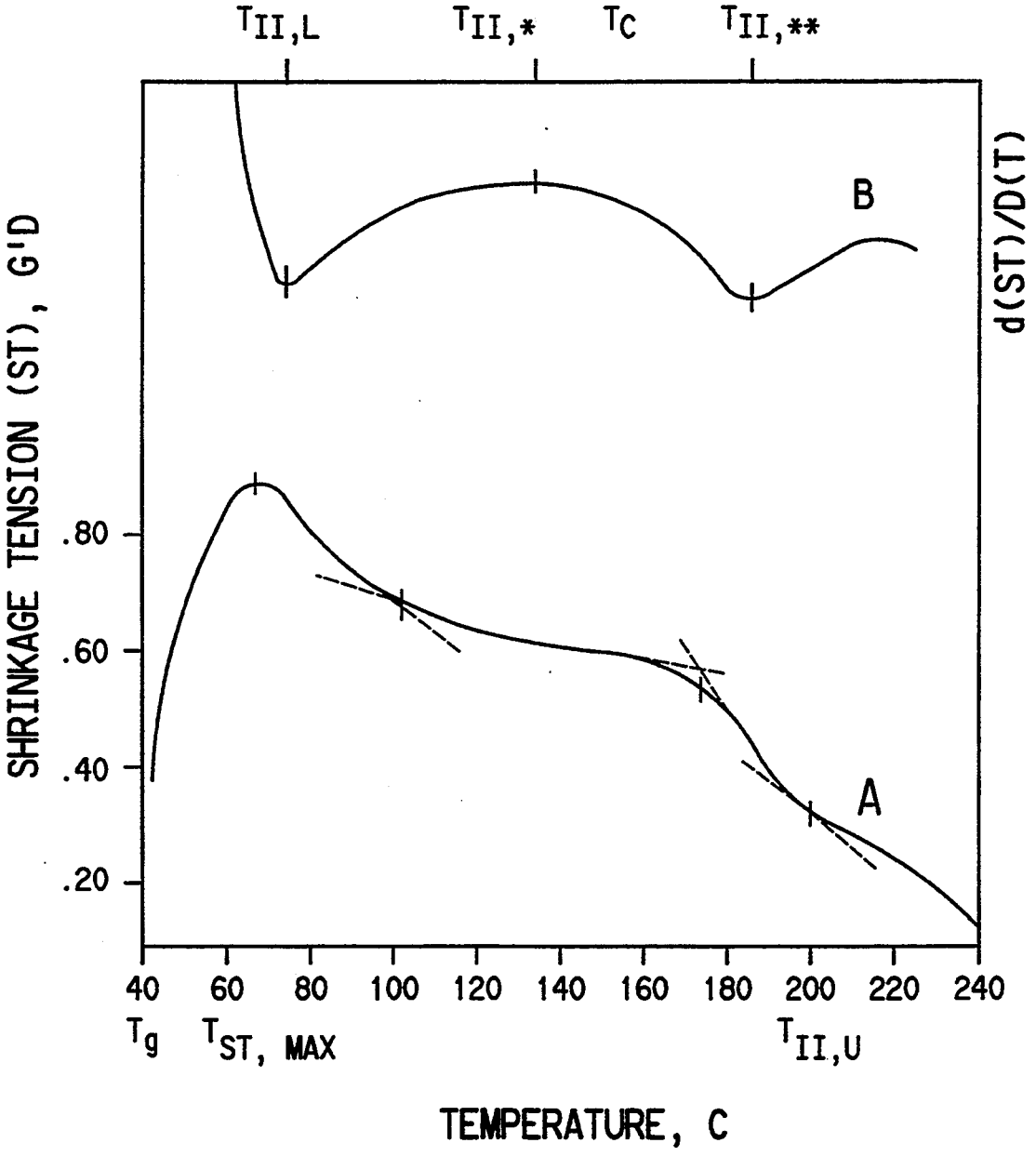
FIG. 10 (Line A) is a plot of dynamic shrinkage tension (ST), under constant length conditions at a heating rate of 30° C. per minute versus temperature, which increases sharply at temperature $T_g$ and reaches a maximum at $T_{ST,max}$; and Line B is the corresponding derivative, d(ST)/d(T), of the dynamic shrinkage tension (ST) versus temperature (T) plot (Line A). The derivative plot (B) exhibits minimum values which correspond approximately with temperatures $T_{II,L}$ and $T_{II,**}$, respectively, and a broad maximum which corresponds approximately with the range between temperatures $T_{II*}$ and $T_c$.

FIGS. 10 thru 13 are representative thermal responses of nylon feed yarns showing similar thermal transitions as in FIG. 6. FIG. 10 (Line A) is a plot of dynamic shrinkage tension (ST), under constant length conditions at a heating rate of 30° C. per minute versus temperature, which increases sharply at temperature Tg and reaches at maximum value at $T_{STmax}$ and then decreases sharply to a temperature, here denoted as $T_{II,L}$ and continues to decrease less sharply between $T_{II,L}$ and a temperature, here denoted as $T_{II,}$ and then decreases more rapidly thereafter. The $T_{STmax}$ is frequently associated with the onset of major polymer chain mobility and subsequent nucleation. The especially preferred draw temperature ($T_D$) is typically between Tg and $T_{II,L}$. Most yarns in the examples were drawn near $T_{STmax}$. FIG. 10 (Line B) is the corresponding derivative, d(ST)/d(T), of the dynamic shrinkage tension (ST) versus temperature (T) plot (Line A). The derivative plot (B) exhibits minimum values which correspond approximately with $T_{II,L}$ and $T_{II,}$, respectively, and a broad maximum which corresponds approximately with the temperature range of $T_{II*}$ to $T_c$.

Figure 11:
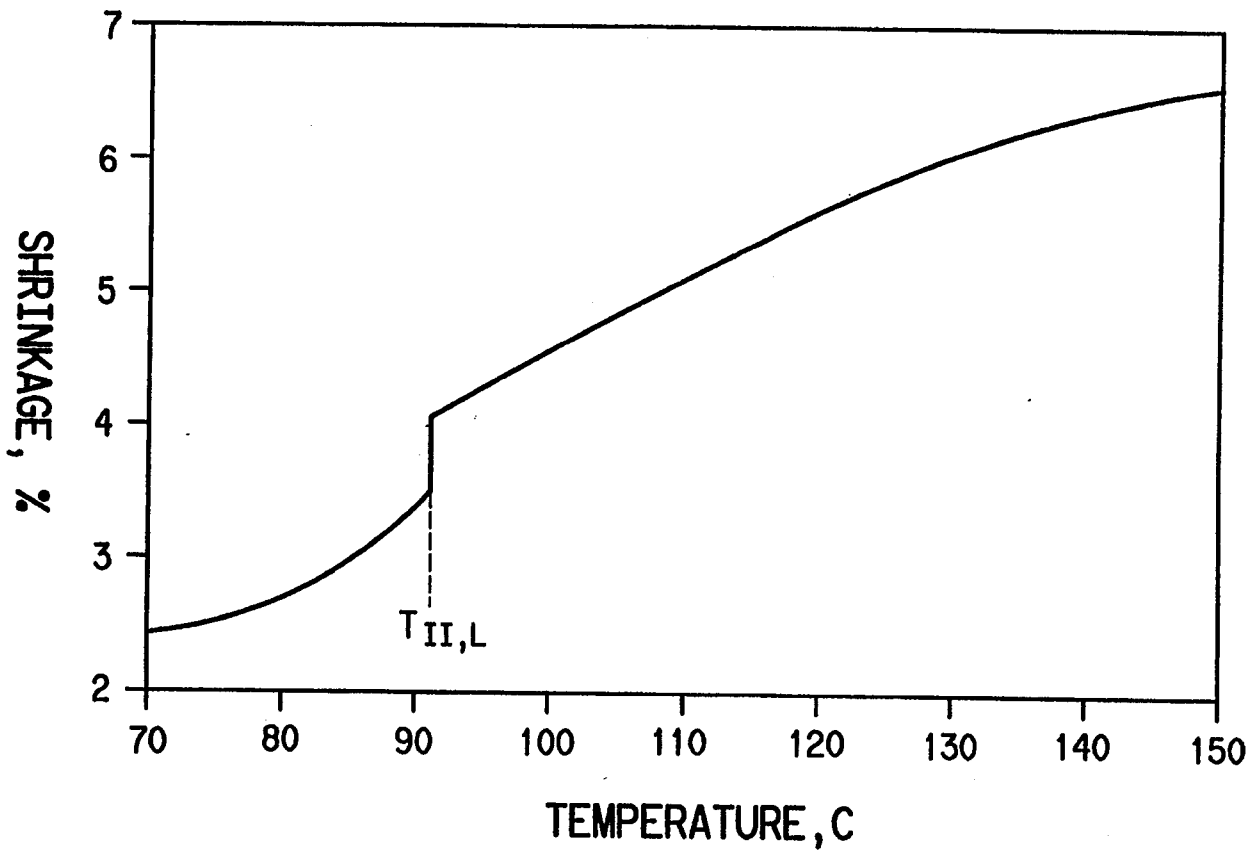
FIG. 11 is a typical plot of dry heat shrinkage measured using the Lawson-Hemphill TYT by increasing temperatures stepwise from 70° C. to 150° C.

FIG. 11 is a typical plot of shrinkage measured using the Lawson-Hemphill TYT by increasing temperatures stepwise from 70° C. to 150° C. The shrinkage increases sharply at about 90° C. which is similar to that observed using the Du Pont TMA (see FIG. 4). The temperature of the sharp increase in shrinkage is associated with temperature $T_{II,L}$.

Figure 12:
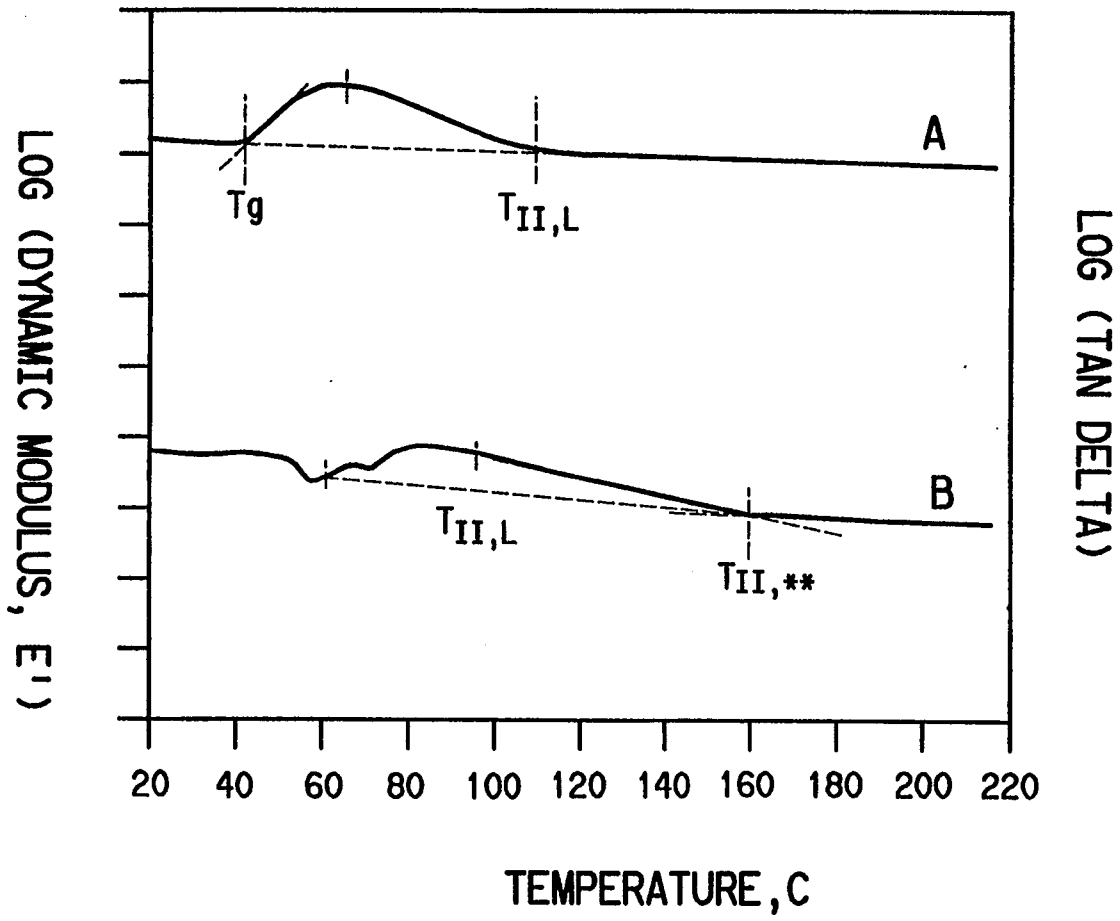
FIG. 12 is a typical plot of the logarithm of the dynamic modulus (E') versus temperature (line A) and of the corresponding logarithm of the Tan Delta versus temperature (line B).

FIG. 12 is a typical plot of the logarithm of the dynamic modulus (E'), Line A, and of the corresponding logarithm of the Loss Tan Delta, Line B, versus temperature; wherein, both are measured using a rheovibron at a heating rate of 5° C./minute. The characteristic thermal transitions are marked and compared to those observed in FIGS. 6 and 10.

Figure 13:
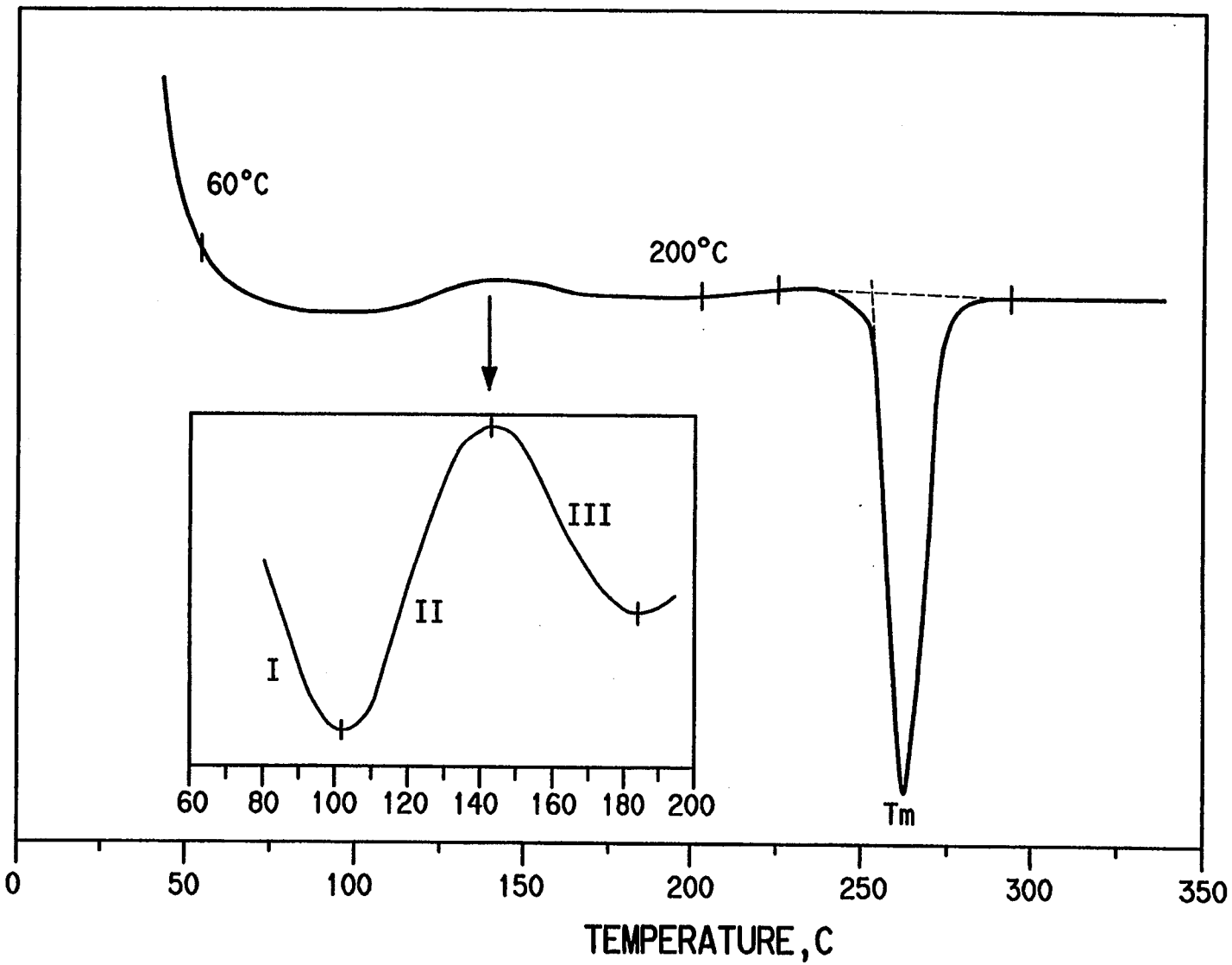
FIG. 13 is a typical plot of the change in heat flow versus temperature as measured by Differential Scanning Calorimetry (DSC). An inset enlargement of temperature range of 60° C. to 200° C. shows three thermal transitions attributed to $T_{II,L}$, $T_{II,*}$ and $T_{II,**}$, respectively.

FIG. 13 is a typical plot of the change in heat flow versus temperature as measured by Differential Scanning Calorimetry (DSC). An inset enlargement of temperature range of 60° C. to 200° C. shows three thermal transitions attributed to $T_{II,L}$, $T_{II,*}$, and $T_{II,**}$, respectively. The onset of the melting endotherm at about 225° C. for this nylon 66 yarn is associated with $T_{II,U}$ and is about 40° C. less than the melting point $T_M$.

Figure 14:
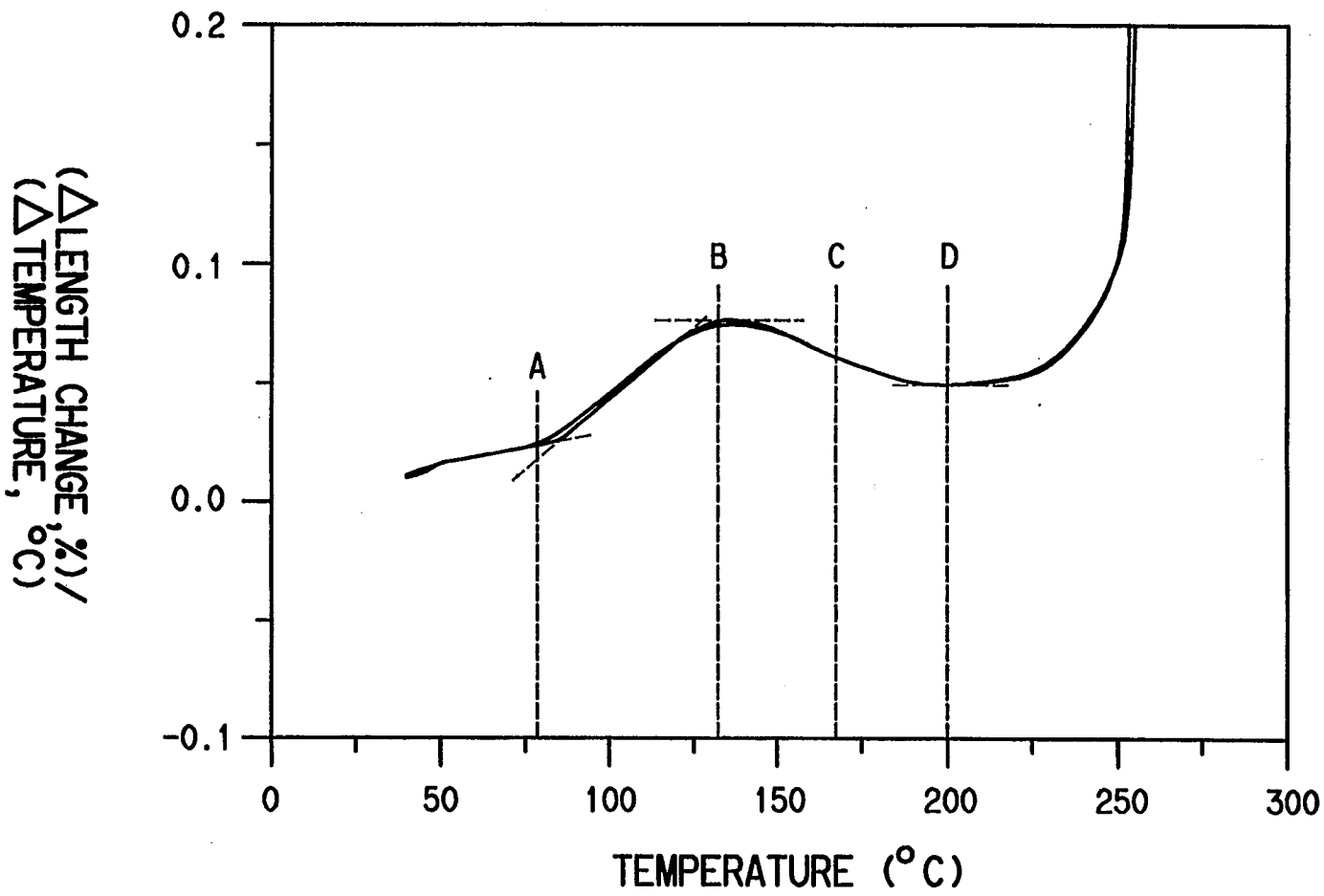
FIGS. 14 and 15 are typical plots of the TMA dynamic extension rate versus temperature for drawn yarns; wherein the drawn yarns of FIG. 14 have a LMDR less than 6 and those of FIG. 15 have a LMDR greater than 6.
Figure 15:
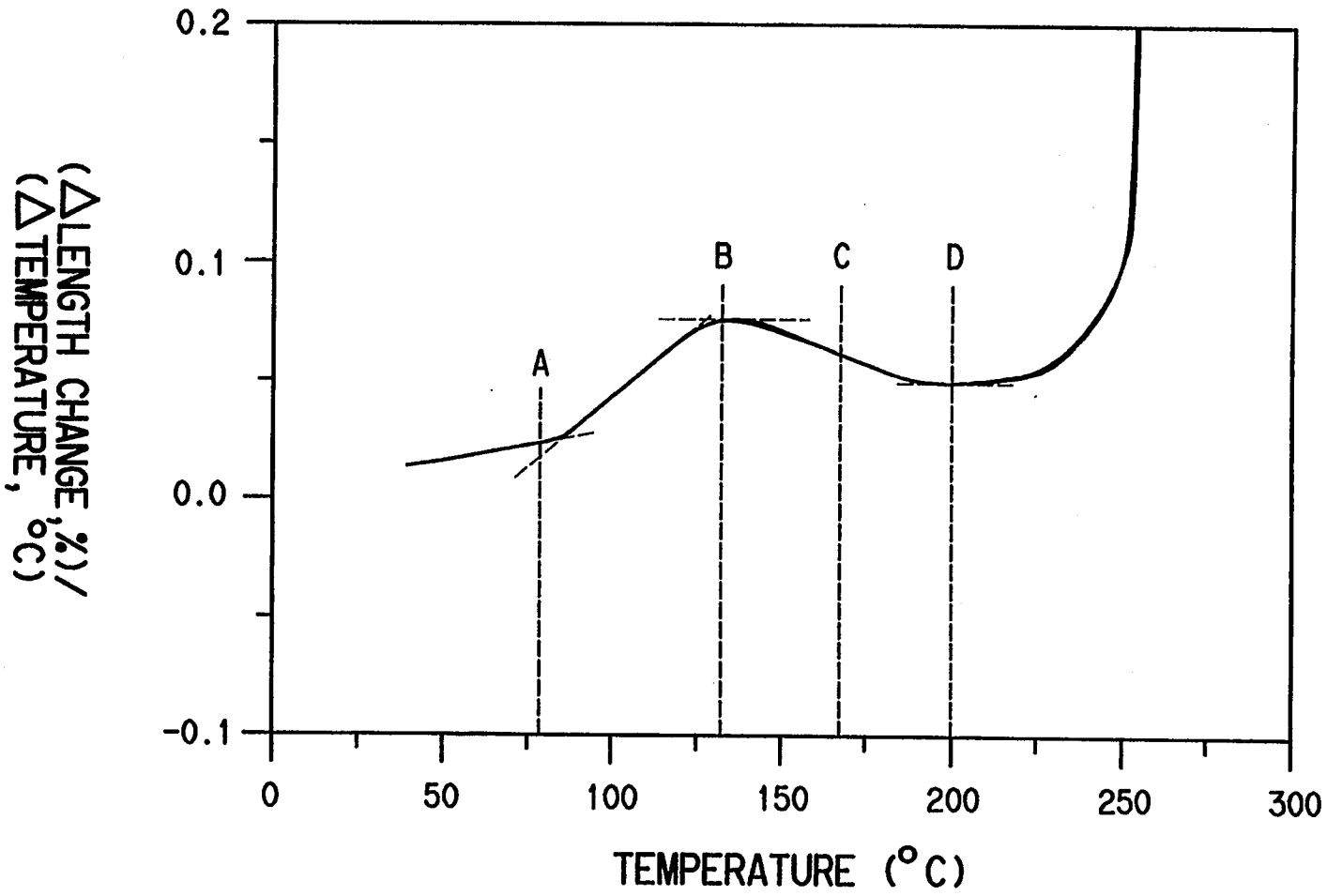

FIGS. 14 and 15 are typical plots of the TMA dynamic extension rates at 300 mg/d pre-tension versus temperature for the warp drawn yarns of Examples IV-3 and IV-10, respectively; wherein the yarns of Ex. IV-10 have a LMDR>6 and the yarns of Ex. IV-3 have a LMDR of less than 6 which corresponds to the greater variability of ($\Delta L/\Delta T$) versus temperature between temperatures A and D, especially between A and C (compare FIG. 14 versus FIG. 15).

Figure 16:
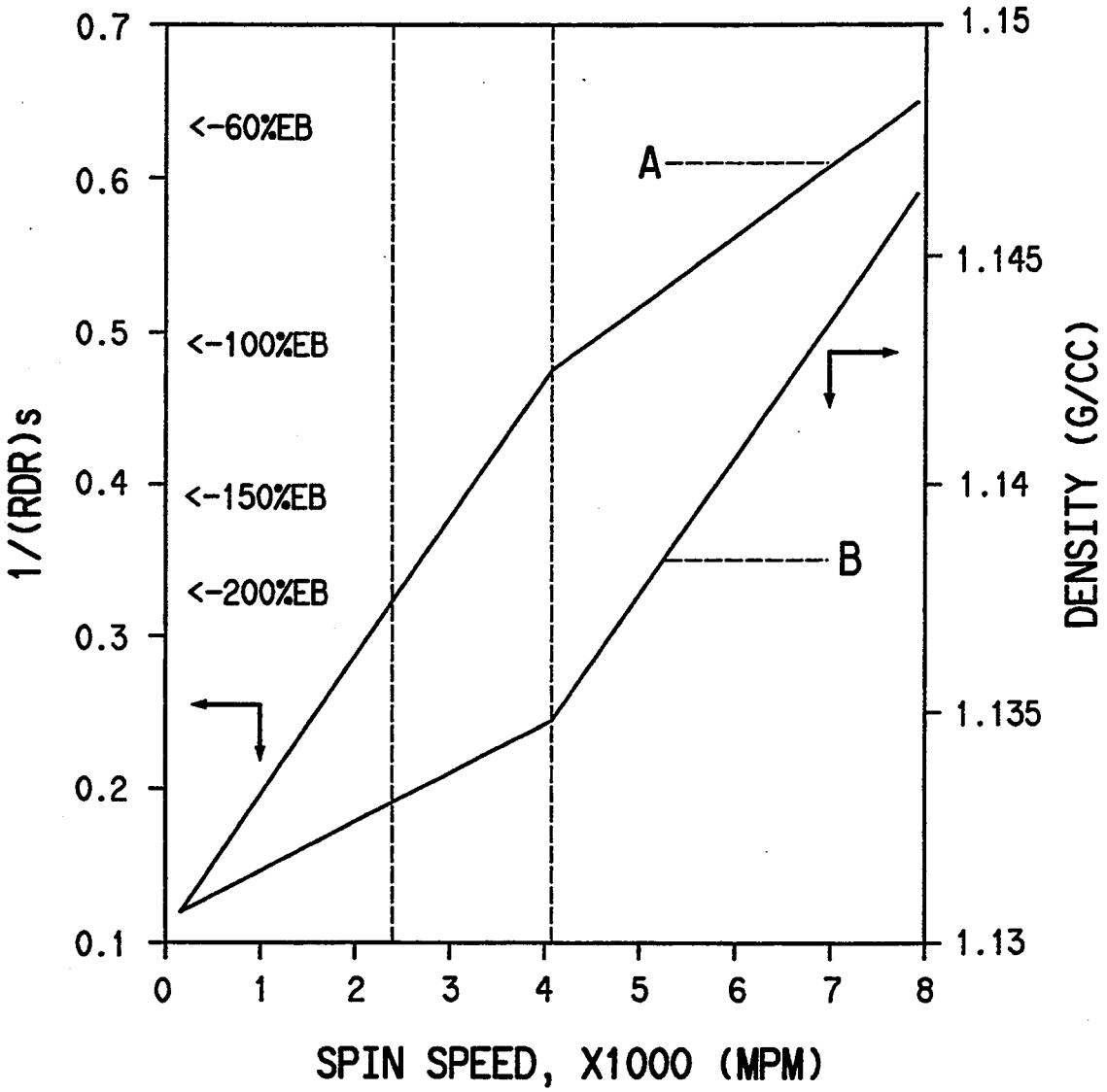
FIG. 16 is a representative plot of the residual draw ratio of as-spun nylon 66 yarns $(RDR)_S$ expressed by its reciprocal, $1/(RDR)_S$, (line A) and of density (line B) versus spin speed.
Figure 17:
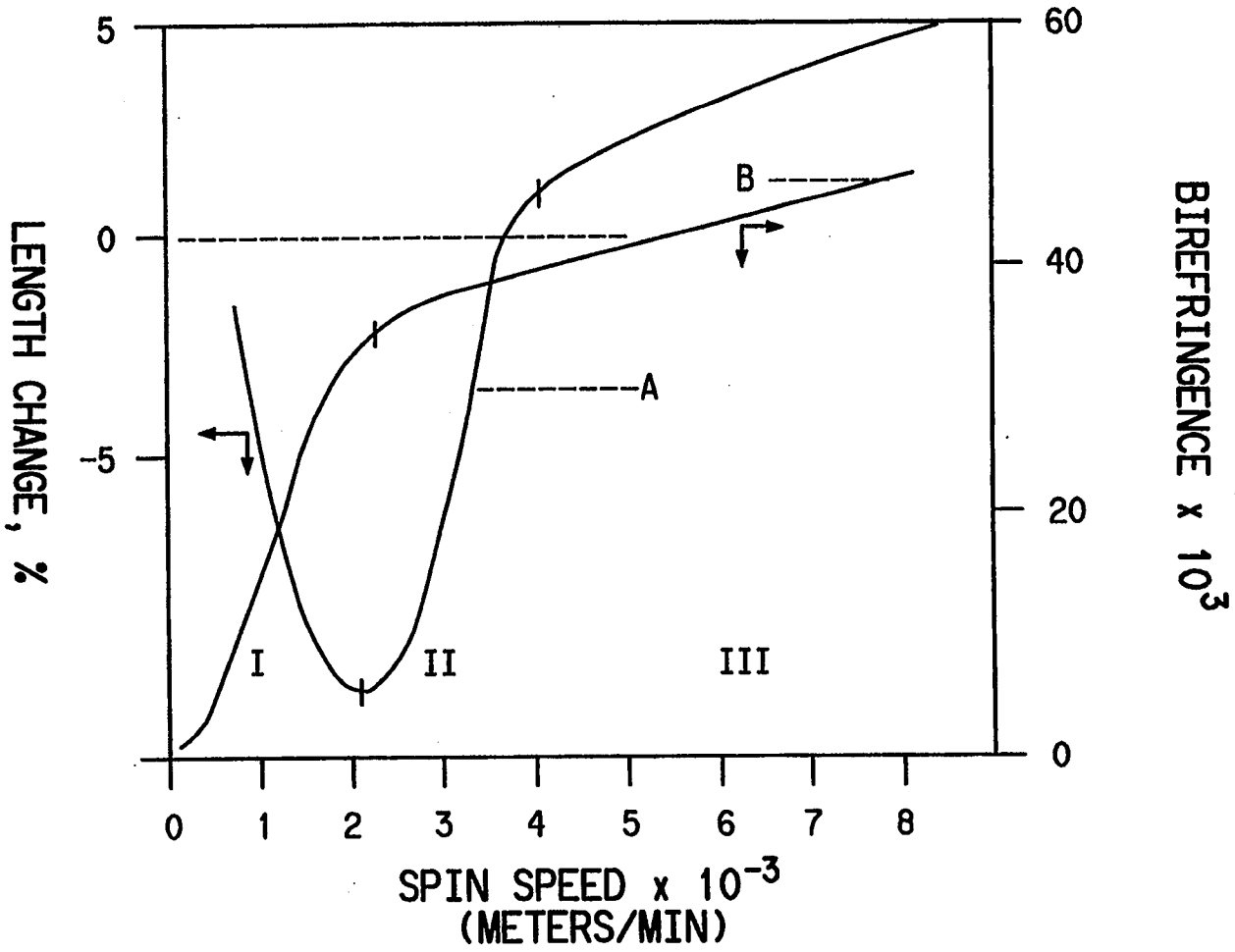
FIG. 17 is a representative plot of the length change after boil-off of freshly as-spun yarns (line A) and of birefringence (line B) versus spin speed.

FIGS. 16 and 17 are plots of important as-spun nylon 66 yarn properties versus spin speed ($V_s$) but the general behavior is also found for nylon 6. FIG. 16 (line A) is a representative plot of the residual draw ratio of as-spun nylon 66 yarns $(RDR)_S$ expressed by its reciprocal, $1/(RDR)_S$ (which is approximately proportional to the degree of molecular chain extension and frequently referred to as the yarn spun draw ratio) versus spin speed ($V_s$), and is,observed to increase linearly with increasing spin speed ($V_s$) over the range of 1000 mpm to about 4000 mpm, and then increases linearly at a reduced rate versus spin speed over the range of about 4000 to about 8000 mpm. The absolute value of $(RDR)_S$ is known to vary with polymer RV and dpf, for example, but the importance of FIG. 16 Line A is the transition in behavior of $(RDR)_S$ at about 4000 mpm. Above about 4000 mpm no thermal/mechanical stabilization is usually required to provide a stable yarn package. Below about 4000 mpm, the as-spun yarn must be further stabilized to provide a useful yarn package for warp drawing (see discussion of FIG. 1).

In FIG. 16 (Line B) the density ($\sigma$) increases with increasing spin speed and increases more sharply above about 4000 mpm. It is found that feed yarns having a $(RDR)_S$ of the spun yarn less than about 2.75, corresponding to $1/(RDR)_S$ value of greater than about 0.364 are preferred for drawing. FIG. 16 does not alone indicate a reason for the requirement of an $(RDR)_S$ value less than about 2.75.

FIG. 17 (line A) is a representative plot of the length change after boil-off of spun yarns not permitted to age more than 24 hours versus spin speed. Up to about 2000 mpm the spun yarns elongate in boiling water (region I). Between about 2000 and about 4000 mpm the spun-yarns elongate in boiling water, but with a less extent versus spin speed (region II). Above about 4000 mpm, the as-spun yarns shrink in boiling water (region III).

In FIG. 17 (line B) the corresponding birefringence (an) values for these yarns are plotted versus spin speed. There is observed a reduction in the rate of increase in birefringence versus spin speed at about 2000 mpm which is believed to be associated with the transition between region I and region II behavior and attributed to the onset of stress-induced nucleation on the spin-line. The transition between regions I and II corresponds approximately to an as-spun yarn $(RDR)_S$ of less than about 2.75. Feed yarns with as-spun yarn properties indicative of region I can not be "dry" drawn to give LMDR of greater than 6. Yarns used in this invention are of regions II and III and preferably of region III for it is observed that yarns of region III have very little sensitivity to moisture-on-yarn during finish application on dye level (MBB) and their yarn properties are more stable with time on storage.

Figure 18:
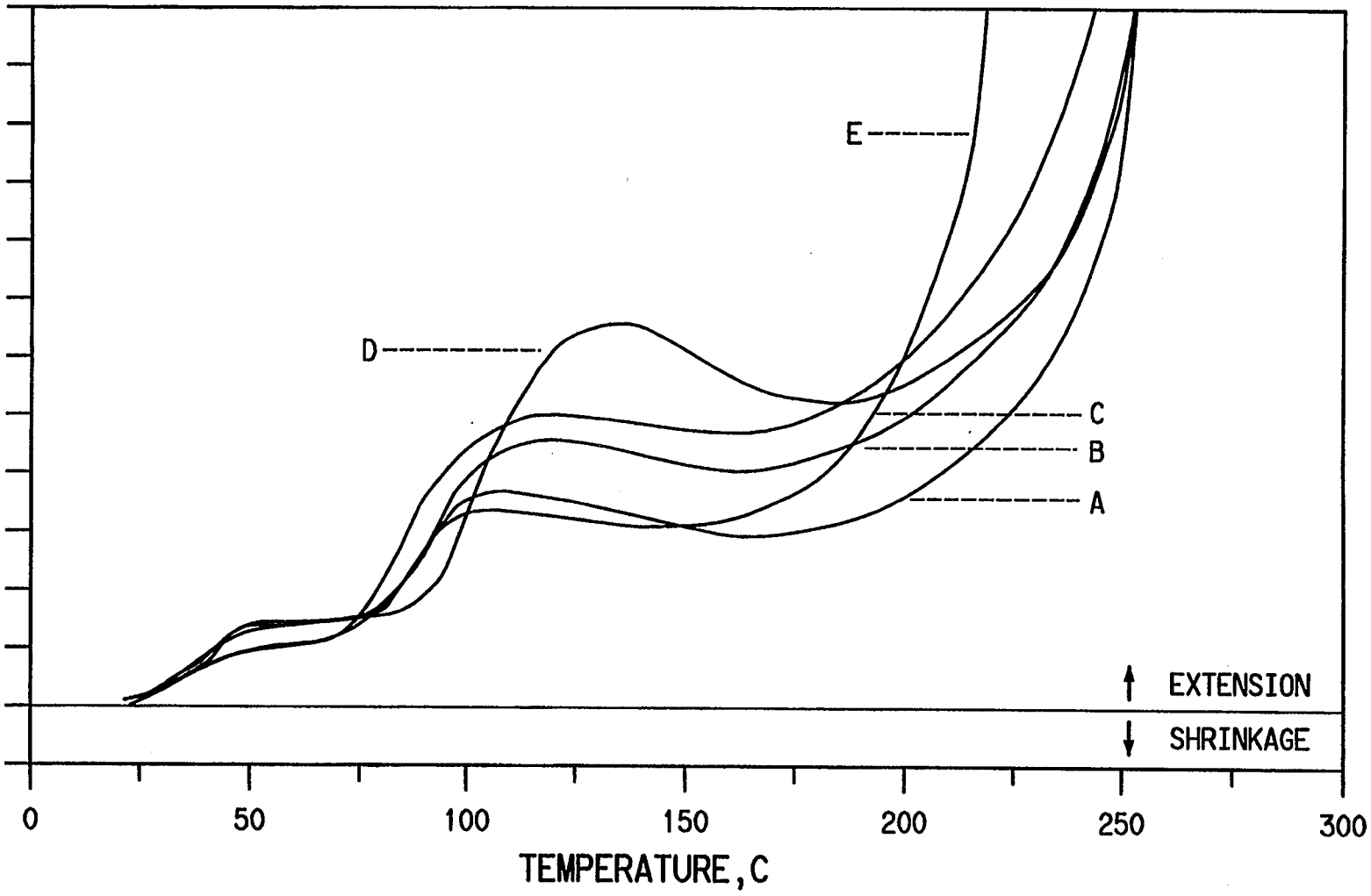
FIG. 18 is a representative TMA plot of the dynamic extension rates ($\Delta L/\Delta T$) under a 300 mg/d tension versus temperature for various spun-oriented and partial drawn yarns used in the Examples as feed yarns for warp drawing.

FIG. 18 is a representative TMA plot of the dynamic extension rates ($\Delta L/\Delta T$) under a 300 mg/d tension versus temperature for various feed yarn types: A=-nominal 50 RV nylon 66 yarn spun at 5300 mpm and containing 5% Me5-6; B=nylon 66 homopolymer yarn spun at 5300 mpm (Yarn J of Example I); C=nylon copolymer yarn spun at 5300 mpm (Yarn K of Example I); D=nylon partial drawn yarn (indicative of Yarns D-F of Example I); E= nominal 47 RV nylon 6 homopolymer yarn spun at 5300 mpm. Nylon 6 feed yarns are shifted about 20°-30° C. to lower temperatures versus nylon 66 feed yarns which reduces the maximum relaxation temperature $(T_R)_{MAX}$ for nylon 6 by about 20°-30° C. versus that for nylon 66 homopolymer.

Figure 19:
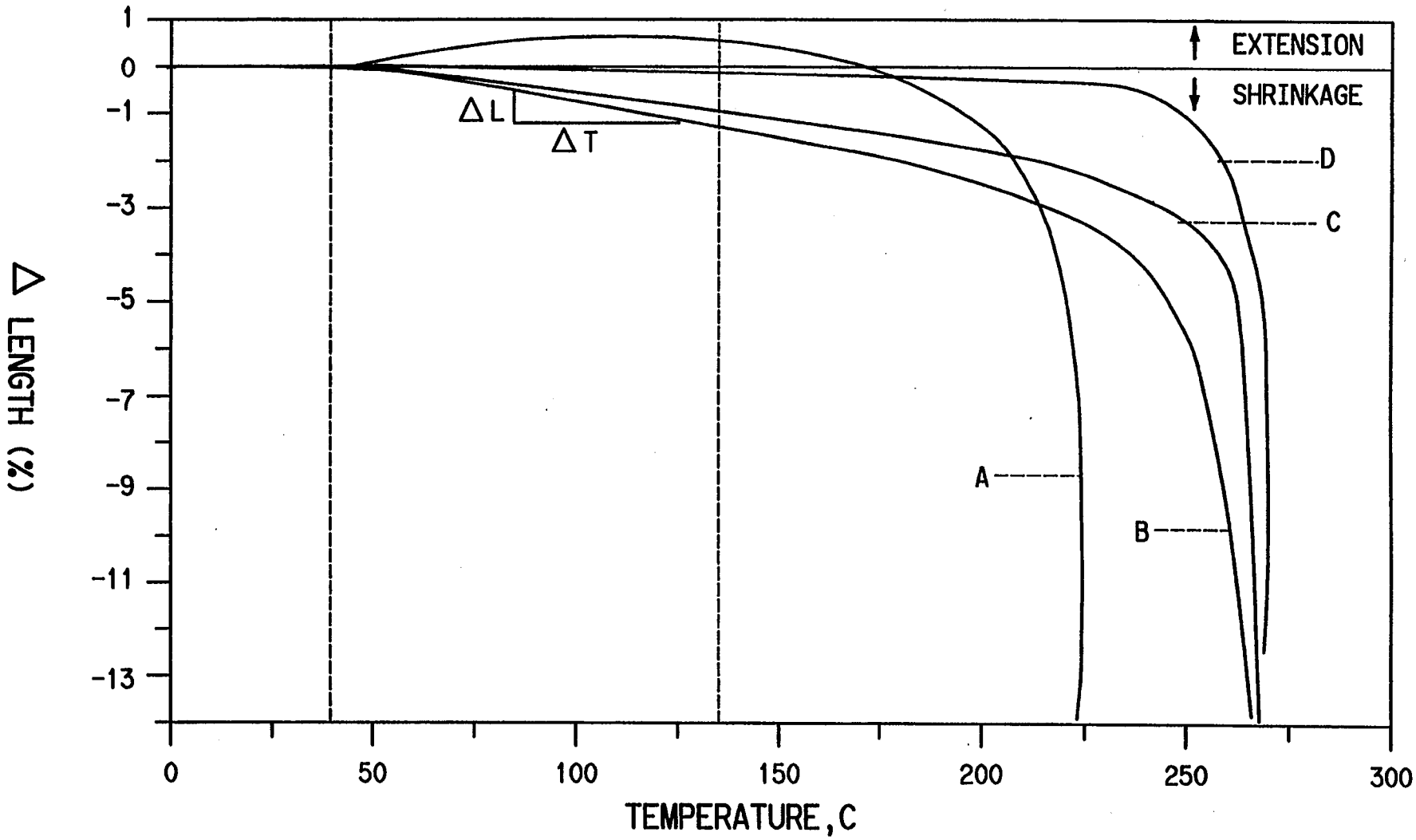
FIG. 19 is a representative TMA plot of shrinkage ($\Delta$Length, %) versus temperature under a 5 mg/d tension for different yarn types.

FIG. 19 is a representative TMA plot of shrinkage ($\Delta$Length, %) versus temperature under a 5 mg/d tension for different yarn types. Most feed yarns shrink with increasing temperature especially between 40° C. and 135° C.; however, Yarn A initially elongates and only shrinks at temperatures above about 150° C. Yarn A is not a preferred feed yarn since it does not shrink, but elongates between 40° and 135° C. (i.e., $\Delta L>0$); and also since it is characterized by a positive rate of length change, herein referred to as a "positive dynamic shrinkage rate" (i.e., $\Delta L/\Delta T>0$), °C.). Preferred feed yarns for draw have a negative dynamic length change and a negative dynamic shrinkage rate over the temperature range of 40° C. and 135° C.

Figure 20:
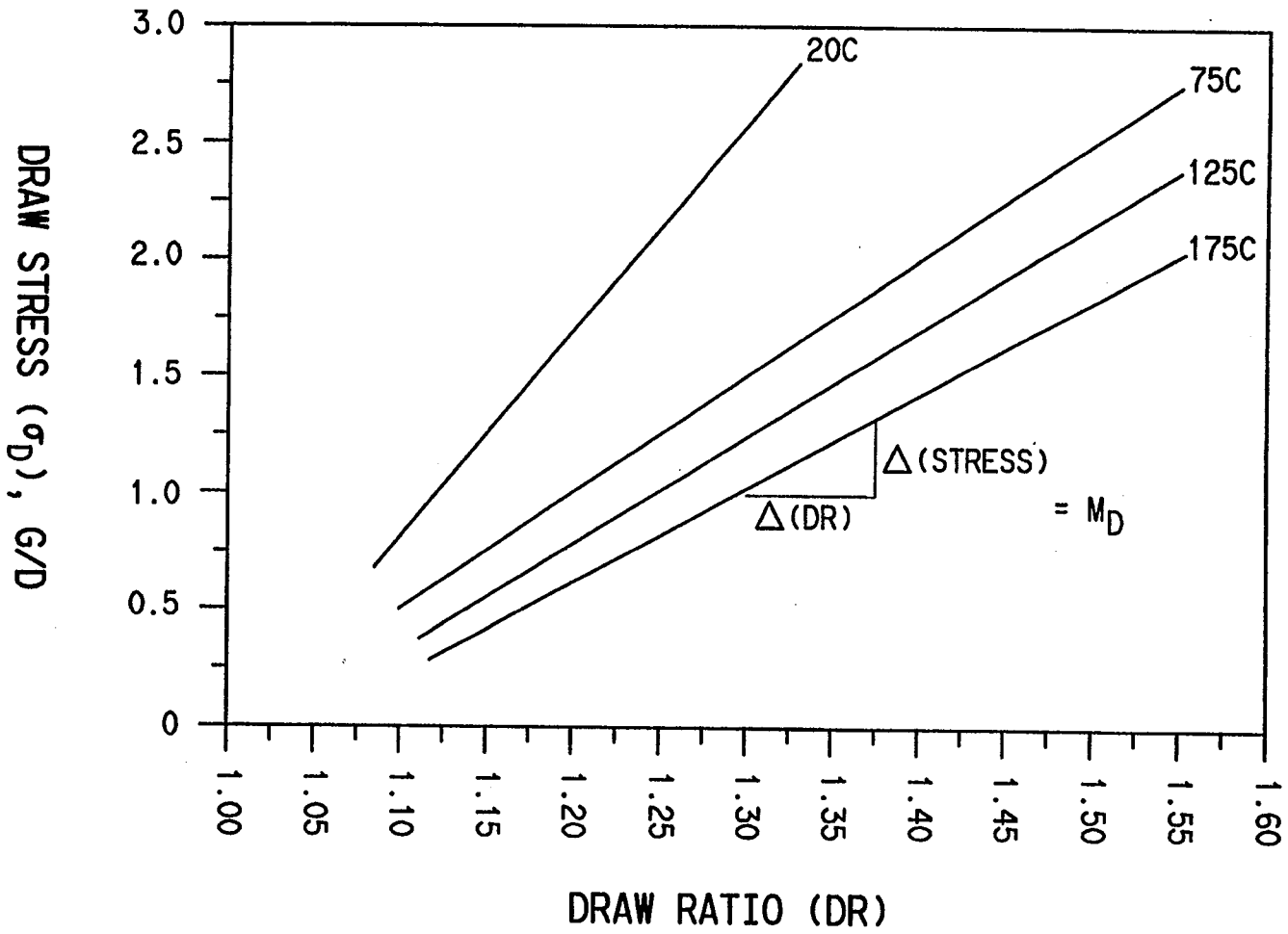
FIG. 20 is a representative plot of draw stress ($\sigma_D$), expressed as a grams per drawn denier (g/dd), versus draw ratio at 20° C., 75° C., 125° C., and 175° C.; wherein, the slope is called the draw modulus ($M_D$) and is defined by ($\Delta\sigma_D/\Delta$ DR).

FIG. 20 is a representative plot of draw stress ($\sigma_D$), expressed as a grams per drawn denier, versus draw ratio at 20° C., 75° C., 125° C., and 175° C. The draw stress ($\sigma_D$) increases linearly with draw ratio above the yield point and the slope is called herein as the draw modulus ($M_D$) and is defined by ($\Delta\sigma_D/\Delta DR$). The values of draw stress ($\sigma_D$) and draw modulus ($M_D$) decrease with increasing draw temperature ($T_D$).

Figure 21:
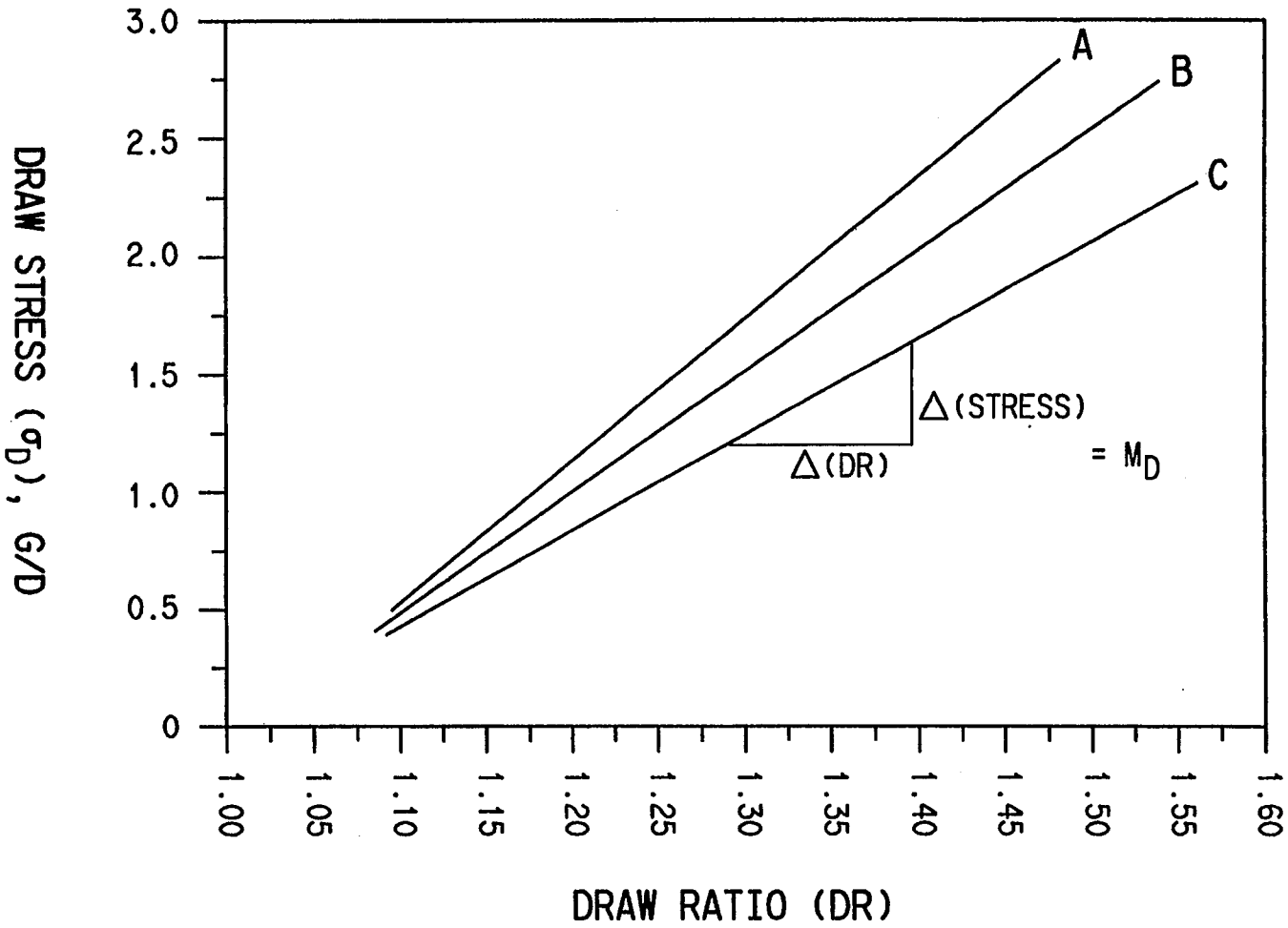
FIG. 21 compares the draw stress ($\sigma_D$) versus draw ratio (DR) at 75° C. for various feed yarns.

FIG. 21 compares the draw stress ($\sigma_D$) versus draw ratio (DR) at 75° C. for various feed yarns (A=nominal 65 RV nylon 66 homopolymer spun at 5300 mpm; B=nominal 68 RV nylon 6,66 copolymer spun at 5300 mpm; C=nominal 40 RV nylon 66 homopolymer spun at about 3300 mpm). The desired level of draw stress ($\sigma_D$) and draw modulus ($M_D$) can be controlled by selection of feed yarn type and draw temperature ($T_D$). Preferred draw feed yarns have a draw stress ($\sigma_D$) between about 1.0 and about 2.0 g/dd, and a draw modulus ($M_D$) between about 3 and about 7 g/dd, as measured at 75° C. and at a 1.35 draw ratio (DR) taken from a plot of draw stress ($\sigma_D$) versus draw ratio.

Figure 22:
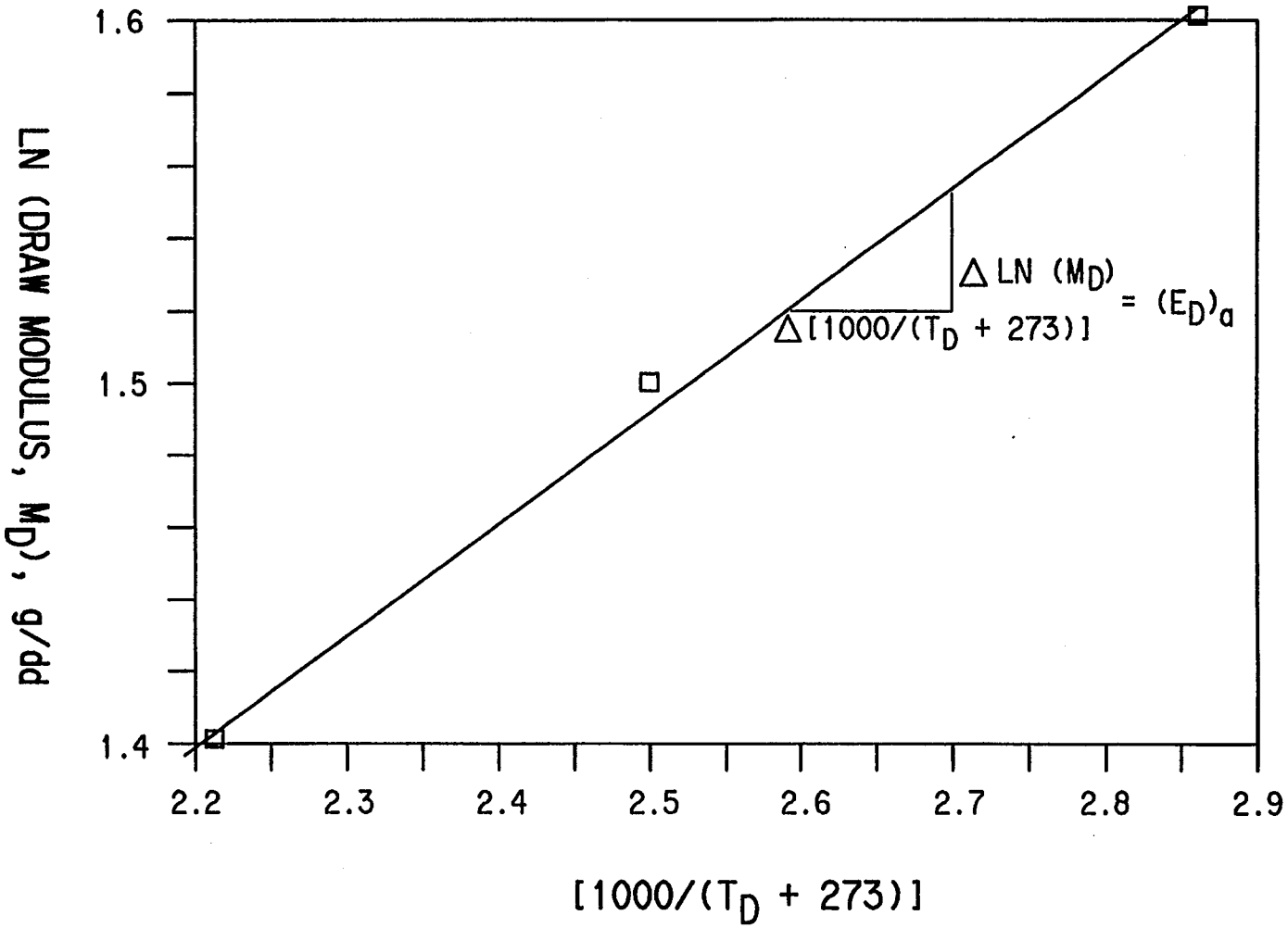
FIG. 22 is a representative plot of the logarithm of draw modulus, $\ln(M_D)$, versus [1000/($T_D$, °C.+273)] for the feed yarn in FIG. 21; wherein, the slope is taken as a measure of the draw energy ($E_D$).

FIG. 22 is a representative plot of the logarithm of draw modulus, $\ln(M_D)$, versus $[1000/(T_D, C+273)]$ for the three yarns in FIG. 21. The slope of the linear relations in FIG. 22, is taken as an apparant draw energy $(E_D)_A$ assuming an Arrhenius type dependence of $M_D$ on temperature (i.e., $M_D=A\exp(E_D/RT)$, where T is temperature in degrees Kelvin, R is the universal gas constant, and "A" is a material constant). Preferred draw feed yarns have an apparent draw energy $(E_D)_A$ $[=E_D/R=\Delta(\ln M_D)/\Delta\ (1000/T_D)$, where $T_D$ is in degrees Kelvin] between about 0.2 and 0.6 (g/dd)/°K.

Figure 23:
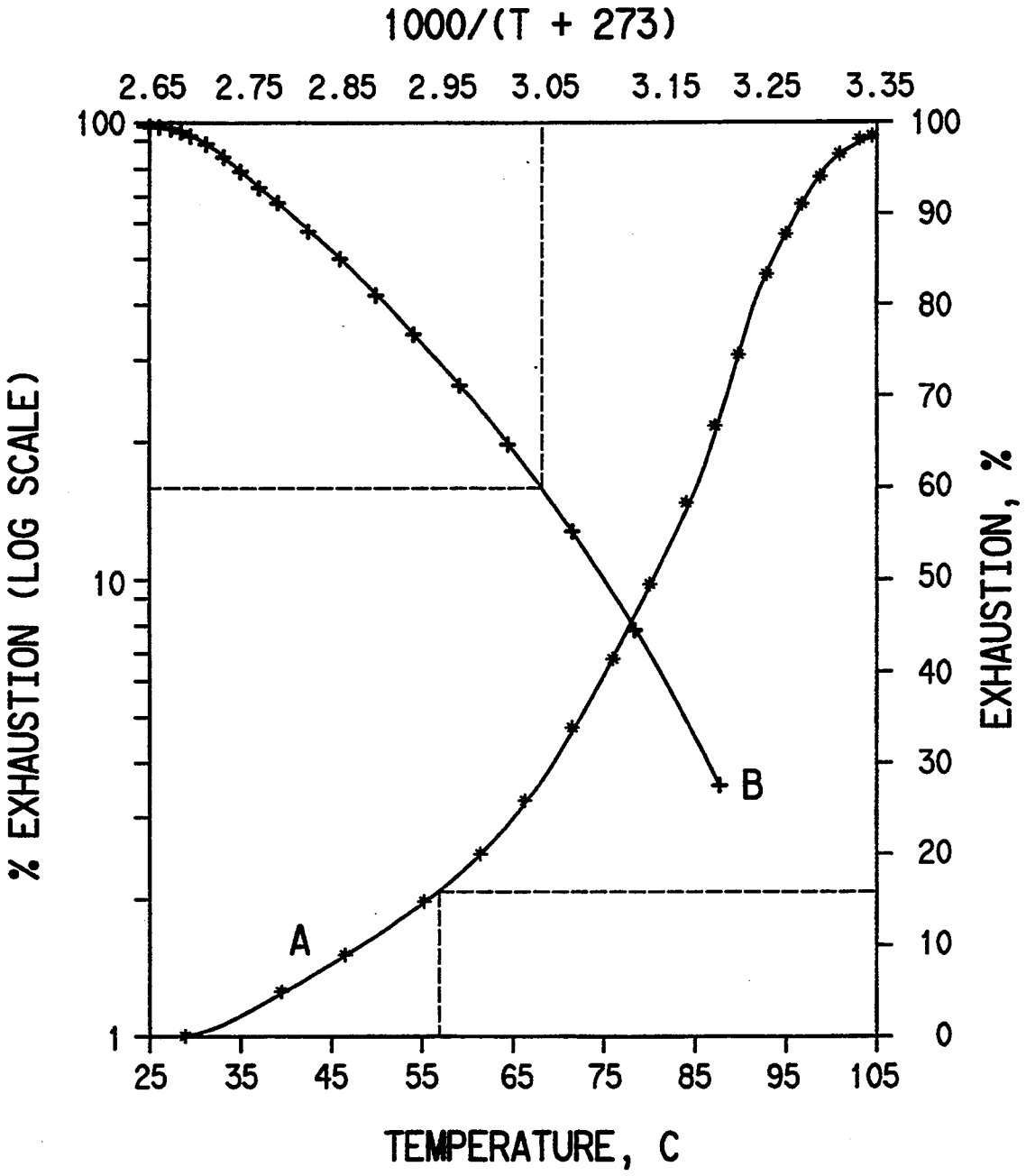
FIG. 23 (Line A) is a representative plot of percent dye exhaustion (% E) for C.I. Acid Blue 122 versus dye temperature (°C.) with an increase in dye exhaustion occurring at about 57°-58° C. which corresponds to the dye bath temperature to reach about 15% exhaustion referred herein to as the dye transition temperature, $T_{DYE}$.
Figure 24:
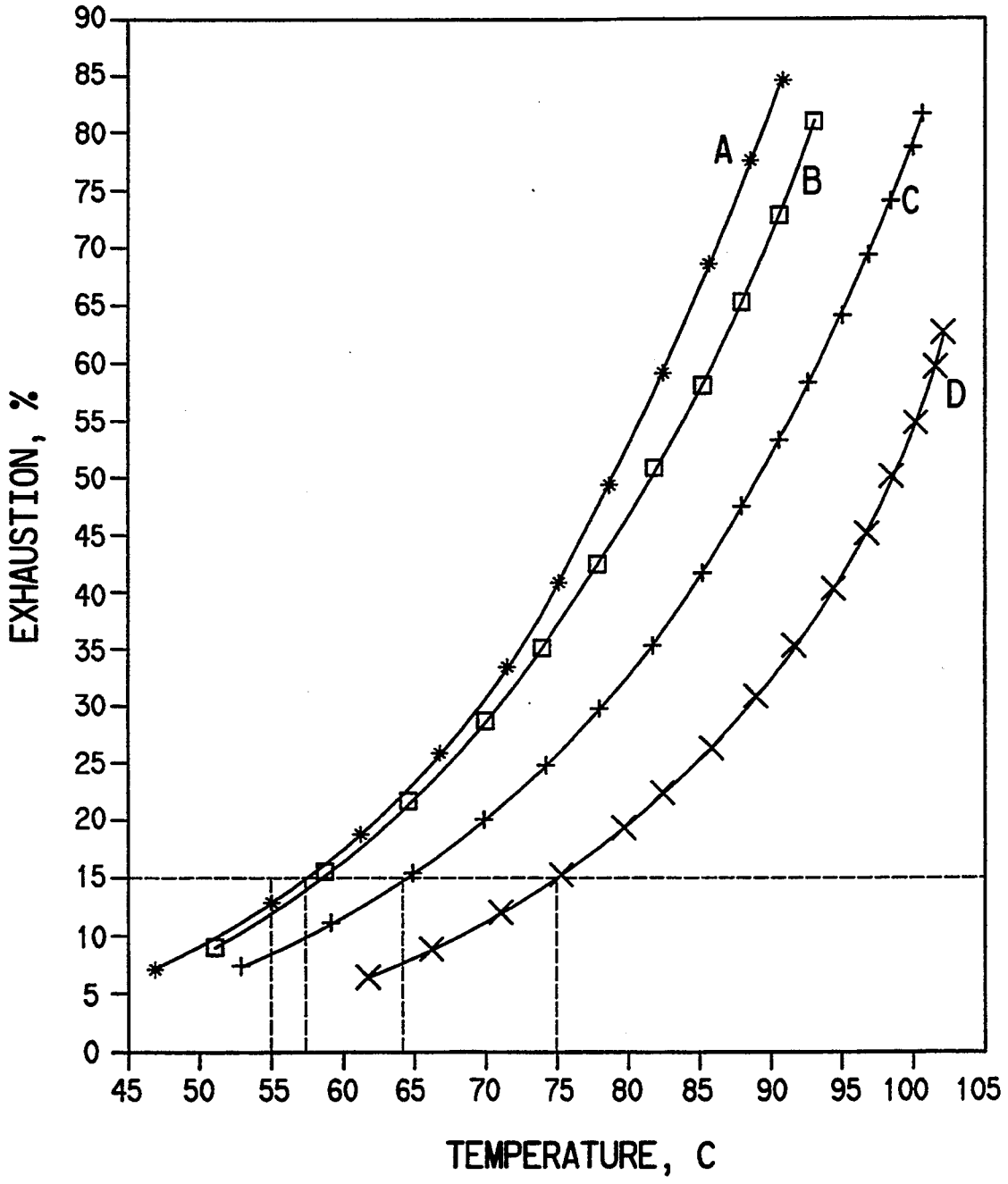
FIG. 24 is a representative plot of dye bath exhaustion curves similar to FIG. 23 (Line A), versus temperature for four drawn yarns made from Feed Yarn "G" in Table I.

FIG. 23 (Line A) is a representative plot of percent dye exhaustion (% E), for C.I. Acid Blue 122, versus dye temperature (°C.) with an increase in dye exhaustion occurring at about 57°–58° C., which corresponds to the dye bath temperature to reach about 15% exhaustion herein defined herein as the dye transition temperature, $T_{DYE}$. FIG. 23 (Line B) is a corresponding plot of Line A expressed as percent exhaustion on a logarithmic scale versus the reciprocal of the dye bath temperature expressed as 1000/(T+273). The dyeing transition temperature is not as apparent in the Log (% E) versus 1000/(T+273) plot; but the smoothed near-linear relationship permits a more accurate interpolation of the dye transition temperature ($T_{DYE}$), herein defined as the temperature T (°C.) at 15% dyebath exhaustion (using C.I. Acid Blue 122). FIG. 24 is a representative plot of dye bath exhaustion curves (C.I. Acid Blue 122) versus temperature for four warp drawn yarns made from Feed Yarn "G" in Table I; Curve A=1.15X DR/$T_R$ at 57° C.; and Curve B=1.15X DR/$T_R$ at 177° C.; Curve C=1.45X DR/$T_R$ at 57° C.; and Curve D=1.45X DR/$T_R$ at 177° C. Yarns A, B, and C have $T_{DYE}$ values less than about 65° C. and provide yarns for uniform dyed fabrics, while Yarn D has a $T_{DYE}$ value greater than 65° C. and does not provide dyed fabrics with acceptable uniformity when dyed with large molecule acid dyes.

Figure 25:
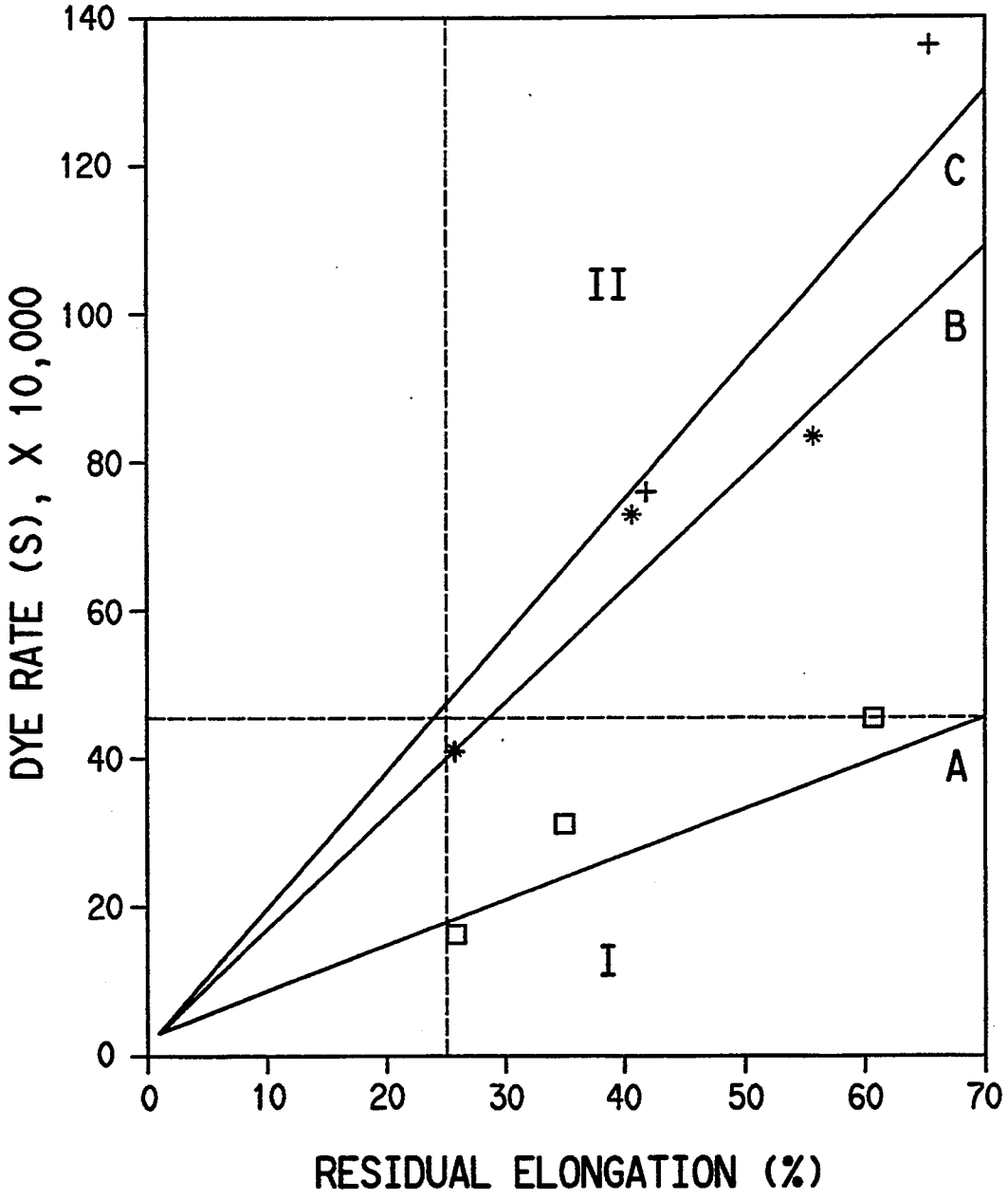
FIG. 25 is a representative plot of measured dye rate ($S_{25}$) using a large molecule acid dye C.I. Acid Blue 40, versus the residual elongation of drawn yarns made from different feed yarns.

FIG. 25 is a representative plot of measured dye rate ($S_{25}$) at 25° C. using a large molecule acid dye, C.I. Acid Blue 40, versus the residual elongation of warp drawn yarns made from different feed yarns; where Line A is from a feed yarn spun greater than about 4000 mpm (region III in FIGS. 16 and 17; Line B is from a feed yarn spun between about 2500 and 4000 mpm (region II in FIGS. 16 and 17), and Line C is from a feed yarn spun less than 2000 mpm (region I in FIGS. 6 and 17). The dye rate at a given residual elongation is observed to increase with the spin speed of the feed yarn used in the dry draw/dry relax warp draw process. Drawn yarns from feed yarn C are nonuniform at all drawing and relaxation process conditions and their nonuniformity is believed to be related to the apparently inherent lower dye rates of the drawn yarns from Region I feed yarns versus that of drawn yarns from feed yarns of Regions II and III, and the drawn yarns having such lower dye rates are also found to have $T_{DYE}$ values greater than 65° C.

Figure 26:
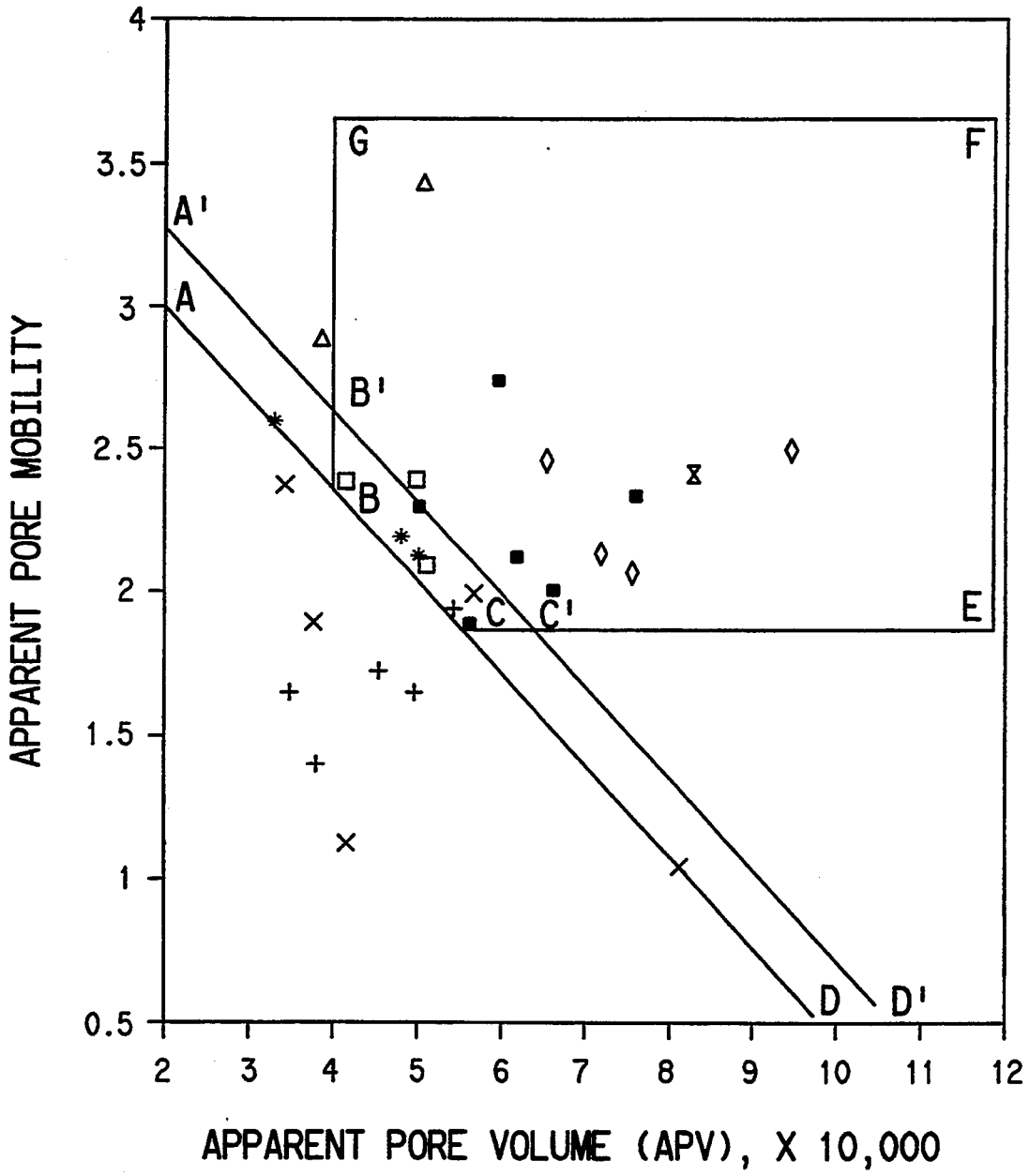
FIG. 26 is a plot of the Apparent Pore Mobility (APM), derived from the orientation of the amorphous polymer chain segments, versus the Apparent Pore Volume (APV), derived from the wide-angle x-ray diffraction scans, for different drawn yarns listed in Table X.
Figure 27:
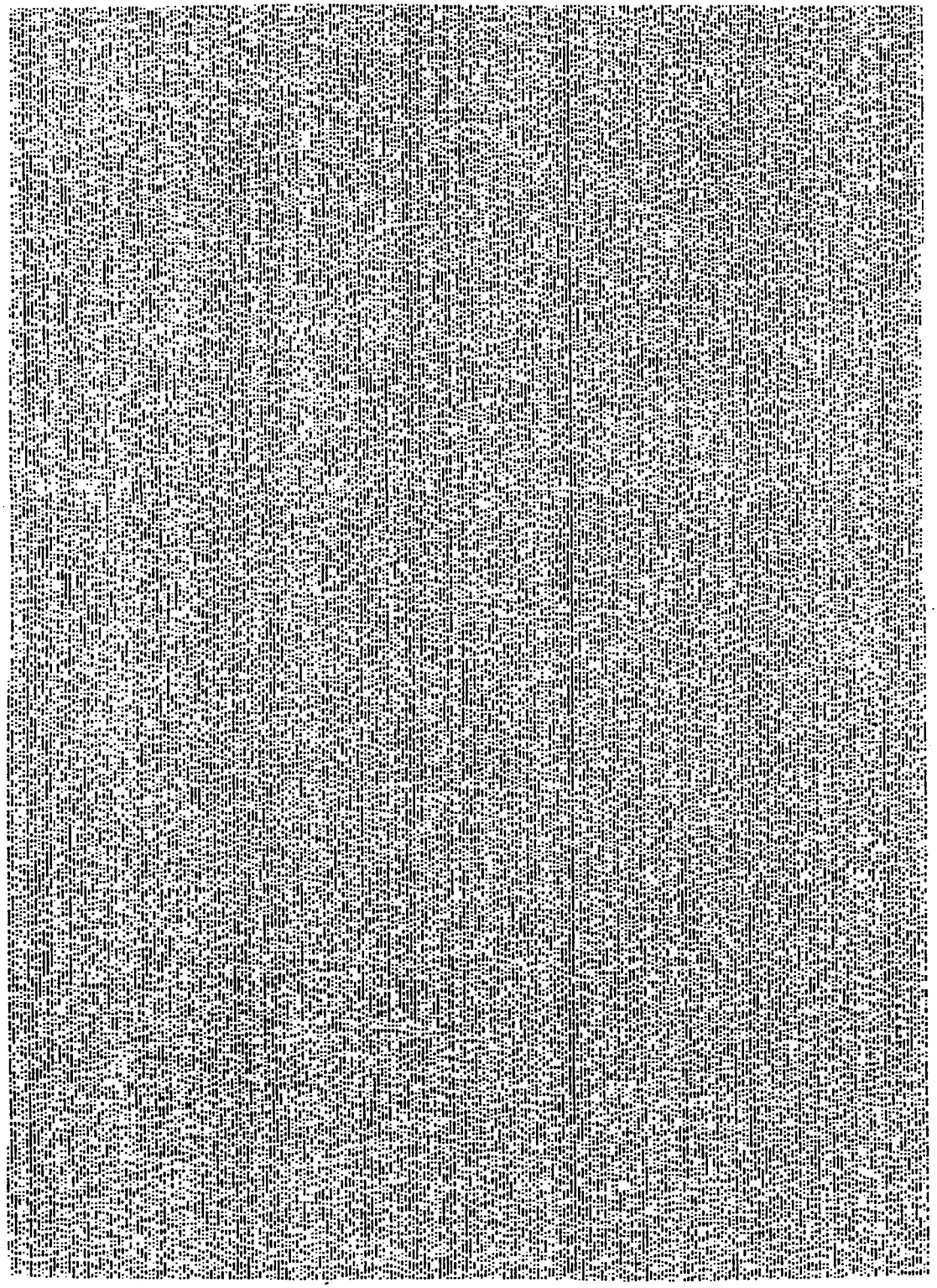
FIGS. 27-36 are computer generated simulations of fabric streaks useful as a guide to determine the LMDR of yarns produced in the examples of this application.
Figure 28:
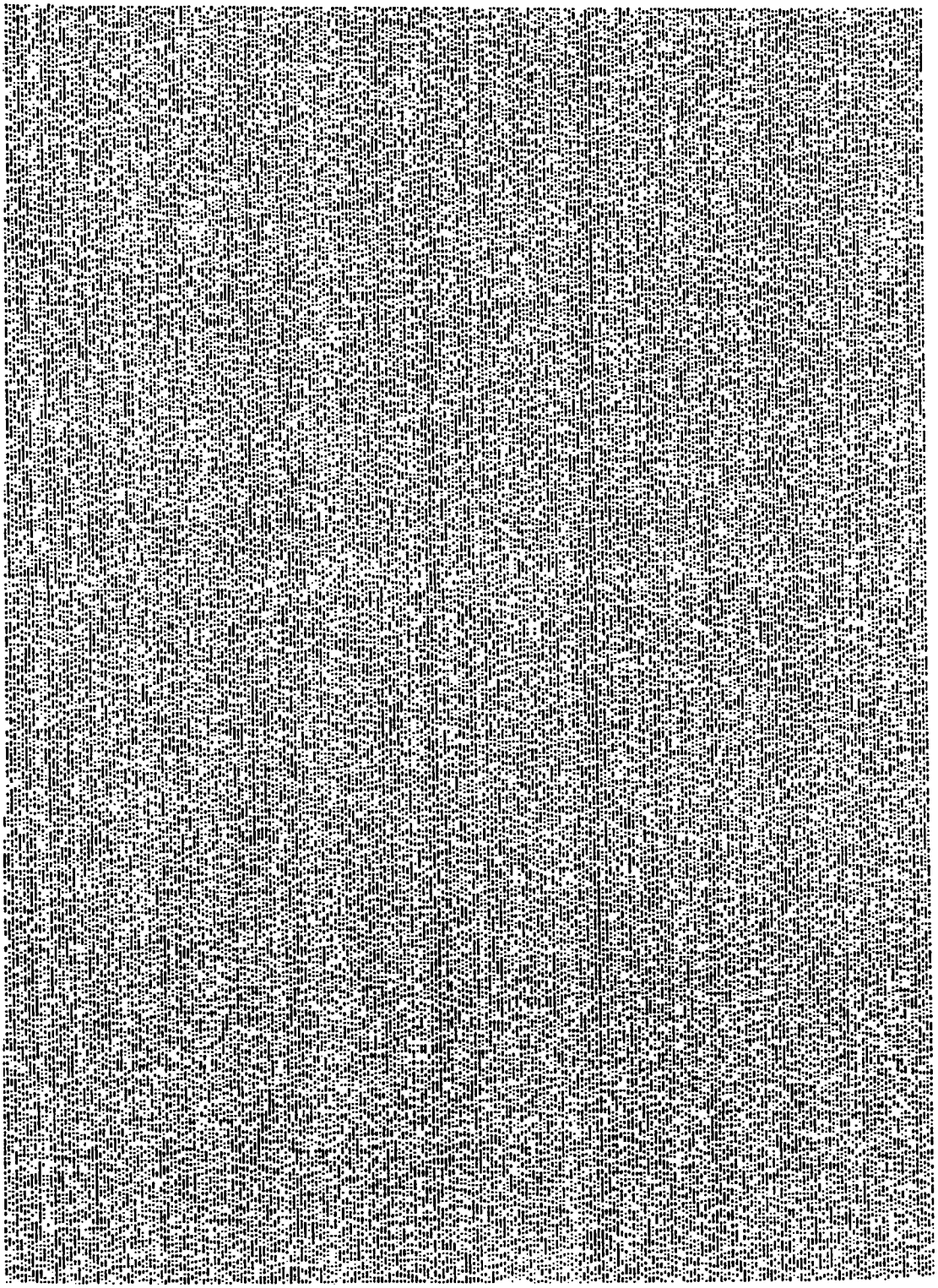
Figure 29:
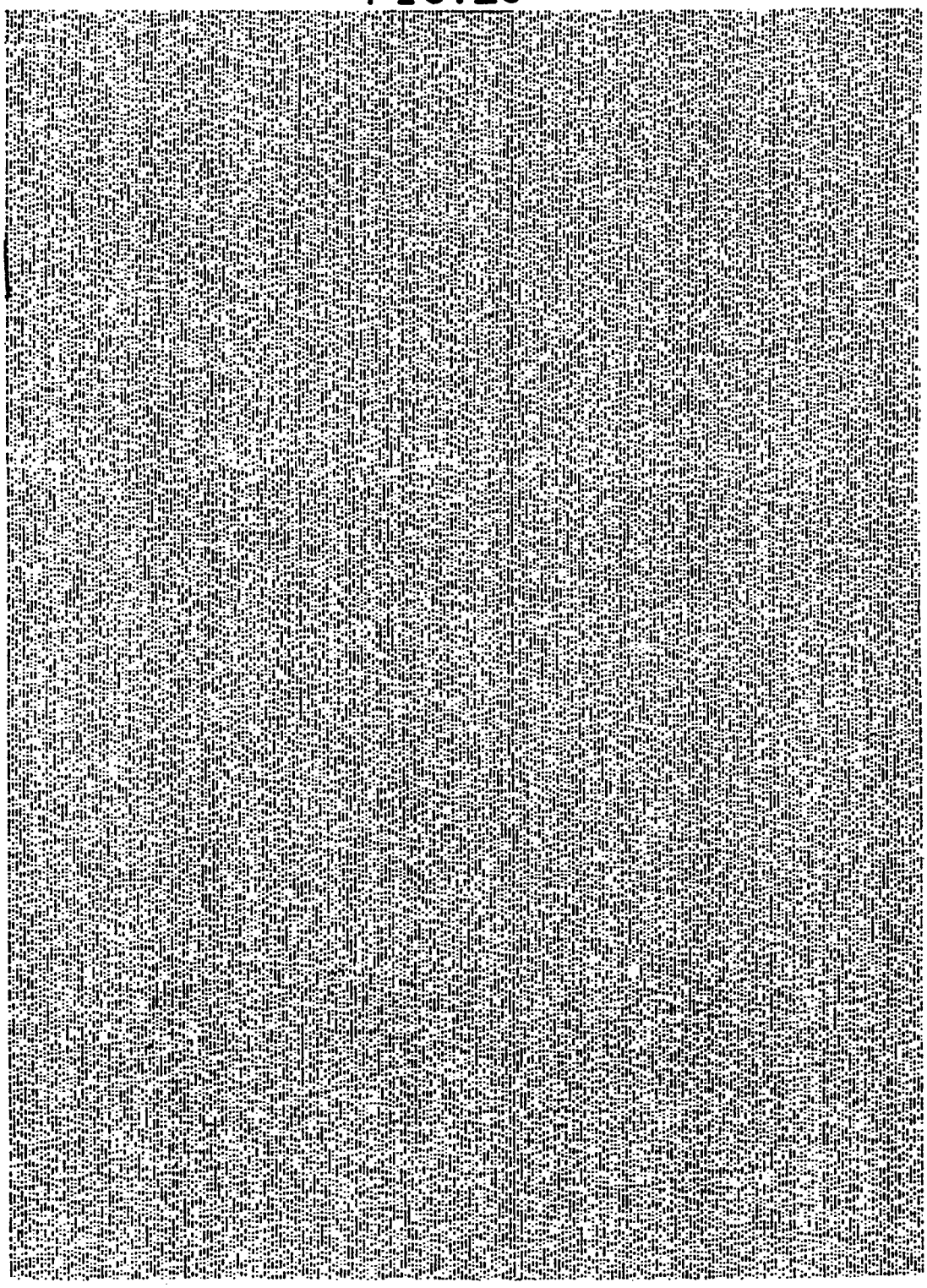
Figure 30:
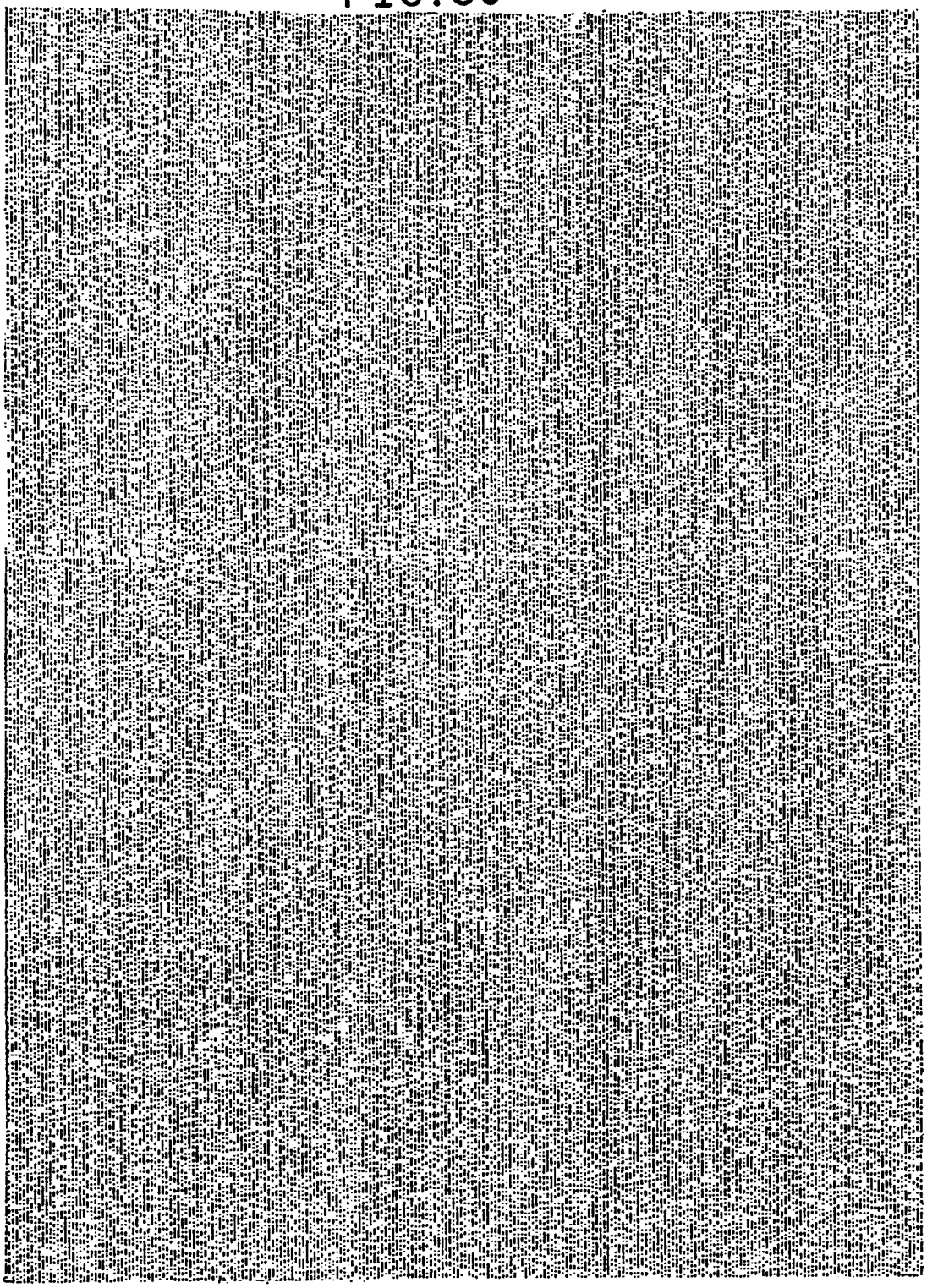
Figure 31:
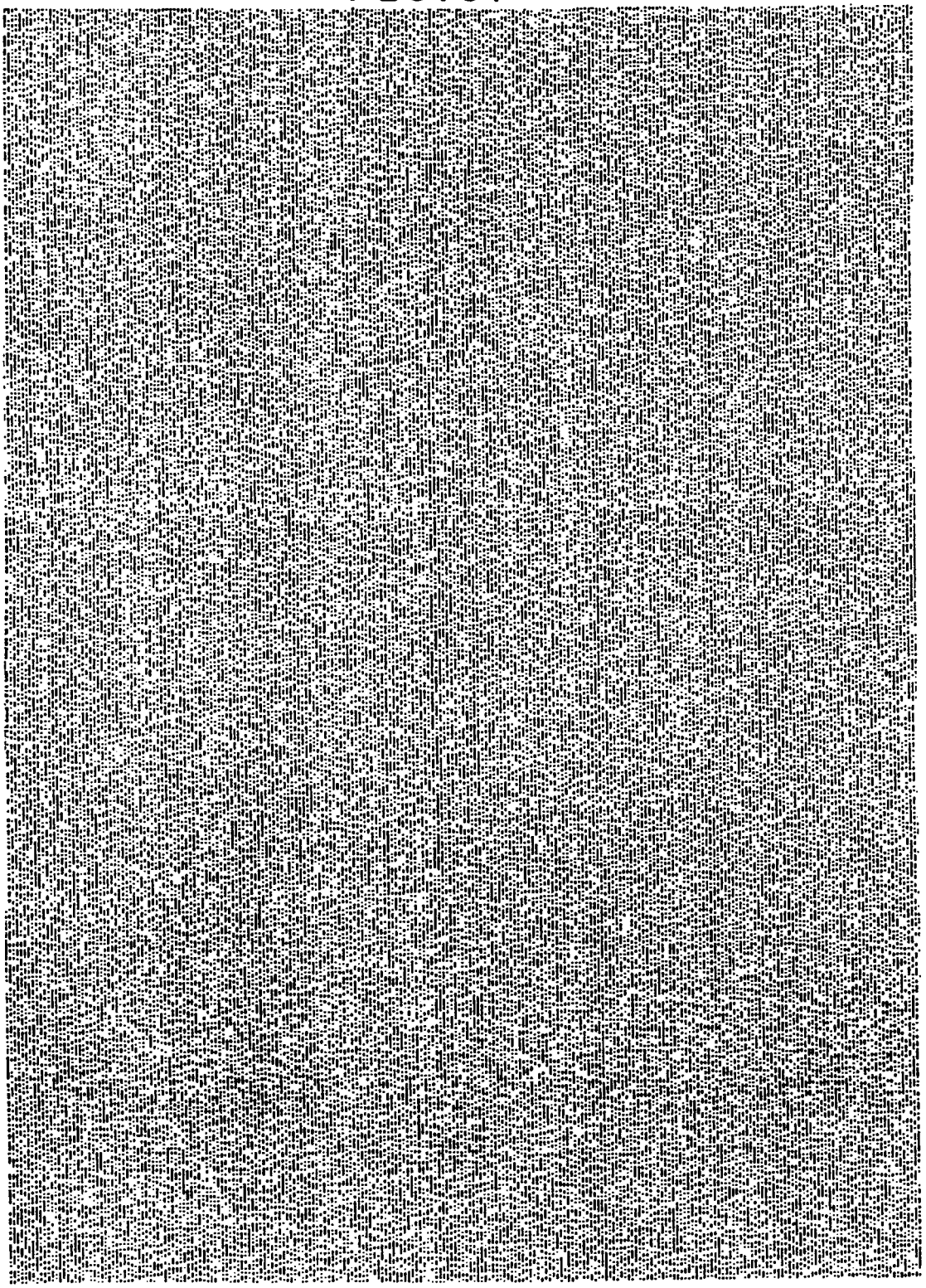
Figure 32:
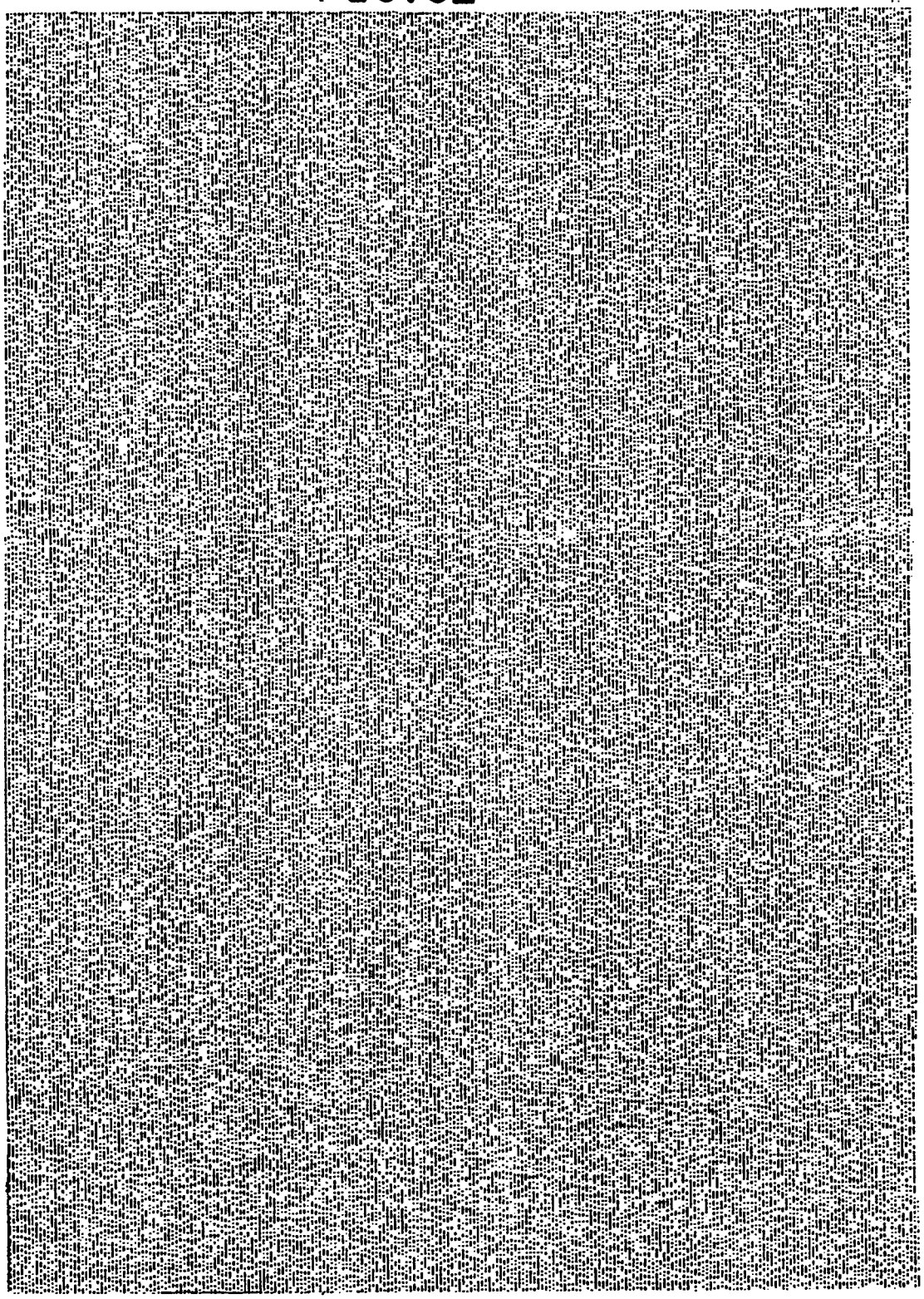
Figure 33:
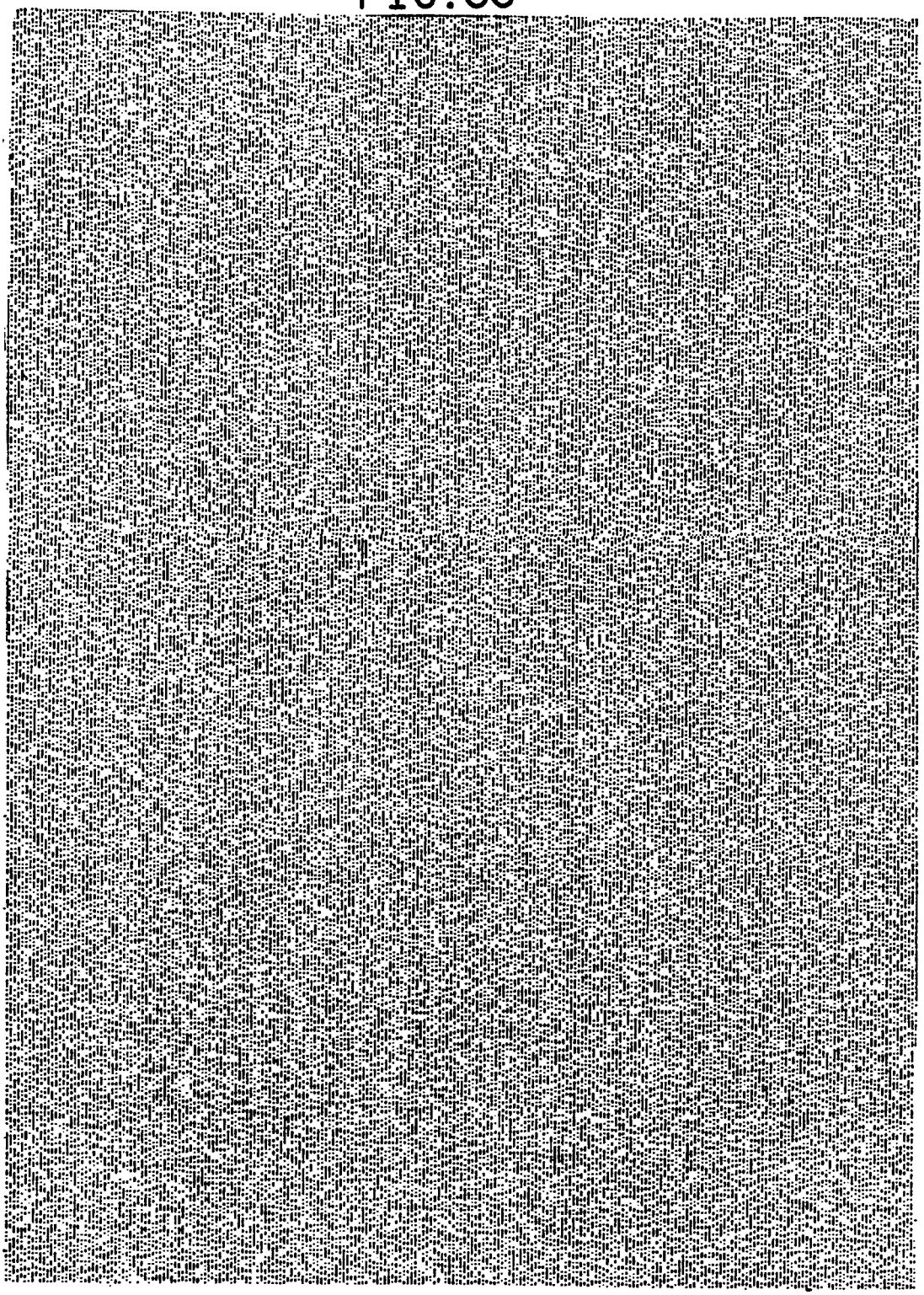
Figure 34:
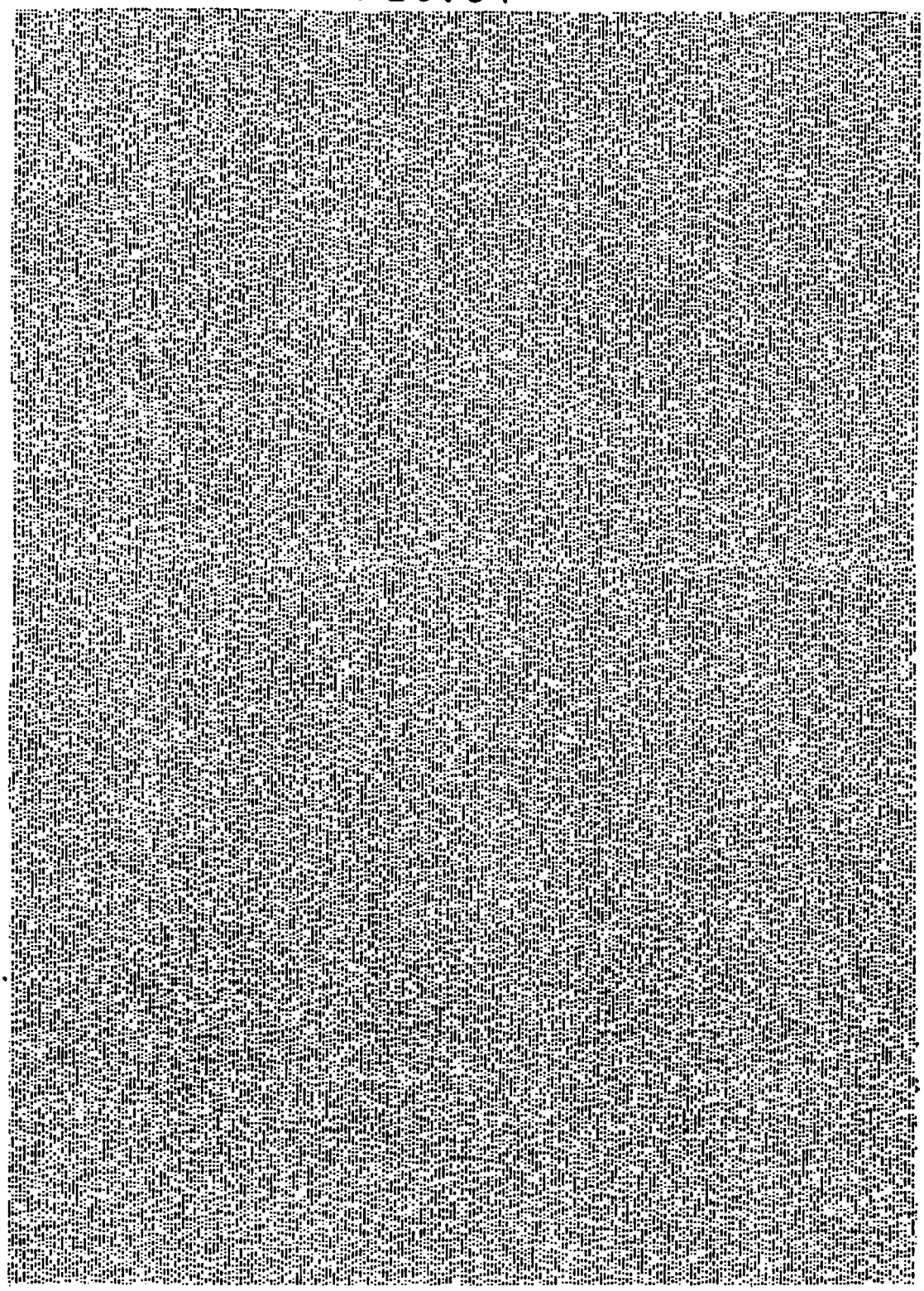
Figure 35:
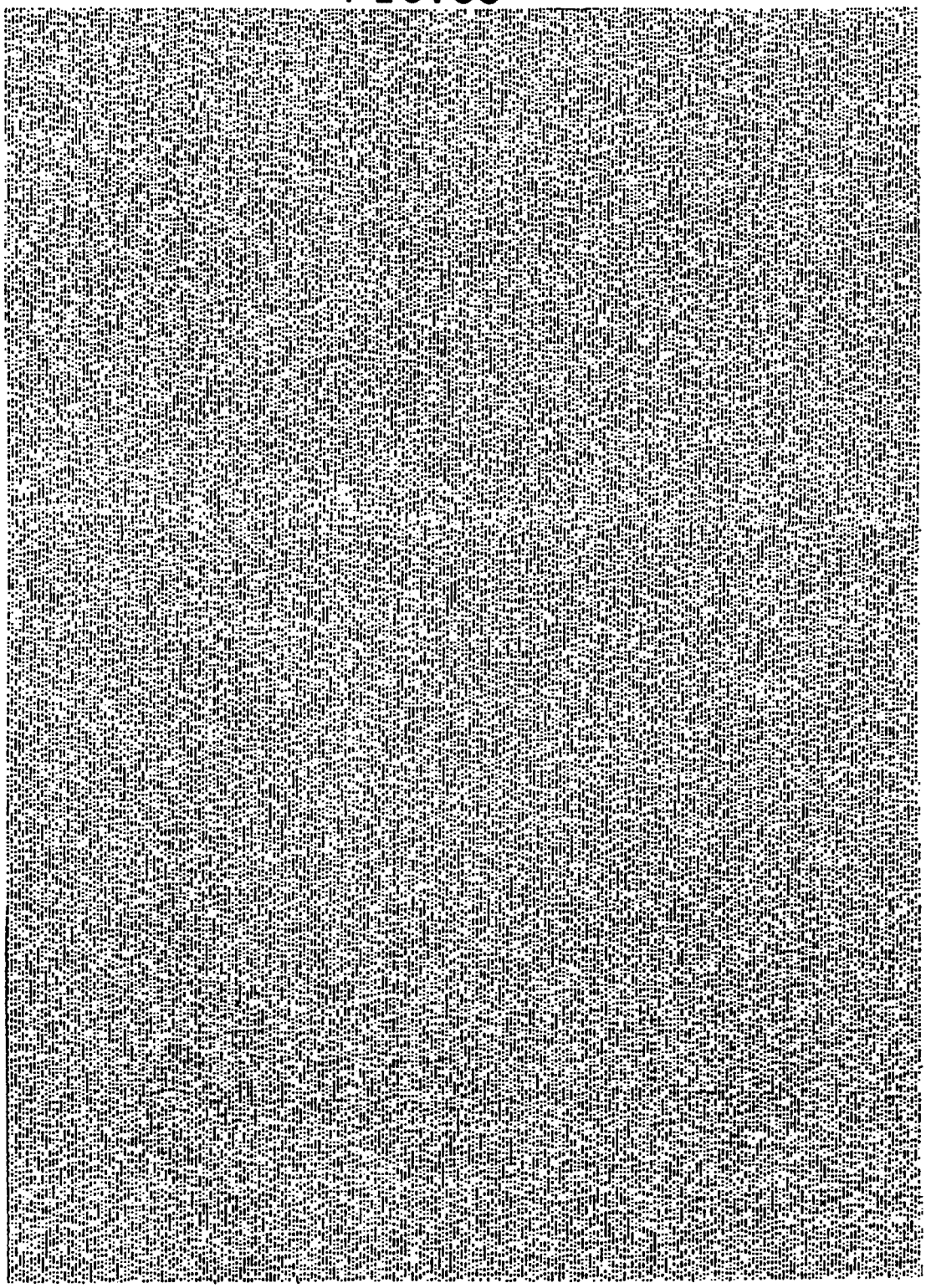
Figure 36:
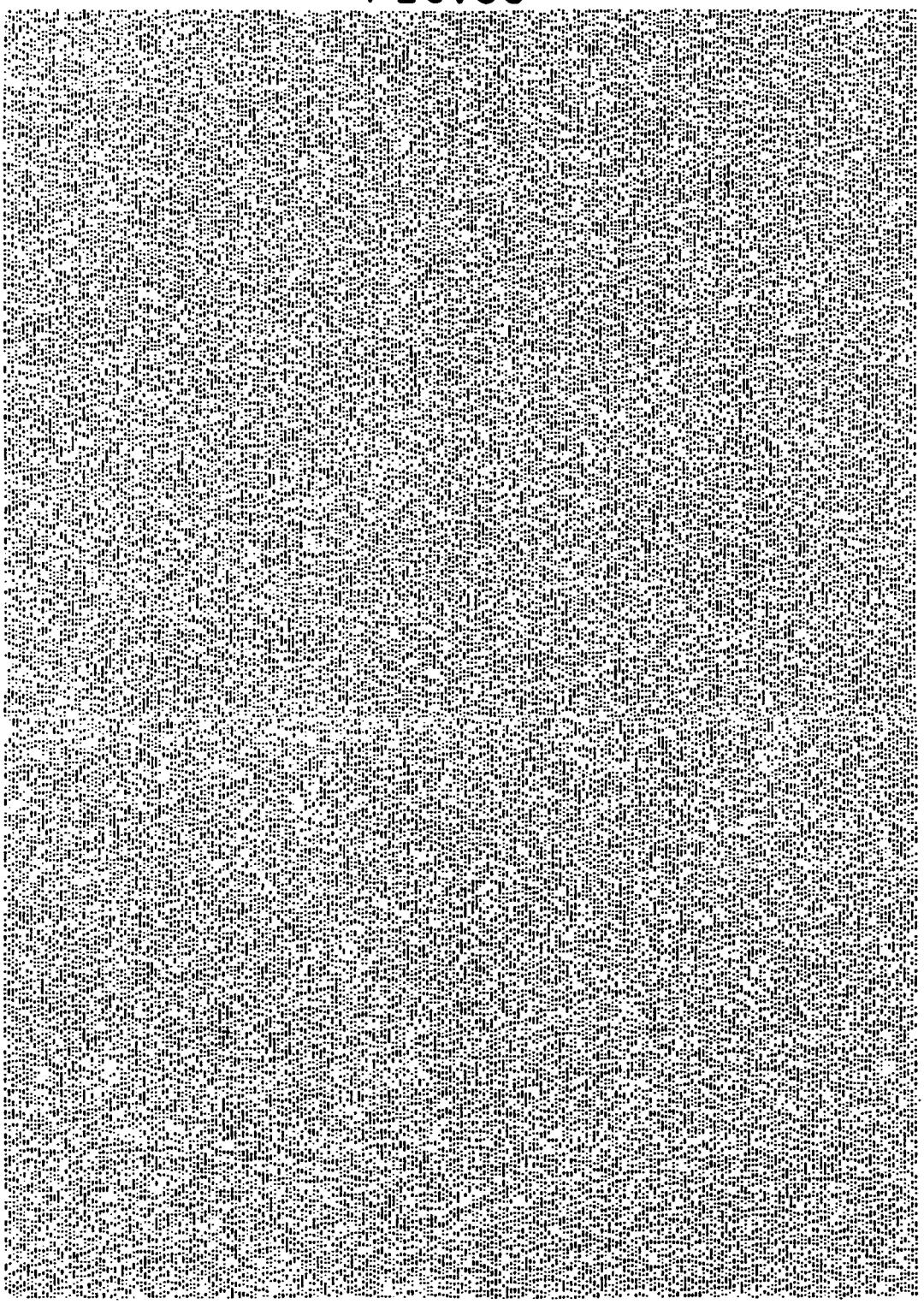

FIG. 26 is a plot of the Apparent Pore Mobility (APM), derived from the orientation of the amorphous polymer chain segments, versus the Apparent Pore Volume (APV), derived from the wide-angle x-ray diffraction scans, for different drawn yarns listed in Table X. Drawn yarns providing a LMDR of at least about 6 are found to have a combination of an APM greater than about 2 (Line CC'E) and greater than about ($4.75-0.37\times10^{-4}$APV), Line ABCD; and an APV greater than $4\times10^{-4}$ cubic angstroms (Line BB'G). Preferred yarns have an APM greater than 2 and greater than ($5-0.37\times10^{-4}$APV), Line A'B'C'D; and an APV greater than $4\times10^{-4}$ cubic angstroms. Yarns having combinations of APM and APV, corresponding to region BGFEC, are also characterized by a dye transition temperature $T_{DYE}$ less than about 65° C.

The following examples further illustrate the invention and are not intended to be limiting. Yarn properties and process parameters are measured in accordance with the following test methods. Parts and percentages are by weight unless otherwise indicated.

TEST METHODS

The Relative Viscosity (RV) of the polyamide is measured as described at col. 2, 1. 42–51, in Jennings U.S. Pat. No. 4,702,875.

Denier of the yarn is measured according to ASTM Designation D-1907-80. Denier may be measured by means of automatic cut-and-weigh apparatus such as that described by Goodrich et al in U.S. Pat. No. 4,084,434.

Tensile Properties (Tenacity, Modulus and Break Elongation) are measured as described by Li in U.S. Pat. No. 4,521,484 at col. 2, 1. 61 to col. 3, 1. 6. The Modulus (M), often referred to as "Initial Modulus," is obtained from the slope of the first reasonably straight portion of a load-elongation curve, plotting tension on the y-axis against elongation on the x-axis. The Secant Modulus at 5% Extension (M5) is defined by the ratio of the (Tenacity/0.05)×100, wherein Tenacity is measured at 5% extension.

Yarn Temperature is measured by a noncontact method using an infrared microscope using the procedure described by Zieminski and Spruiell, J. Appl. Polymer Science, 35, 2223,2245(1988) and Bheda and Spruiell, J. Appl. Polymer Science 39,447–463(1990). Temperature of equipment described herein, e.g., rolls, etc. is measured with standard thermocouples.

Boil-off shrinkage (BOS). The following relaxed skein method is used for the feed yarns described in this application and measures the change in length as a percentage of the original length of a skein of yarn upon immersion in boiling water. Skeins of yarn are prepared on a standard denier reel of 1⅛ meters in circumference. The number of revolutions of the reel is determined from the weight used to measure the skein length. The weight should be as follows:

<30 denier—100 g;
30–100 denier—250 g;
>100 denier—500 g.

The number of revolutions is that required to give a load of 55 mg/denier and is calculated from the following formula:

$$R=1000W/2LD$$

wherein R=number of revolutions rounded to the nearest integer;
W=weight in grams;
D=denier;
L=load=55 mg/denier.

The skeins are straightened by hanging on a hook and attaching the weight. The length of the skein is measured to the nearest 1 mm and recorded as L1. The skeins are then wrapped in a cheesecloth and placed in a boil-off pot for 20±1 min. at 98±1° C. The skeins are removed from the bath and allowed to air dry. The skein length after boil-off, L2, is measured by the same method as L1. Boil-off shrinkage is calculated as:

$$\%\ BOS=(L1-L2)\times100/L1$$

Boil-Off Shrinkage (BOS) The following loop method is used for the measurement of boil-off shrinkage of the warp drawn yarns. The yarn is tied in a loop having a length of about 50 cm and the length of the loop is measured under a load of 0.05 g/d using a meter stick. The load is removed and the loop is placed in boiling water with a load of about 0.6 g to prevent it floating and becoming entangled in the water. The loop is dried in air and the length is remeasured under a load of 0.05 g/d. Boil-off shrinkage is calculated as follows:

$$BOS = \frac{\text{Length before boiling} - \text{Length after boiling}}{\text{Length before boiling}} \times 100$$

Heat Set Shrinkage After Boil Off (HSS/ABO) is measured by immersing a skein of the test yarn into boiling water and then placing it in a hot oven and measuring shrinkage. More specifically, a 500 gram weight is suspended from a 3000 denier skein of the test yarn (6000 denier loop) so that the force on the yarn is 83 mg./denier, and the skein length is measured (L1). The 500 gm. weight is then replaced with a 30 gm. weight and the weighted skein is immersed into boiling water for 20 minutes removed and allowed to air dry for 20 minutes. The skein is then hung in an oven at 175 degrees C. for 4 minutes, removed, the 30 gm. weight is replaced with a 500 gm. weight and skein length is measured (L2). "Heat set shrinkage after Boil Off" is calculated by the formula:

$$\text{Heat Set Shrinkage After Boil Off (\%)} = \frac{L1 - L2}{L1} \times 100$$

Heat set shrinkage after boil-off (HSS/ABO) is typically greater than BOS, that is, the yarns continue to shrink on DHS at 175° C. ABO which is preferred to achieve uniform dyeing and finishing.

Static Dry Heat Shrinkage (DHS90 and DHS135) are measured by the method described in U.S. Pat. No. 4,134,882, Col. 11, 11. 42–45 except that the oven temperatures are 90 degrees C., 135 degrees C., and 175 degrees C., respectively, instead of 160 degrees C.

Large Molecule Acid Dye Uniformity (LMDR) Yarns were knitted into tricot fabric using a 32 gauge tricot machine and dyed by the following procedure using either C.I. Acid Blue 122or C.I. Acid Blue 80:

This procedure is used to dye small quantities (~1–3 yards) of fabric. A weighed quantity of fabric is added to 30 liters of water at 110° F. in a Cook washer. To this bath is added 3 g of Merpol HCS (a liquid nonionic detergent sold by E. I. du Pont de Nemours and Company) and 3 g of 10% ammonium hydroxide. The bath temperature is raised to 160° F. at 3° F./minute and the cook washer is run for 15 minutes. Then the bath is emptied and cleared thoroughly and a 30 liters of water is added. The temperature is set at 80° F. and 0.5% on weight of fabric of Merpol DA (a non-ionic surfactant sold by E. I. du Pont de Nemours and Company) is added. The bath is run for 5 minutes to allow mixing, and 2% on weight of fabric of MSP (monobasic sodium phosphate) is added. The pH of the bath is adjusted to 6.0 with acetic acid. Then 6% on weight of fabric of ammonium sulfate is added and the bath is run for 5 minutes before adding 1.0% on weight of fabric of Du Pont Anthraquinone Milling Blue BL (C.I. Acid Blue 122) or Sandolin milling blue N-BL (C.I Acid Blue 80). The bath is run for 5 minutes, and the bath temperature is then raised to 212° at 3° F./min. After running the bath for 60 minutes, the pH is measured. If the pH is >5.7, it is adjusted to 5.5 and run another 30 minutes. The bath is then cooled to 170° F., emptied, and cleared with clear water. Fabric is removed from the bath and dried.

The yarns in the fabrics were evaluated for LMDR as follows:

Fabric swatches (full width, i.e., approximately 60 inches wide and about 20–60 inches long) were laid on a large table covered with dull black plastic in a room with diffuse fluorescent lighting. The fabric is rated by a panel of experts (the ratings of 5 to 7 experts are averaged) on a scale from 1 to 10 as more further described below using the computerized simulation of fabric streaks shown in FIGS. 23–32 as a guide.

The selected ratings on the rating scale is:

10=no defect visible, absolutely uniform;

8=minor unevenness observed but difficult to detect, acceptable for almost all end uses;

7=superior;

6.5=acceptable for very critical warp knit fabrics such as those used for swimwear;

6=unevenness noticeable, usable for most apparel;

5=unacceptable except for second grade apparel;

4=unevenness highly noticeable, too uneven for any apparel; and

2=extremely uneven, disastrously defective;

MBB Dyeability

For MBB dye testing a set of 42 yarn samples each sample weighing 1 gram is prepared, preferably by jetting the yarn onto small dishes. 9 samples are for control; the remainder are for test.

All samples are then dyed by immersing them into 54 liters of an aqueous dye solution comprised of 140 ml of a standard buffer solution and 80 ml of 1.22% Anthraquinone Milling Blue BL (abbreviated MBB) (C.I. Acid Blue 122). The final bath pH is 5.1. The solution temperature is increased at 3°–10° C./min. from room temperature to $T_{DYE}$ (dye transition temperature, which is that temperature at which there is a sharp increase in dye uptake rate) and held at that temperature for 3–5 minutes. The dyed samples are rinsed, dried, and measured for dye depth by reflecting colorimeter.

The dye values are determined by computing K/S values from reflectance readings. The equations are:

$$MBB \text{ dyeability} = \frac{K/S \text{ SAMPLE}}{K/S \text{ CONTROL}} \times 180$$

AND $$K/S = \frac{(1 - R)^2}{2R}$$

when R=the reflectance value. The 180 value is used to adjust and normalize the control sample dyeability to a known base.

ABB Dyeability

A set of samples is prepared in the same manner as for MBB Dyeability. All samples are then dyed by immersing them into 54 liters of an aqueous dye solution comprised of 140 ml of a standard buffer solution, 100 ml of 10% Merpol LFH (a liquid, nonionic detergent from E. I. du Pont de Nemours and Co.), and 80–500 ml of 0.56% ALIZARINE CYANINE BLUE SAP (abbreviated ABB) (C.I. Acid Blue 45). The final bath pH is 5.9. The solution temperature is increased at 3°–10° C./min from room temperature to 120° C., and held at that temperature for 3–5 minutes. The dyed samples are rinsed, dried, and measured for dye depth by reflecting colorimeter.

The dye values are determined by computing K/S values from reflectance readings. The equations are:

$$ABB \text{ dyeability} = \frac{K/S \text{ SAMPLE}}{K/S \text{ CONTROL}} \times 180$$

AND $$K/S = \frac{(1-R)^2}{2R}$$

when R = the reflectance value. The 180 value is used to adjust and normalize the control sample dyeability to % CV of K/S measured on fabrics provides an indication of LMDR. High LMDR corresponds to low K/S values. Low % CV of K/S values is desirable.

Dye Transition Temperature is that temperature during dyeing at which the fiber structure opens up sufficiently to allow a sudden increase in the rate of dye uptake. It is related to the polymer glass transition temperature, to the thermomechanical history of the fiber, and to the size and configuration of the dye molecule. Therefore it may be viewed as an indirect measure of the "pore" size of the fiber for a particular dye.

The dye transition temperature may be determined for C.I. acid blue 122 dye as follows: Prescour yarn in a bath containing 800 g of bath per g of yarn sample. Add 0.5 g/l of tetrasodium pyrophosphate (TSPP) and 0.5 g/l of Merpol(R) HCS. Raise bath temperature at a rate of 3° C./min. until the bath temperature is 60° C. Hold for 15 minutes at 60° C., then rinse. Note that the prescour temperature must not exceed the dye transition temperature of the fiber. If the dye transition temperature appears to be close to the scour temperature, the procedure should be repeated at a lower scour temperature. Set the bath at 30° C. and add 1% on weight of fabric of C.I. acid blue 122 and 5 g/l of monobasic sodium phosphate. Adjust pH to 5.0 using M.S.P. and acetic acid. Add yarn samples and raise bath temperature to 95° C. at a rate of 3° C./min.

With every 5° C. rise in bath temperature take a dye liquor sample of ~25 ml from the dye bath. Cool the samples to room temperature and measure the absorbance of each sample at the maximum absorbance of about 633 nm on a spectrophotometer using a water reference. Calculate the % dye exhaust and plot % dye exhaust vs dyebath temperature. Draw intersecting lines along each of the two straight portions of the curve and the intersection is the dye transition temperature. To improve reproducibility of measurement it is preferable to measure the dye transition temperature at 15% dye exhaustion. The dye transition temperature ($T_{DYE}$) is a measure of the openness of the fiber structure and preferred values of $T_{DYE}$ for warp drawn yarns are less than about 65° C., especially less than about 60° C.

The denier variation analyzer (DVA) is a capacitance instrument, using the same principle as the Uster, for measuring along-end denier variation. The DVA measures the change in denier every ½ meter over a 240 meter sample length and reports % CV of these measurements. It also reports % denier spread, which is the average of the high minus low readings for eight 30 meter samples. Measurements in tables using the DVA are, reported as coefficient of variation (DVA % CV).

Dynamic Mechanical Analysis tests are made according to the following procedure. A "Rheovibron" DDV-IIc equipped with an "Autovibron" computerization kit from Imass, Inc., Hingham MA and an IMC-1 furnace, also from Imass, Inc., are used. Standard, stainless steel specimen support rods and fiber clamps, also from Imass, Inc., are used. The computer program supplied with the Autovibron has been modified so that constant, selectable, heating rate and static tension on the specimen can be maintained over the temperature range −30 to 220 degrees C. It has, also been modified to print the static tension, time and current specimen length whenever a data point is taken so that the constancy of tension and heating rate can be confirmed and that shrinkage vs. temperature can be measured at constant stress. This computer program contains no corrections for clamp mass and load-cell compliance, and all operations and calculations, except as described above, are as provided by Imass with the Autovibron.

For tests on specimens of this invention a static tension corresponding with 0.1 grams per denier (based on pre-test denier) is used. A heating rate of 1.4±0.1 degrees C./minute is used and the test frequency is 110 Hz. The computerization equipment makes one reading approximately every 1.5 minutes, but this is not constant because of variable time required for the computer to maintain the static tension constant by adjustment of specimen length. The initial specimen length is 2.0±0.1 cm. The test is run over the temperature range −30 to 230 degrees C. Specimen denier is adjusted to 400±30 by plying or dividing the yarn to assure that dynamic and static forces are in the middle of the load cell range.

The position (i.e., temperature) of tan delta and E″ peaks is determined by the following method. First the approximate position of a peak is estimated from a plot of the appropriate parameter vs. temperature. The final position of the peak is determined by least squares fitting a second order polynomial over a range of ±10–15 degrees with respect to this estimated position considering temperature to be the independent variable. The peak temperature is taken as the temperature of the maximum of this polynomial. Transition temperatures, i.e., the temperature of inflection points are determined similarly. The approximate inflection point is estimated from a plot. Then sufficient data points to cover the transition from one apparent plateau to the other are fitted to a third order polynomial considering temperature to be the independent variable. The transition temperature is taken as the inflection point of the resulting polynomial. The E″ peak temperature ($T_{E''max}$) around 100° C. (see FIG. 12) is taken as the indicator of the alpha transition temperature ($T_A$) and it is important to have this a low value (i.e., less than 100° C., preferably less than 95° C., especially less than 90° C.) for uniform dyeability.

Melting Behavior, including initial melt rate, is measured by a Differential Scanning Calorimeter (DSC) or a Differential Thermal Analyzer (DTA). Several instruments are suitable for this measurement. One of these is the Du Pont Thermal Analyzer made by E. I. Du Pont de Nemours and Company of Wilmington, Del. Samples of 3.0±0.2 mg. are placed in aluminum capsules with caps and crimped in a crimping device all provided by the instrument manufacturer. The samples are heated at a rate of 20° C. per minute for measurement of the melting point ($T_M$) and a rate of 50° C. per minute is used to detect low temperature transitions which would normally would not be seen because of rapid recrystallization during the heating of the yarn. Heating takes place under a nitrogen atmosphere (inlet flow of 43 ml/min.) using glass bell jar cover provided by the instrument manufacturer. After the sample is melted the cooling exotherm is determined by cooling the sample at 10° C. per minute under the nitrogen atmosphere. The melting pointed of nylon 66 homopolymer is typically 260°–262° C. and is lowered by about 1° C./1% by weight of copolyadipamides, such as by addition of N6 and Me-5,6. The melting point of nylon 6 homopolymer is typically 222° C. (i.e., about 40° C. lower than nylon 66) and may be raised by addition of higher melting point copolyamides, such as by addition of N66.

Interlace level of the polyamide yarn is measured by the pin-insertion technique which, basically, involves insertion of a pin into a moving yarn and measures yarn length (in cm.) between the point on the yarn at which the pin has been inserted and a point on the yarn at which a predetermined force on the pin is reached. For yarns of >39 denier the predetermined force is 15 grams; for yarns of ≦39 denier the predetermined force is 9 grams. Twenty readings are taken. For each length between points, the integer is retained, dropping the decimal, data of zero is dropped, and the log to the base 10 is taken of that integer and multiplied by 10. That result for each of the 20 readings is averaged and recorded as interlace level.

The amount of ϵ-caproamide monomer (N6% in Tables, herein) in 6—6 nylon is determined as follows: A weighed nylon sample is hydrolyzed (by refluxing in 6N HCl), then 4-aminobutyric acid is added as an internal standard. The sample is dried and the carboxylic acid ends are methylated (with anhydrous methanolic 3N HCl), and the amine ends are trifluoroacylated with trifluoroacetic anhydride/$CH_2Cl_2$ at 1/1 volume ratio. After evaporation of solvent and excess reagents, the residue is taken up in MeOH and chromatographed using a gas chromatograph such as Hewlett Packard 5710A, commercially available from Hewlett Packard Co., Palo Alto, Calif., with Flame Ionization Detector, using for the column Supelco 6-foot×4 mm ID glass, packed with 10% SP2100 on 80/100 Supelcoport, commercially available from Supelco Co., Bellefonte, Pa. Many gas chromatographic instruments, columns, and supports are suitable for this measurement. The area ratio of the derivatized 6-aminocaproic acid peak to the derivatized 4-aminobutyric acid peak is converted to mg 6 nylon by a calibration curve, and wt. % 6 nylon is then calculated.

The amount of Me5–6 in weight percent (reported as MPMD % in the Tables) is determined by heating two grams of the polymer in flake, film, fiber, or other form (surface materials such as finishes being removed) at 100° C. overnight in a solution containing 20 mls of concentrated hydrochloric acid and 5 mls of water. The solution is then cooled to room temperature, adipic acid precipitates out and may be removed. (If any TiO2 is present it should be removed by filtering or centrifuging.) One ml of this solution is neutralized with one ml of 33% sodium hydroxide in water. One ml of acetonitrile is added to the neutralized solution and the mixture is shaken. Two phases form. The diamines (MPMD AND HMD) are in the Upper phase. One microliter of this upper phase is analyzed by Gas Chromatography such as a capillary Gas Chromatograph having a 30 meter DB-5 column (95% dimethylpolysiloxane/5% diphenylpolysiloxane) is used although other columns and supports are suitable for this measurement. A suitable temperature program is 100° C. for 4 minutes then heating at a rate of 8° C./min up to 250° C. The diamines elute from the column in about 5 minutes, the MPMD eluting first. The weight percentage MPMD is calculated from the ratio of the integrated areas under the peaks for the MPMD and HMD and the weight percent Me5–6 is calculated from the weight percentage of the MPMD.

Draw Tension ($DT_{33\%}$), expressed as grams per original denier, is measured while drawing the yarn to be tested while heating it. This is most conveniently done by passing the yarn from a set of nip rolls, rotating at approximately 180 meters/minute surface speed, through a cylindrical hot tube, at 185±2° C. (characteristic of the exit gain temperature in high speed texturing), having a 1.3 cm diameter, 1 meter long yarn passageway, then to a second set of nip rolls, which rotate faster than the first set so that the yarn is drawn between the sets of nip rolls at a draw ratio of 1.33 X. A conventional tensiometer placed between the hot tube and the first set of nip rolls measures yarn tension. The coefficient of variation is determined statistically from replicate readings. Freshly spun yarn is aged 24 hours before this measurement is done. Draw Tension @1.05 Draw Ratio (DT 5%) is measured in the same manner except that draw ratio is 1.05X instead of 1.33X and hot tube temperature is at 135° C. instead of 185° C. Using these settings, Average Secant Modulus ($M_5$) is calculated by the formula $$\frac{([M_5]/[\text{denier}])}{5} \times 100$$

(average values are denoted by brackets) % Coefficient of Variation of $M_5$ is also obtained in this manner.

Draw Tension @1.00 Draw Ratio (herein referred to as "along-end shrinkage tension") is measured in the same manner as DT 5% except that the draw ratio is 1.00X and the hot tube temperature is 75° C.

Draw Tension @1.20 Residual Draw Ratio (DT RDR=1.2) is obtained in the same manner as DT5 except that the draw ratio is based on residual draw ratio of 1.20 X; i.e., $$\text{Draw Ratio} = \frac{100 + E_B \text{ (in percent)}}{120}$$

% of coefficient of variation is also calculated using this data.

The Dynamic Shrinkage Tension (ST) is measured using the Kanebo Stress Tester, model KE-2L, made by Kanebo Engineering, LTD., Osaka, Japan, and distributed in the U.S. by Toyomenka America, Inc. of Charlotte, N.C. The tension in grams is measured versus temperature on a seven centimeter yarn sample tied into a loop and mounted between two loops under an initial preload of 5 milligrams per denier and heated at 30 degrees centigrade per minute from room temperature to 260 degrees centigrade. The maximum shrinkage tension (g/d) ($S_{Tmax}$) and the temperature at $S_{Tmax}$, denoted by $T_{STmax}$ are recorded. Other thermal transitions can be detected (see detailed discussion of FIG. 10).

The Dynamic Length Change (ΔL) of a yarn under a pretensioning load versus increasing temperature (ΔT) is measured using the Du Pont Thermomechanical Analyzer (TMA), model 2940, available from the E. I. Du Pont de Nemours and Co., Inc. of Wilmington, Del. The change in yarn length (ΔL, %) versus temperature (degrees centigrade) is measured on a 12.5 milimeter length of yarn which is: 1) mounted carefully between two press-fit aluminum balls while keeping all individual filaments straight and unstressed with the cut filament ends fused outside of the ball mounts using a micro soldering device to avoid slippage of individual filaments; 2) pre-stressed to an initial load of 5 mg/denier for measurement of shrinkage and to 300 mg/denier for measurement of extension; and 3) heated from room temperature to 300 degrees centigrade at 50 degrees per minute with the yarn length at 35 degrees centigrade defined as the initial length. The change in length ($\Delta L$, %) is measured every two seconds (i.e., every 1.7 degrees) and recorded digitally and then plotted versus specimen temperature. An average relationship is defined from at least three representative plots. Preferred draw feed yarns have a negative length change (i.e., the yarns shrink) under a 5 mg/d tension over the temperature range of 40° C. to 135° C.

The instantaneous change in length versus temperature ($\Delta L$, %)/($\Delta T$, °C.), herein called the Dynamic Shrinkage Rate under shrinkage conditions (5 mg/d) and the Dynamic Extension Rate under extension conditions (300 mg/d), is derived from the original data by a floating average computation and replotted versus specimen temperature. Preferred draw feed yarns have a negative dynamic shrinkage rate (i.e., the yarns do not elongate after initially shrinking) over the temperature range on 40° C. to 135° C. Under extension conditions (300 mg/d pre-tension load), the value of ($\Delta L/\Delta T$) is found to increase with increasing temperature, reaching an intermediate maximum value at about 110°-140° C., decreasing slightly in value at about 160°-200° C. and then increasing in value sharply as the yarn begins to soften prior to melting (see FIG. 7). The intermediate maximum in ($\Delta L/\Delta$ T), occuring between about 110° C.-140° C., is herein called ($\Delta L/\Delta T$)max and is taken as a measure of the mobility of the polymer network under stress and high temperatures. Preferred draw feed yarns have a ($\Delta L/\Delta T$)max value, as measured at 300 mg/d, of less than about 0.2 (%/°C.), preferably less than about 0.15 (%/°C.) and greater than about 0.05%/°C.

Another important characteristic of a polymer network is the sensitivity of its ($\Delta L/\Delta T$)max value with increasing stress which is defined as the tangent to the plot of ($\Delta L/\Delta T$)max versus $\sigma_D$ at a $\sigma_D$-value of 300 mg/d (denoted by $d(\Delta L/\Delta T)_{MAX}/d\sigma_D$) and determined on separate specimens pre-stressed from 3 mg/d to 500 mg/d (see FIGS. 5 and 6). A 300 mg/d stress value is selected for characterization since it approximates the nominal stress level in the draw relaxation zone (i.e., between rolls 17 and 18 in FIG. 2).

The Hot Draw Stress ($\sigma_D$) vs. Draw Ratio Curve is used to simulate the response of a draw feed yarn to increasing draw ratio (DR) and draw temperature ($T_D$). The draw stress ($\sigma_D$) is measured the same as $DT_{33\%}$, except that the yarn speed is reduced to 50 meters per minute, the measurement is taken over a length of 100 meters, and different temperatures and draw ratios are used as described herein. The draw stress ($\sigma_D$) is expressed as grams per drawn denier (g/dd); that is, $\sigma_D = DT(g/d) \times DR$, and is plotted versus draw ratio (DR) at 75° C., 125° C., and 175° C. (see FIG. 20). The draw stress ($\sigma_D$), increases linearly with draw ratio for values of DR greater than about 1.05 (i.e., above the yield point) to the onset of strain-hardening (i.e., to a residual draw ratio $(RDR)_D$ of about 1.25), and the slope of best fit linear plot of draw stress versus draw ratio is herein called the draw modulus ($M_D = \Delta\sigma_D/\Delta DR$). The values of draw stress ($\sigma_D$) and draw modulus ($M_D$) decrease with increasing draw temperature ($T_D$). The desired level of draw stress ($\sigma_D$) and draw modulus ($M_D$) can be controlled by selection of feed yarn type and draw temperature ($T_D$). Preferred draw feed yarns have a draw stress ($\sigma_D$) between about 1.0 and about 2.0 g/dd, and a draw modulus ($M_D$) between about 3 to about 7 g/dd, as measured at 75° C. and at a 1.35 draw ratio (DR) taken from a best fit linear plot of draw stress ($\sigma_D$) versus draw ratio (see FIGS. 20 and 21). The temperature of 75° C. is selected since it is found that most nylon spin-oriented feed yarns have reached their maximum shrinkage tension and have not yet begun to undergo significant recrystallization (i.e., this is more indicative of the mechanical nature of the "as-spun" polymer chain network above its glass transition temperature, $T_g$, before the network has been modified by thermal recrystallization).

Apparent Draw Energy $(E_D)_a$, is the rate of decrease of the draw modulus with increasing temperature (75° C., 125° C., 175° C.) and is defined as the slope, of a plot of the logarithm of the draw modulus, $\ln(M_D)$, versus $[1000/(T_D, °C. + 273)]$, assuming an Arrhenius type temperature dependence (i.e., $M_D = A\exp(E_D/RT)$, where T is temperature in degrees Kelvin, R is the universal gas constant, and "A" is a material constant). Preferred draw feed yarns have an apparent draw energy $(E_D)_a[= E_D/R = \Delta(\ln M_D)/\Delta(1000/T_D)$, where $T_D$ is in degrees Kelvin] about 0.2 to about 0.6 (g/dd)/°K.

The Differential Dye Variance is a measure of the along-end dye uniformity of a warp drawn yarn and is defined by the difference in the variance of K/S measured in the axial and radial directions, respectively, on a lawson knit sock dyed according to the MBB dye procedures described herein. The LMDR of a warp knit fabric is found to vary inversely with the warp drawn yarn Differential Dye Variance (axial K/S variance−radial K/S variance). The warp draw process of the invention balances the draw temperature, extent of draw, relaxation temperature, and extent of relaxation so to minimize the Differential Dye Variance (DDV) of the warp drawn yarn product.

Tensions expressed in terms of grams per drawn denier (g/dd) (herein sometimes referred to as "stress") may be measured by use of the Rothschild Electronic Tensiometer. Model R-1192A operation conditions are: 0 to 100 gram head; range=25 (scale 0 to 40 grams on display); calibrated with Lawson-Hemphill Tensiometer Calibration Device are commercially available from: Lawson-Hemphill Sales, Inc., PO Drawer 6388, Spartansburg, S.C.

Along-end Shrinkage of yarns may be measured by the Lawson-Hemphill Texured Yarn Test system (TYT) as follows: A suitable Tester is the Model 30 available from Lawson-Hemphill Sales, Inc., P.O. Drawer 6388, Spartansburg, S.C. Four yarn length measurements are made in the sequence: ($L_1$); (2) length under just enough tension to straighten the yarn ($L_2$); (3) length upon heating to further develop shrinkage under very low tension $L_3$); (4) and the final yarn length ($L_4$) under just enough tension to straighten the yarn. Shrinkage is calculated by the formula:

$$\text{Shrinkage (\%)} = \frac{L_2 - L_4}{L_2} \times 100$$

Amine (NH2) and carboxyl (COOH) ends are determined by the methods described on pages 293 and 294 in volume 17 of the "Encyclopedia of Industrial Chemical Analysis" published by John Wiley & Sons, Inc. in 1973, and are expressed in terms of equivalents per $10^6$ grams. Typical nylon 66 polymer has about 30–50 equivalents of NH2-ends and "deep" dye nylon 66 polymer has about 50–70 equivalents of NH2-ends. The number average molecular weight ($M_N$) is approximately proportional to the reciprocal of the total number of NH2 and COOH ends, expressed as equivalents per $10^6$ grams; that is, $M_N=2\times10^6$ is still in (NH2+COOH+SE), where SE is the number of equivalent stabilized non-reactive end groups. For example, nylon 66 polymer having a $M_N$ of about 15,000 has a RV of about 44 and a total number of ends of about 133; and for example, nylon 66 polymer having a $M_N$ of about 20,000 has a RV of about 66 and a total number of ends of about 100; wherein for nylon 66 polymer the $M_N$ and RV are approximately interrelated by the expression $M_N=1065(RV)^{0.7}$; and for nylon 6 polymers the expression $M_N=1002(RV)^{0.74}$ may be used. Polyamide polymers of about 50 to about 80 RV with about 30 to about 70 equivalent NH2-ends are preferred.

Density($\rho$) of the polyamide fiber is measured by use of the standard density gradient column technique using carbon tetrachloride and heptane liquids at 25° C.

The Fractional Volume Crystallinity (Xv) is calculated from the fiber density ($\rho$) measurement using the following formula: $X_v=(\rho-\rho_1)/(\rho_c-\rho_a)$; where, $\rho_c$ is the density of the perfectly crystalline phase and $\rho_a$ is the density of the amorphous phase. For nylon 66, $\rho_c=1.22$ g/cm$^3$ and $\rho_a=1.069$ g/cm$^3$ [H. W. Starkweather, Jr., R. E. Moynihan, Journal of Polymer Science, vol. 22, p. 363 (1956)]. The Fractional weight Crystallinity (Xw) and the fractional volume crystallinity (Xv) are related by the formula: $Xw=Xv\ (\rho/\rho_c)$. The fractional volume crystallinity varies only slightly with warp draw process conditions, e.g., typically varying from about 0.5 to about 0.55.

The Optical Parameters of the fibers are measured according to the method described in Frankfort and Knox U.S. Pat. No. 4,134,882, beginning at column 9, line 59 and ending at column 10, line 65 with the following exceptions and additions. First instead of Polaroid T-410 film and 1000X image magnification, high speed 35 mm film intended for recording oscilloscope traces and 300X magnification are used to record the interference patterns. Also suitable electronic image analysis methods which give the same result can be used. Second, the word "than" in column 10, line 26 is replaced by the word "and" to correct a typographical error. Because the fibers of this invention are different from those of 4,134,882, additional parameters, calculated from the same n|| and n| distributions at ±0.05. Here the ± refers to opposite sides from the center of the fiber image. The isotropic refractive index (RISO) at ±0.05 is determined from the relationship:

$$RISO(0.05)=[(n||)0.05)+2(n\perp)0.05))]/3$$

Finally the average value of any of the optical parameters is defined as the average of the two values at ±0.05, e.g.:

$$<RISO>=(RISO(0.05)+RISO(-0.05))/2,$$

and similarly for the Average Birefringence ($\Delta n$). The average birefringence ($\Delta n$) may in turn be expressed as the sum of the crystalline ($\Delta c$) and amorphous ($\Delta a$) birefringences: $\Delta n=\Delta c+\Delta a$; where, $\Delta c=\Delta c^\circ fcXv$ and $\Delta a=\Delta a^\circ fa(1-Xv)$ and $\Delta c^\circ$, $a^\circ$ are the intrinsic birefringences of the crystalline and amorphous regions, respectively, with values of 0.073 [M. F. Culpin, and K. W. Kemp, Proc. Physics Society, vol. 69C, p. 1301 (1956)]; fc,a are the orientation functions of the crystalline and amorphous regions, respectively; and Xv and (1−Xv) are the fractional volumes of the crystalline and amorphous regions, respectively. The value of the Crystalline Orientation Function (fc) is defined by the expression: $fc=1-OA/180$, where OA is the crystalline orientation angle, defined hereinafter; permitting the Amorphous Orientation Function (fa) to be calculated from the formula: $fa=(\Delta n-\Delta c^\circ fcXv)/\Delta a^\circ(1-Xv)$ and an Average Orientation Function (favg) to be calculated from the formula: $favg=(\Delta n)/0.073$. [R. S. Stein, Journal Polymer Science, Vol. 21, pgs 381–396 (1956)].

Crystal Perfection Index (CPI) and Apparent Crystallite Size: Crystal perfection index and apparent crystallite size are derived from X-ray diffraction scans. The diffraction pattern of fibers of these compositions is characterized by two prominent equatorial X-ray reflections with peaks occurring at scattering angle ($2\theta$) approximately 20°–21° and 23°.

X-ray diffraction patterns of these fibers are obtained with an X-ray diffractometer (Philips Electronic Instruments, Mahwah, N.J., cat. no. PW1075/00) in reflection mode, using a diffracted-beam mono-chromator and a scintillation detector. Intensity data are measured with a rate meter and recorded by a computerized data collection/reduction system. Diffraction patterns are obtained using the instrumental settings:

Scanning Speed 1° $2\theta$ per minute;
Stepping Increment 0.025° $2\theta$;
Scan Range 6° to 38°, $2\theta$; and
Pulse Height Analyzer, "Differential".

For both Crystal Perfection Index and Apparent Crystallite Size measurements, the diffraction data are processed by a computer program that smoothes the data, determines the baseline, and measures peak locations and heights.

The X-ray diffraction measurement of crystallinity in 66 nylon, 6 nylon, and copolymers of 66 and 6 nylon is the Crystal Perfection Index.(CPI) (as taught by P. F. Dismore and W. O. Statton, J. Polym. Sci. Part C, No. 13, pp. 133–148, 1966). The positions of the two peaks at 21° and 23° $2\theta$ are observed to shift, and as the crystallinity increases, the peaks shift farther apart and approach the positions corresponding to the "ideal" positions based on the Bunn-Garner 66 nylon structure. This shift in peak location provides the basis of the measurement of Crystal Perfection Index in 66 nylon:

$$CPI=\frac{[d(\text{outer})/d(\text{inner})]-1}{0.189}\times100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc. (London), A189, 39, 1947). An equivalent and more useful equation, based on $2\theta$ values, is:

$$CPI=[2\theta(\text{outer})/2\theta(\text{inner})-1]\times546.7$$

Apparent Crystallite Size: Apparent crystallite size is calculated from measurements of the half-height peak width of the equatorial diffraction peaks. Because the two equatorial peaks overlap, the measurement of the half-height peak width is based on the half-width at half-height. For the 20°–21° peak, the position of the half-maximum peak height is calculated and the $2\theta$ value for this intensity is measured on the low angle side. The difference between this $2\theta$ value and the $2\theta$ value at maximum peak height is multiplied by two to give the half-height peak (or "line") width. For the 23° peak, the position of the half-maximum peak height is calculated and the $2\theta$ value for this intensity is measured on the high angle side; the difference between this $2\theta$ value and the $2\theta$ value at maximum peak height is multiplied by two to give the half-height peak width.

In this measurement, correction is made only for instrumental broadening; all other broadening effects are assumed to be a result of crystallite size. If 'B' is the measured line width of the sample, the corrected line width 'beta' is $$\beta=(B^2-b^2)^{\frac{1}{2}}$$

where 'b' is the instrumental broadening constant. 'b' is determined by measuring the line width of the peak located at approximately 2° $2\theta$ in the diffraction pattern of a silicon crystal powder sample.

The Apparent Crystallite Size (ACS) is given by $ACS=(K\lambda)/(\beta \cos \theta)$, wherein K is taken as one (unity);

$\lambda$ is the X-ray wavelength (here 1.5418 Å);

$\beta$ is the corrected line breadth in radians; and $\theta$ is half the Bragg angle (half of the $2\theta$ value of the selected peak, as obtained from the diffraction pattern). The ACS for the "outer" and "inner" d-spacings are also referred to as ACS(100) and ACS(010), respectively. An Apparent Crystallite Volume (ACV) is herein defined by the expression: $ACV=[ACS(100)*ACS(010)]^{3/2}$, Å$^3$.

X-ray Orientation Angle: A bundle of filaments about 0.5 mm in diameter is wrapped on a sample holder with care to keep the filaments essentially parallel. The filaments in the filled sample holder are exposed to an X-ray beam produced by a Philips X-ray generator (Model 12045B) available from Philips Electronic Instruments. The diffraction pattern from the sample filaments is recorded on Kodak DEF Diagnostic Direct Exposure X-ray film (Catalogue Number 154–2463), in a Warhus pinhole camera. Collimators in the camera are 0.64 mm in diameter. The exposure is continued for about fifteen to thirty minutes (or generally long enough so that the diffraction feature to be measured is recorded at an Optical Density of ~1.0). A digitized image of the diffraction pattern is recorded with a video camera. Transmitted intensities are calibrated using black and white references, and gray level (0–255) is converted into optical density. The diffraction pattern of 66 nylon, 6 nylon, and copolymers of 66 and 6 nylon has two prominent equatorial reflections at $2\theta$ approximately 20°–21° and 23°; the outer (~23°) reflection is used for the measurement of Orientation Angle. A data array equivalent to an azimuthal trace through the two selected equatorial peaks (i.e. the outer reflection on each side of the pattern) is created by interpolation from the digital image data file; the array is constructed so that one data point equals one-third of one degree in arc.

The Orientation Angle (OA) is taken to be the arc length in degrees at the half-maximum optical density (angle subtending points of 50 percent of maximum density) of the equatorial peaks, corrected for background. This is computed from the number of data points between the half-height points on each side of the peak (with interpolation being used, this is not an integral number). Both peaks are measured and the Orientation Angle is taken as the average of the two measurements.

Long Period Spacing and Normalized Long Period Intensity: The long period spacing (LPS), and long period intensity (LPI), are measured with a Kratky small angle diffractometer manufactured by Anton Paar K. G., Graz, Austria. The diffractometer is installed at a line-focus port of a Philips XRG3100 x-ray generator equipped with a long fine focus X-ray tube operated at 45 KV and 40 ma. The X-ray focal spot is viewed at a 6 degree take-off angle and the beam width is defined with a 120 micrometer entrance slit. The copper K-alpha radiation from the x-ray tube is filtered with a 0.7 mil nickel filter and is detected with a NaI(TI) Scintillation counter equipped with a pulse height analyzer set to pass 90% of the CuK-alpha radiation symmetrically.

The nylon samples are prepared by winding the fibers parallel to each other about a holder containing a 2 cm diameter hole. The area covered by the fibers is about 2 cm by 2.5 cm and a typical sample contains about 1 gram of nylon. The actual amount of sample is determined by measuring the attenuation by the sample of a strong CuK-alpha X-ray signal and adjusting the thickness of the sample until the transmission of the X-ray beam is near 1/e or 0.3678. To measure the transmission, a strong scatterer is put in the diffracting position and the nylon sample is inserted in front of it, immediately beyond the beam defining slits. If the measured intensity without attenuation is Io and the attenuated intensity is I, then the transmission T is I/(Io). A sample with a transmission of 1/e has an optimum thickness since the diffracted intensity from a sample of greater or less thickness than optimum will be less than that from a sample of optimum thickness.

The nylon sample is mounted such that the fiber axis is perpendicular to the beam length (or parallel to the direction of travel of the detector). For a Kratky diffractometer viewing a horizontal line focus, the fiber axis is perpendicular to the table top. A scan of 180 points is collected between 0.1 and 4.0 degrees $2\theta$, as follows: 81 points with step size 0.0125 degrees between 0.1 and 1.1 degrees; 80 points with step size 0.025 degrees between 1.1 and 3.1 degrees; 19 points with step size 0.05 degrees between 3.1 and 4.0 degrees. The time for each scan is 1 hour and the counting time for each point is 20 seconds. The resulting data are smoothed with a moving parabolic window and the instrumental background is subtracted. The instrumental background, i.e. the scan obtained in the absence of a sample, is multiplied by the transmission, T, and subtracted, point by point, from the scan obtained from the sample. The data points of the scan are then corrected for sample thickness by multiplying by a correction factor, $CF=-1.0/(eT \ln(T))$. Here e is the base of the natural logarithm and ln(T) is the natural logarithm of T. Since T is less than 1, ln(T) is always negative and CF is positive. Also, if $T=1/e$, then $CF=1$ for the sample of optimum thickness. Therefore, CF is always greater than 1 and corrects the intensity from a sample of other than optimum thickness to the intensity that would have been observed had the thickness been optimum. For sample thicknesses reasonably close to optimum, CF can generally be maintained to less than 1.01 so that the correction for sample thickness can be maintained to less than a percent which is within the uncertainty imposed by the counting statistics.

The measured intensities arise from reflections whose diffraction vectors are parallel to the fiber axis. For most nylon fibers, a reflection is observed in the vicinity of 1 degree $2\theta$. To determine the precise position and intensity of this reflection, a background line is first drawn underneath the peak, tangent to the diffraction curve at angles both higher and lower than the peak itself. A line parallel to the tangent background line is then drawn tangent to the peak near its apparent maximum but generally at a slightly higher $2\theta$ value. The $2\theta$ value at this point of tangency is taken to be the position since it is position of the maximum if the sample background were subtracted. The long period spacing, LPS, is calculated from the Bragg Law using the peak position thus derived. For small angles this reduces to:

$$LPS=\lambda/\sin(2\theta)$$

The intensity of the peak, LPI, is defined as the vertical distance, in counts per second, between the point of tangency of the curve and the background line beneath it.

The Kratky diffractometer is a single beam instrument and measured intensities are arbitrary until standardized. The measured intensities may vary from instrument to instrument and with time for a given instrument because of x-ray tube aging, variation in alignment, drift, and deterioration of the scintillation crystal. For quantitative comparison among samples, measured intensities were normalized by ratioing with a stable, standard reference sample. This reference was chosen to be a nylon 66 sample (T-717 yarn from E. I. du Pont Co., Wilmington, Del.) which was used as feed yarn in the first example of this patent (Feed yarn 1).

Sonic Modulus: Sonic Modulus is measured as reported in Pacofsky U.S. Pat. No. 3,748,844 at col. 5 lines 17 to 38, the disclosure of which is incorporated by reference except that the fibers are conditioned for 24 hours at 70° F. (21° C.) and 65% relative humidity prior to the test and the nylon fibers are run at a tension of 0.1 grams per denier rather than the 0.5–0.7 reported for the polyester fibers of the referenced patent.

Preferred drawn yarns have sonic modulus (Ms) values between about 40 and 60 g/d, and especially between about 40 and 55 g/d.

Cross Polarization combined with "magic angle spinning" (CP/MAS) are Nuclear Magnetic Resonance (NMR) techniques used to collect spectral data which describe differences between the copolymer and homopolymer in both structure and composition. In particular solid state carbon-13 (C-13) and nitrogen-15(N-15) NMR data obtained using CP/MAS can be used to examine contributions from both crystalline and amorphous phases of the polymer. Such techniques are described by Schafer et. al. in Macromolecules 10, 384 (1977) and Schaefer et. al. in J. Magnetic Resonance 34, 443 (1979) and more recently by Veeman and coauthors in Macromolecules 22, 706(1989).

Structural information concerning the amorphous phases of the polymer is obtained by techniques described by Veeman in the above mentioned article and by VanderHart in Macromolecules 12, 1232 (1979) and Macromolecules 18, 1663 (1985).

Parameters governing molecular motion are obtained by a variety of techniques which include C-13T1 and C-13 Tlrho. The C-13T1 was developed by Torchia and described in J. Magnetic Resonance, vol. 30, 613 (1978). The measurement of C-13 Tlrho is described by Schafer in Macromolecules 10, 384 (1977).

Natural abundance nitrogen-15 NMR is used to provide complementary information in addition to that obtained from carbon-13 solid state NMR analysis. This analysis also provides information on the distribution of crystal structures with the polymer as illustrated by Mathias in Polymer Commun. 29, 192 (1988).

Dye rate methods:

It is well known that the dye rate of nylon fibers is strongly dependent on the structure. The radial and axial diffusion coefficients of dyes in nylon fibers may be measured according to the procedures described in Textile Research Institute of Princeton, N.J., in Dye Transport Phenomena, Progress Report No. 15 and references therein.

The loss of dye from a dye bath and thus sorption of the dye by the fiber and calculation of a diffusion coefficient from the data .may be carried out using the procedures described by H. Kobsa in a series of articles in Textile Research Journal, Vol. 55, No. 10, October 1985 beginning at page 573. A variation of this method is available at the Hamby Textile Institute of Carey, N.C.; wherein the dye rate, ($S_{25}$) expressed in units of reciprocal seconds ($sec^{-1}$), is measured using C.I. Acid Blue 40 at 25° C. An Apparent Diffusion Coefficient ($D_A$), which characterizes the "porosity" of the fiber structure to dye uptake, is defined herein by the expression: $D_A$ ($cm_2$/sec)=Measured Dye Rate ($S_{25}$)×Average Filament Cross-sectional Area ($cm^2$)÷Filament Shape Factor, wherein the Average Filament Cross-sectional Area is defined in terms of the filament denier and density by the relationship: Area ($cm^2$)=(dpf/density)/($9\times10^5$) and where, the Filament Shape Factor is defined by [$1/4\pi$)×square of the filament circumference divided by the filament cross-sectional area]; that is, the Apparent Diffusion Coefficient ($D_A$) is defined herein by the expression:

$$D_A = S_{25} \times \left(\frac{dpf}{\rho}\right) \times \left(\frac{1}{9 \times 10^5}\right)\left(\frac{4\pi \text{ area}}{\text{circumference}^2}\right)$$

A 3 dpf round filament with a density of 1.14 g/$cm^3$ having a measured dye rate of $50\times10^{-5}$ $sec^{-1}$ has a calculated apparent diffusion coefficient ($D_A$) of $14.6\times10^{-10}$ $cm^2$ $sec^{-1}$. Preferred filaments have an apparent diffusion coefficient ($D_A$) of at least about $15\times10^{-10}$ $cm^2$ $sec^{-1}$ and especially preferred have an apparent diffusion coefficient ($D_A$ of at least about $20\times10^{-10}$ $cm^2$ $sec^{-1}$.

Apparent Pore Mobility (APM) and Apparent Pore volume (APV) are measures of the openness of the amorphous regions to permit sufficient dye uptake for uniform along-end dyeing. The Apparent Pore Mobility (APM) is defined by the expression: (1−fa)/fa=(1-/fa−1). [A. Peterlin, J. Macromol. Sci. B, Vol. 11, p. 57 (1975).] and the Apparent Pore Volume (APV) is defined by the expression: (CPI/100)ACV which is analogous to the expression for amorphous free-volume per crystallite used for polyester fibers [J. H. Dumbleton and T. Murayama, Kolloid-Z., Z. Polym., Vol 220, No. 1, p. 41 (1967)]. To achieve uniform dyeings with Large Molecule Dyes, such as with C.I. Acid Blue 122 , the drawn yarns preferably have an APM greater than about 2 and greater than about

[4.75−(0.37×10⁻⁴)APV] and an APV greater than about 4×10⁻⁴ cubic angstroms; and preferred drawn yarns have an APM greater than about 2 and greater than about [5−(0.37×10⁻⁴)APV] and an APV greater than about 4×10⁴ cubic angstroms (as illustrated in FIG. 26.

EXAMPLE I

Parts A-E illustrate the poor fabric appearance after dying of fabrics knit from nylon flat yarns produced by warp-drawing and relaxing of feed yarns spun at low withdrawal speeds. These yarns, which are unsatisfactory for critical dye applications, are believed to result in poor fabric appearance because of along-end variations in dye uptake which are worse than fully-drawn yarns produced by a conventional spin-draw process. Parts F-K illustrate the process of the invention and the superior LMDR values obtainable using yarns produced in accordance with the invention.

Part A—Comparative

Nylon 6 having an RV of ~46 is spun at a melt temperature of 270° C. through a spinneret having 13 capillaries of length 0.022" and diameter 0.015". A quench cabinet is supplied with a cross-flow of 20° C. quench air at an average velocity of ~67 feet per minute (fpm). It is spun using a very low withdrawal speed of 590 mpm and is not mechanically drawn during the spinning process. This yarn can be referred to as a "low orientation yarn" (LOY). Finish is applied after converging of the filaments but no interlace is applied. The resulting 134 denier yarn has a very low orientation making it unsuitable for knitting or weaving as evidenced by a high elongation of about 320%.

670 bobbins of the feed yarn are placed on a creel equipped with tensioning devices for use in making yarn for 21" wide tricot. The creel and tensioning devices are the same as those commonly used for preparing beams of yarn. The ends of yarn are passed through reeds and guides designed to arrange the yarns in a parallel manner to form a warp, and are then passed to a Barmag STF1 draw unit at a warp draw ratio of 3.00, a draw roll temperature of 60° C., an overfeed of 2.5%, a relaxation temperature of 22° C., and wound onto a beam at a speed of 320 mpm. The resulting yarn has a denier of 44.2 and an elongation of 52.8%.

Beams of the drawn yarn are knit into a 32 gauge tricot fabric and dyed with C. I. Acid Blue 80 dye according to the LMDR procedure. The dyed fabric is rated for uniformity and unacceptable LMDR of 4 is achieved. Details of the process and yarn properties are provided in Table 1.

Part B—Comparative

Nylon 66 having an RV of ~40 is spun at a melt temperature of 290° C. through a spinneret containing 14 capillaries of length 0.022" and diameter 0.015". The filaments are quenched and converged as in Part A to produce a 125 denier feed yarn having properties as described in Table I. 670 bobbins of the feed yarn are drawn at 500 mpm using a Karl Mayer DSST 50 machine as indicated in Table I to produce a 44 denier yarn with the properties listed in Table I. When dyed with C. I. Acid Blue 80 dye as in Part A, the LMDR is an unacceptable 3.5

Part C—Comparative

Nylon 6,6 having an RV of ~42 is spun at a melt temperature of 290° C. through a spinneret having 13 capillaries of length 0.022" and diameter 0.015". A quench cabinet is supplied with a cross-flow of 20° C. quench air at an average velocity of ~67 feet per minute (fpm). The filaments are converged into yarn at a finish roll applicator just below the quench cabinet. The yarn is then passed through an interfloor tube to a feed roll which provides a withdrawal speed of 1500 mpm and then to a draw roll at a speed 1.60 times that of the feed roll or 2400 mpm. Subsequent rolls may vary the speed slightly from 2400 mpm to adjust tensions. Interlace was applied at a level sufficient for efficient removal of the yarn later from the bobbin. The yarn is wound on a tube at a tension of ~0.2 g/d. This yarn, having been mechanically drawn only 1.60X, is at this point only partially oriented and does not yet possess the tensile properties ideal for warp knitting or weaving and is used as the feed yarn for the warp draw operation described before. It has a denier of 55 and an elongation of ~80% and can be referred to as a partially drawn yarn (PDY).

The feed yarn is warp drawn on a Barmag model STF1 draw unit at a draw ratio of 1.39X, a draw temperature of 60° C., an overfeed of 5%, a relaxation temperature of 120° C. and wound into a beam at a speed of 500 mpm. The resulting yarn has a denier of 42 and an elongation of 30%.

The drawn yarn is knit into a tricot fabric, dyed with C.I. Acid Blue 122 dye, and rated for LMDR. The LMDR is an unacceptable 4.4. Details of the process and yarn properties are provided in Table 1.

Part D—Comparative

The feed yarn is prepared as described in Part C except that the RV is 44, the feed roll (withdrawal) speed is 1849 mpm, the wind-up speed is 3217 mpm, and the draw ratio is 1.74X. The feed yarn in this example is 53 denier/13 filaments, has an elongation of 74% and a draw tension of 58 g.

The feed yarn is warp drawn on the Karl Mayer DSST 50 unit at a draw ratio of 1.35X, and a draw roll temperature of 70° C. The drawn yarn is overfed by 5% to the exit rolls, relaxed at 129° C. between the draw rolls and the exit rolls, and wound into a beam at 500 mpm. The resulting PDY yarn has a denier of 41 and an elongation of ~40%.

Beams of the warp drawn yarn are knitted on a 32 gauge tricot knitting machine to form a warp knit fabric. The fabric is dyed using C.I. Acid Blue 80 dye and rated for LMDR uniformity. An unacceptable LMDR of 3 is obtained. Details of the process and yarn properties are provided in Table 1.

Part E—Comparative

The feed yarn is prepared as described in Part C except that the RV is 45, the feed roll (withdrawal) speed is 1937 mpm, the wind-up speed is 3254 mpm, and the draw ratio is 1.68X. The feed yarn in this example is 95 denier/34 filaments, has an elongation of 67% and other properties as indicated in Table I.

The feed yarn is warp drawn on the Barmag model STF1 unit at a draw ratio of 1.43X, and a draw roll temperature of 60° C. The drawn yarn is overfed by 5% to the exit rolls, relaxed at 22° C. between the draw rolls and the exit rolls, and wound into a beam 500 mpm. The resulting PDY yarn has a denier of 72.7 and an elongation of ~34.2%.

Beams of the warp drawn yarn are knitted on a 32 gauge tricot knitting machine to form a warp knit fabric. The fabric is dyed using C.I. Acid Blue 80 dye and rated for LMDR uniformity. An unacceptable LMDR of 3 is obtained. Details of the process and yarn properties are provided in Table 1.

Part F—Invention

Nylon 6,6 having an RV of ~42 is spun at a melt temperature of 290° C. through a spinneret containing 17 capillaries of length 0.022" and diameter 0.015". A quench cabinet is supplied with a cross-flow of 20° C. quench air at an average velocity of ~67 fpm. The filaments are converged into yarn at a finish roll applicator just below the quench unit. The yarn is then passed through an interfloor tube to a feed roll which provides a withdrawal speed of 2818 mpm and then to a draw roll at a speed 1.26 times that of the feed roll or 3551 mpm. Subsequent rolls may vary the speed slightly from 3551 mpm to adjust tensions and apply interlace. The yarn is wound on a tube at about 3551 and at a tension of ~0.2 gpd. The result is a 55 denier PDY yarn with an elongation of 60% and a draw tension of 59 g.

The yarn is warp drawn on the Barmag STF1 draw unit at a draw ratio of 1.29, a draw temperature of 6O° C., an overfeed of 6%, was relaxed at 22° C. and wound into a beam at a speed of 550 mpm. The resulting yarn had a denier of 45.5 and an elongation of 28.5%. The drawn yarn is knit into a tricot fabric, dyed with C.I. Acid Blue 80 dye according to the LMDR procedure, and rated for uniformity. The uniformity rating is an excellent 7.8.

Part G—Invention

Nylon 6,6 having an RV of ~50 is spun at a melt temperature of 290° C. through a spinneret containing 17 trilobal capillaries of leg length 0.015" and leg width 0.004". A quench cabinet is supplied with a cross-flow of 20° C. quench air at an average velocity of ~127 fpm. The filaments are converged into yarn at a finish roll applicator just below the quench unit. The yarn is then passed through an interfloor tube to an undriven air bearing separator roll with a speed of 3909 mpm (withdrawal speed) and interlace is applied. The yarn is wound on a tube at 3909 mpm and at a tension of ~0.2 gpd. Thus, there is no mechanical draw. The result is a 55 denier trilobal cross-section feed yarn which has not been drawn appreciably but, because of the tension generated by the high speed spinning, the yarn is oriented sufficiently in the quench zone to give it an elongation of 85% and a draw tension of 40 g. Thus, it may be referred to as a "spun oriented yarn" (SOY).

The feed yarn is warp drawn on the Barmag STF1 draw unit at a draw ratio of 1.316X, a draw temperature of 60° C., an overfeed of 5%, was relaxed at ambient temperature, and wound into a beam at a speed of 550 mpm. The resulting drawn yarn has a denier of 43.8 and an elongation of 53.1%.

The drawn yarn is knit into a tricot fabric, dyed with C.I. Acid Blue 80 dye according to the LMDR procedure, and rated for uniformity. The LMDR is a superior 7.1. Details of the process and yarn properties are provided in Table 1.

Part H—Invention

Nylon 6,6 having an RV of ~50 is spun at a melt temperature of 290° C. through a spinneret containing 17 capillaries of length 0.022" and diameter 0.015". A quench cabinet is supplied with a cross-flow of 20° C. quench air at an average velocity of ~67 fpm. The filaments are converged into yarn at a finish roll applicator just below the quench unit. The yarn is then passed through an interfloor tube to an undriven air bearing separator roll with a speed of 3954 mpm (withdrawal speed) and interlace is applied. The yarn is wound on a tube at 3989 mpm and at a tension of ~0.2 gpd. Thus the mechanical draw is insignificant at 1.009X. The result is a 52 denier feed yarn which has not been drawn appreciably but, because of the tension generated by the high speed spinning, the yarn is oriented sufficiently in the quench zone to give it an elongation of 78% and a draw tension of 40 g. Thus, it may be referred to as a "spun oriented yarn" (SOY).

The feed yarn is warp drawn on the Barmag STF1 draw unit at a draw ratio of 1.45X, a draw temperature of 60° C., an overfeed of 6%, was relaxed at 22° C. and wound into a beam at a speed of 550 mpm. The resulting drawn yarn has a denier of 39.6 and an elongation of 30.6%

The drawn yarn is knit into a tricot fabric, dyed with the C.I. Acid Blue 80 dye according to the LMDR procedure, and rated for uniformity. The LMDR is a superior 7.4. Details of the process and yarn properties are provided in Table 1.

Part I—Invention

Nylon 6, having an RV of 46 is spun at a melt temperature of 275° C. through a spinneret containing 10 capillaries of length 0.010" and diameter 0.020". A quench cabinet is supplied with a cross-flow of 20° C. quench air at an average velocity of ~67 fpm. The filaments are converged into yarn at a metered finish applicator just below the quench unit and the yarn is then passed through an interfloor tube and onto a windup where the yarn is wound at a speed of 4200 mpm (withdrawal speed) and a tension of ~0.2 gpd. The SOY yarn is not mechanically drawn and passes over no rolls before the wind-up but, because of the tension generated by the high speed spinning, the yarn is oriented sufficiently in the quench zone to give it an elongation of ~67.5% and a draw tension of 42.8 g. The yarn has a denier of 46.

The feed yarn is warp drawn on the Karl Mayer DSST 50 draw unit at a draw ratio of 1.23, a draw temperature of 80° C., an overfeed of 6.7%, a relaxation temperature of 120° C., and wound into a beam at a speed of 500 mpm. The resulting drawn yarn had a denier of 40 and an elongation of 42%.

The drawn yarn is knit into a tricot fabric, dyed with C.I. Acid Blue 122 dye according to the LMDR procedure, and rated for uniformity. The uniformity rating is a superior 7.4.

Part J—Invention

Nylon 66 having an RV of 65 is prepared as in example F, except that the windup (withdrawal) speed is 5300 mpm. The resulting 13 filament SOY feed yarn for warp-drawing has a denier of 50.5, an elongation of 73.5%, and a draw tension of 63 g.

The feed yarn is warp draw on the Barmag STF1 draw unit at a draw ratio of 1.15X, a draw temperature of 60° C., an overfeed of 5%, was relaxed at 22° C. and was wound into a beam at a speed of 550 mpm. The resulting drawn yarn had a denier of 46.5 and an elongation of 47%.

The drawn yarn is knit into a tricot fabric, dyed with C.I. Acid Blue 80 dye according to the LMDR procedure, and rated for uniformity. The uniformity rating is an excellent 7.6.

Part K—Invention

A nylon 66 copolymer, 95 mole % poly(hexamethylene adipamide) and 5% by weight ε-caproamide units having an RV of 65 is prepared as in example J. The resulting 13 filament SOY feed yarn for warp-drawing has a denier of 50.0, an elongation of 76.1%, and a draw tension of 63 g.

The feed yarn is warp drawn on the Barmag STF1 draw unit at a draw ratio of 1.30X, a draw temperature of 60° C., an overfeed of 5%, was relaxed at 118° C. and was wound into a beam at a speed of 550 mpm. The resulting drawn yarn had a denier of 39.5 and an elongation of 41.7%.

The drawn yarn is knit into a tricot fabric, dyed with C.I. Acid Blue 80 dye according to the LMDR procedure, and rated for uniformity. The uniformity rating is an excellent 7.6.

TABLE I

| EXAMPLE I - Part | A | B | C | D | E |
|---|---|---|---|---|---|
| | | Comparative | | | |
| SPIN SPEED, mpm | 590 | 889 | 1500 | 1849 | 1937 |
| SPIN DRAW RATIO | 1.00 | 1.00 | 1.60 | 1.73 | 1.68 |
| FEED YARN | | | | | |
| NYLON POLYMER TYPE | 6 | 6,6 | 6,6 | 6,6 | 6,6 |
| DENIER | 134 | 125 | 55 | 53 | 95 |
| FILAMENTS | 13 | 14 | 13 | 13 | 34 |
| RV | 46 | 40 | 42 | 44 | 45 |
| ELONGATION, % | 320 | 250 | 80 | 74 | 67 |
| $(RDR)_F$ | 4.2 | 3.5 | 1.80 | 1.74 | 1.67 |
| $(RDR)_S$ | 4.2 | 3.5 | 2.88 | 3.01 | 2.81 |
| TENACITY, g/d | 1.1 | N/A | 2.99 | 4.14 | 3.9 |
| MODULUS, g/d | N/A | N/A | 8.2 | 16.6 | N/A |
| $DT_{33}$, g | N/A | 49 | 36.5 | 58 | 114 |
| $DT_{33}$, % CV | N/A | 1.0 | 1.3 | .87 | 1.3 |
| $DT_{33}$, g/d | N/A | 0.52 | 0.66 | 1.09 | 1.20 |
| DVA, % CV | N/A | N/A | .40 | N/A | N/A |
| USTER, % | N/A | N/A | N/A | N/A | N/A |
| WARP DRAW CONDITIONS | | | | | |
| WD UNIT | BARMAG | MAYER | BARMAG | MAYER | BARMAG |
| WD SPEED, mpm | 320 | 500 | 500 | 500 | 550 |
| WD RATIO | 3.00 | 3.00 | 1.39 | 1.35 | 1.43 |
| WD TEMP °C. | 60 | 85 | 60 | 70 | 60 |
| OVERFEED, % | 2.5 | 9 | 5 | 5 | 5 |
| HEATER TEMP, °C. | OFF | 180 | 130 | 140 | OFF |
| RELAX TEMP, °C. | 22 | 161 | 120 | 129 | 22 |
| DRAWN YARN PROPERTIES | | | | | |
| DENIER | 44.2 | 44 | 42 | 41 | 72.7 |
| ELONGATION, % | 52.8 | 48 | 30 | 35 | 34.2 |
| $(RDR)_D$ | 1.528 | 1.48 | 1.30 | 1.35 | 1.342 |
| TENACITY, g/d | 3.70 | 4.1 | N/A | 5.0 | 5.19 |
| MODULUS, g/d | 19.4 | 20 | N/A | 32 | 24.2 |
| DVA % CV | 1.42 | N/A | N/A | N/A | .47 |
| USTER, % | N/A | N/A | N/A | N/A | N/A |
| BOIL-OFF SHRINK, % | 10.8 | 3.5 | N/A | 8.4 | 7.6 |
| LMDR RATING | 4 | 3.5 | 4.4 | 3.0 | 3.0 |

| EXAMPLE I - Part | F | G | H | I | J | K |
|---|---|---|---|---|---|---|
| | | Invention | | | | |
| SPIN SPEED, mpm | 2818 | 3909 | 3954 | 4200 | 5300 | 5300 |
| SPIN DRAW RATIO | 1.26 | 1.00 | 1.009 | 1.00 | 1.00 | 1.00 |
| FEED YARN | | | | | | |
| NYLON POLYMER TYPE | 6,6 | 6,6 | 6,6 | 6 | 6,6 | 95%/5% 66/6 |
| DENIER | 55 | 55 | 52 | 46 | 50.5 | 50.0 |
| FILAMENTS | 17 | 17 | 17 | 10 | 13 | 13 |
| RV | 42 | 50 | 50 | 46 | 65 | 65 |
| ELONGATION, % | 60 | 85 | 78 | 67.5 | 73.5 | 76.1 |
| $(RDR)_F$ | 1.60 | 1.85 | 1.78 | 1.675 | 1.735 | 1.761 |
| $(RDR)_S$ | 2.02 | 1.85 | 1.80 | 1.675 | 1.735 | 1.761 |
| TENACITY, g/d | 3.6 | 2.97 | 2.88 | 4.3 | 4.23 | 4.24 |
| MODULUS, g/d | 18.5 | 12.8 | 12.7 | N/A | 14.3 | 13.7 |
| $DT_{33}$, g | 63 | 41.9 | 43.4 | 42.8 | 63.5 | 58.8 |
| $DT_{33}$, % CV | .63 | .36 | .30 | ~1.0 | .39 | .41 |
| $DT_{33}$, g/d | 1.15 | 0.76 | 0.83 | 0.93 | 1.26 | 1.18 |
| DVA, % CV | .38 | .27 | .41 | N/A | .46 | .46 |
| USTER, % | .82 | .68 | .63 | .91 | .62 | .70 |
| WARP DRAW CONDITIONS | | | | | | |
| WD UNIT | BARMAG | BARMAG | BARMAG | MAYER | BARMAG | BARMAG |
| WD SPEED, mpm | 550 | 550 | 550 | 500 | 550 | 550 |
| WD RATIO | 1.29 | 1.316 | 1.45 | 1.23 | 1.15 | 1.30 |
| WD TEMP, °C. | 60 | 60 | 60 | 80 | 60 | 60 |
| OVERFEED, % | 6 | 5 | 6 | 6.7 | 5 | 5 |
| HEATER TEMP, °C. | OFF | 130 | OFF | 130 | OFF | 130 |

TABLE I-continued

| | | | | | | |
|---|---|---|---|---|---|---|
| RELAX TEMP, °C. | 22 | 118 | 22 | 120 | 22 | 118 |
| DRAWN YARN PROPERTIES | | | | | | |
| DENIER | 45.5 | 43.8 | 39.6 | 40 | 46.5 | 39.5 |
| ELONGATION, % | 28.5 | 53.1 | 30.6 | 42 | 47 | 41.7 |
| $RDR_D$ | 1.285 | 1.531 | 1.306 | 1.42 | 1.47 | 1.417 |
| TENACITY, g/d | 4.3 | 3.87 | 4.16 | 4.89 | 4.51 | 5.27 |
| MODULUS, g/d | 25.6 | 15.2 | N/A | N/A | 20.9 | 21.8 |
| DVA, % CV | .37 | .35 | .35 | N/A | .40 | .45 |
| USTER, % | .74 | N/A | N/A | N/A | .73 | .73 |
| BOIL-OFF SHRINK, % | 5.1 | 6.5 | 8.3 | 7.0 | 5.9 | 7.5 |
| LMDR RATING | 7.8 | 7.1 | 7.4 | 7.4 | 7.6 | 7.6 |

EXAMPLE II

Example II illustrates the effect of warp-drawing conditions on LMDR. The PDY feed yarn described in Example I—Part "F" above is warp drawn on the Barmag STF1 unit at various warp draw ratios and relaxation temperatures as indicated for items 1–13 in Table II. The resulting beams are warp knit into a 32 guage tricot fabric, dyed with C.I. Acid Blue 80 dye by the LMDR procedure, and rated for uniformity with the results being shown in Table II.

TABLE II

Example II

| FEED YARN | I-F | I-F | I-F | I-F | I-F |
|---|---|---|---|---|---|
| DRAWN ITEM NO. | II-1 | II-2 | II-3 | II-4 | II-5 |
| WARP DRAW CONDITIONS | | | | | |
| WD SPEED, mpm | 500 | 500 | 500 | 550 | 550 |
| WD RATIO | 1.25 | 1.25 | 1.38 | 1.48 | 1.48 |
| WD TENSION, g | 82 | 68 | >100 | 80 | 84 |
| WD TENSION, g/dd* | 1.78 | 1.48 | >2.41 | 2.05 | 2.13 |
| WD TEMP, °C. | 60 | 60 | 60 | 60 | 60 |
| OVERFEED, % | 5 | 6 | 5 | 5 | 6 |
| HEATER TEMP, °C. | 140 | OFF | 140 | 160 | OFF |
| RELAX TEMP, °C. | 130 | 22 | 130 | 143 | 22 |
| DRAWN YARN PROPERTIES | | | | | |
| DENIER | 46 | 46 | 41.5 | 39 | 39.5 |
| ELONGATION, % | 32 | 33 | 21 | 15.5 | 16.5 |
| $(RDR)_D$ | 1.32 | 1.33 | 1.21 | 1.155 | 1.165 |
| TENACITY, g/d | 4.2 | 4.1 | 4.9 | 5.9 | 5.5 |
| MODULUS, g/d | 27.6 | 25.0 | 34.4 | 39.6 | 34.4 |
| DVA, % CV | .44 | .44 | .44 | .34 | .37 |
| USTER, % | .82 | .78 | .73 | .82 | .82 |
| BOIL-OFF SHRINK, % | 7.0 | 7.2 | 7.8 | 8.0 | 7.4 |
| LMDR RATING | 6.0 | 6.2 | 5.8 | 5.4 | 6.1 |

| FEED YARN | I-F | I-F | I-F | I-F | I-F |
|---|---|---|---|---|---|
| DRAWN ITEM NO. | II-6 | II-7 | II-8 | II-9 | II-10 |
| WARP DRAW CONDITIONS | | | | | |
| WD SPEED, mpm | 550 | 550 | 550 | 550 | 550 |
| WD RATIO | 1.05 | 1.05 | 1.29 | 1.29 | 1.29 |
| WD TENSION, g | 24 | 26 | 58 | 58 | 56 |
| WD TENSION, g/dd* | .46 | .49 | 1.27 | 1.30 | 1.26 |
| WD TEMP, °C. | 60 | 60 | 60 | 60 | 60 |
| OVERFEED, % | 1 | 1 | 6 | 6 | 5 |
| HEATER TEMP, °C. | 160 | OFF | OFF | 100 | 130 |
| RELAX TEMP, °C. | 143 | 22 | 22 | 94 | 118 |
| DRAWN YARN PROPERTIES | | | | | |
| DENIER | 52 | 53.5 | 45.5 | 44.5 | 44.5 |
| ELONGATION, % | 52.5 | 56.5 | 28.5 | 29 | 29 |
| $RDR_D$ | 1.525 | 1.565 | 1.285 | 1.29 | 1.29 |
| TENACITY, g/d | 3.7 | 3.5 | 4.3 | 4.4 | 4.3 |
| MODULUS, g/d | 18.4 | 19.5 | 25.6 | 27.0 | 28.6 |
| DVA, % CV | .31 | .34 | .37 | .30 | .36 |
| USTER, % | .83 | .73 | .74 | .73 | .78 |
| BOIL-OFF SHRINK, % | 3.4 | 4.8 | 5.1 | 5.7 | N/A |
| LMDR RATING | 6.3 | 7.8 | 7.8 | 7.1 | 6.4 |

| FEED YARN | I-F | I-F | I-F |
|---|---|---|---|
| DRAWN ITEM NO. | II-11 | II-12 | II-13 |
| WARP DRAW CONDITIONS | | | |
| WD SPEED, mpm | 550 | 550 | 550 |
| WD RATIO | 1.29 | 1.29 | 1.48 |
| WD TENSION, g | 60 | 53 | 80 |
| WD TENSION, g/dd* | 1.35 | 1.20 | 2.05 |
| WD TEMP, °C. | 60 | 60 | 60 |
| OVERFEED, % | 5 | 5 | 5 |
| HEATER TEMP, °C. | 160 | 190 | 130 |
| RELAX TEMP, °C. | 143 | 169 | 118 |

TABLE II-continued

| Example II | | | |
|---|---|---|---|
| DRAWN YARN PROPERTIES | | | |
| DENIER | 44.5 | 44 | 39 |
| ELONGATION, % | 30 | 30.5 | 15.5 |
| $RDR_D$ | 1.30 | 1.305 | 1.155 |
| TENACITY, g/d | 4.7 | 4.9 | 5.7 |
| MODULUS, g/d | 30.1 | 32.2 | 29.9 |
| DVA, % CV | .28 | .31 | .29 |
| USTER, % | .81 | .89 | .83 |
| BOIL-OFF SHRINK, % | 6.2 | 5.2 | 8.3 |
| LMDR RATING | 5.3 | 4.8 | 5.2 |

*g/dd = DRAW TENSION(g)/DRAWN DENIER

EXAMPLE III

Example III also illustrates the effect of warp-drawing conditions on LMDR. The SOY feed yarn described in Example I—Part "G" above is warp drawn on the Barmag STF1 unit at various warp draw ratios and relaxation temperatures as indicated for items 1-6 in Table III. The resulting beams are warp knit into a 32 gauge tricot fabric, dyed with C.I. Acid Blue 80 dye by the LMDR procedure, and rated for uniformity with the results shown in Table III.

TABLE III

| EXAMPLE III | | | | | |
|---|---|---|---|---|---|
| FEED YARN DRAWN ITEM NO. | I-G III-1 | I-G III-2 | I-G III-3 | I-G III-4 | I-G III-5 |
| WARP DRAW CONDITIONS | | | | | |
| WD SPEED, mpm | 550 | 550 | 550 | 550 | 550 |
| WD RATIO | 1.316 | 1.316 | 1.447 | 1.447 | 1.608 |
| WD TENSION, g | 60 | 58 | 77 | 60 | 96 |
| WD TENSION, g/dd* | 1.37 | 1.33 | 1.92 | 1.49 | 2.66 |
| WD TEMP, °C. | 60 | 60 | 60 | 60 | 60 |
| OVERFEED | 5 | 5 | 5 | 5 | 5 |
| HEATER TEMP, °C. | 130 | 160 | 130 | OFF | OFF |
| RELAX TEMP, °C. | 118 | 143 | 118 | 22 | 22 |
| DRAWN YARN PROPERTIES | | | | | |
| DENIER | 43.8 | 43.7 | 40.0 | 40.2 | 36.1 |
| ELONGATION, % | 53.1 | 51.9 | 39.8 | 43.6 | 30.5 |
| $RDR_D$ | 1.531 | 1.519 | 1.398 | 1.436 | 1.305 |
| TENACITY, g/d | 3.87 | 97 | 4.31 | 4.33 | 5.03 |
| MODULUS, g/d | 15.2 | 16.2 | 17.9 | 29.2 | 23.9 |
| DVA, % CV | .35 | .36 | .38 | .40 | .37 |
| USTER, % | N/A | N/A | N/A | N/A | N/A |
| BOIL-OFF SHRINK, % | 6.5 | 6.2 | 7.4 | 6.6 | 7.3 |
| LMDR RATING | 7.1 | 6.9 | 6.8 | 6.8 | 6.3 |

| FFED YARN DRAWN ITEM NO. | I-G III-6 |
|---|---|
| WARP DRAW CONDITIONS | |
| WD SPEED, mpm | 550 |
| WD RATIO | 1.608 |
| WD TENSION, g | 96 |
| WD TENSION, g/dd* | 2.68 |
| WD TEMP, °C. | 60 |
| OVERFEED, % | 5 |
| HEATER TEMP, °C. | 130 |
| RELAX TEMP, °C. | 118 |
| DRAWN YARN PROPERTIES | |
| DENIER | 35.8 |
| ELONGATION, % | 22.8 |
| $(RDR)_D$ | 1.228 |
| TENACITY, g/d | 5.18 |
| MODULUS, g/d | 47.0 |
| DVA, % CV | .40 |
| USTER, % | N/A |
| BOIL-OFF SHRINK, % | 7.6 |

TABLE III-continued

| EXAMPLE III | |
|---|---|
| LMDR RATING | 5.3 |

*g/dd = DRAW TENSION(g)/DRAWN DENIER

EXAMPLE IV

Example IV also illustrates the effect of warp-drawing conditions on LMDR. The SOY feed yarn described in Example I—Part "H" above is warp drawn on the Barmag STF1 unit at various warp draw ratios and relaxation temperatures as indicated for items 1-14 in Table III. The resulting beams are warp knit into a 32 gauge tricot fabric, dyed with C.I. Acid Blue 80 dye by the LMDR procedure, and rated for uniformity with the results should in Table IV.

TABLE IV

| FEED YARN DRAWN ITEM NO. | I-H IV-1 | I-H IV-2 | I-H IV-3 | I-H IV-4 | I-H IV-5 |
|---|---|---|---|---|---|
| WARP DRAW CONDITIONS | | | | | |
| WD SPEED, mpm | 550 | 550 | 550 | 550 | 550 |
| WD RATIO | 1.30 | 1.30 | 1.45 | 1.45 | 1.60 |
| WD TENSION, g | 24.5 | 19 | 50 | 49 | 61 |
| WD TENSION, g/dd* | .56 | .43 | 1.25 | 1.22 | 1.72 |
| WD TEMP, °C. | 60 | 60 | 60 | 60 | 60 |
| OVERFEED, % | 5 | 6 | 5 | 6 | 5 |
| HEATER TEMP, °C. | 160 | OFF | 160 | OFF | 160 |
| RELAX TEMP, °C. | 143 | 22 | 143 | 22 | 143 |
| DRAWN YARN PROPERTIES | | | | | |
| DENIER | 44 | 44.5 | 40 | 40 | 35.5 |
| ELONGATION, % | 39 | 45 | 27 | 30 | 23 |
| $(RDR)_D$ | 1.39 | 1.45 | 1.27 | 1.30 | 1.23 |
| TENACITY, g/d | 3.4 | 3.6 | 4.1 | 4.1 | 5.2 |
| MODULUS, g/d | N/A | N/A | N/A | N/A | N/A |
| DVA, % CV | .32 | .34 | .40 | .35 | .34 |
| USTER, % | N/A | N/A | N/A | N/A | N/A |
| BOIL-OFF SHRINK, % | 6.6 | 7.0 | 7.3 | 8.3 | 6.9 |
| LMDR RATING | 4.8 | 6.6 | 5.8 | 7.4 | 5.0 |

| FEED YARN DRAWN ITEM NO. | I-H IV-6 | I-H IV-7 | I-H IV-8 | I-H IV-9 | I-H IV-10 |
|---|---|---|---|---|---|
| WARP DRAW CONDITIONS | | | | | |
| WD SPEED, mpm | 550 | 550 | 550 | 550 | 550 |
| WD RATIO | 1.60 | 1.15 | 1.15 | 1.45 | 1.45 |
| WD TENSION, g | 61 | 59.5 | 57.5 | 50 | 49 |
| WD TENSION, g/dd* | 1.72 | 1.21 | 1.62 | 1.27 | 1.24 |
| WD TEMP, °C. | 60 | 60 | 60 | 60 | 60 |
| OVERFEED, % | 6 | 5 | 6 | 6 | 6 |
| HEATER TEMP, °C. | OFF | 160 | OFF | OFF | 100 |
| RELAX TEMP, °C. | 22 | 143 | 22 | 22 | 94 |
| DRAWN YARN PROPERTIES | | | | | |
| DENIER | 35.5 | 49 | 49.5 | 39.5 | 39.5 |
| ELONGATION, % | 22 | 64 | 71 | 39 | 38.5 |
| $RDR_D$ | 1.22 | 1.64 | 1.71 | 1.39 | 1.385 |

TABLE IV-continued

| | | | | | |
|---|---|---|---|---|---|
| TENACITY, g/d | 5.1 | 3.3 | 3.3 | 4.1 | 4.1 |
| MODULUS, g/d | N/A | N/A | N/A | N/A | N/A |
| DVA, % CV | .35 | .32 | .35 | .35 | .37 |
| USTER, % | N/A | N/A | N/A | N/A | N/A |
| BOIL-OFF SHRINK, % | 6.6 | 4.0 | N/A | 6.1 | 6.7 |
| LMDR RATING | 4.8 | 6.5 | 7.0 | 7.1 | 6.9 |
| FEED YARN | I-H | I-H | I-H | I-H | I-H |
| DRAWN ITEM NO. | IV-11 | IV-12 | IV-13 | IV-14 | |
| WARP DRAW CONDITIONS | | | | | |
| WD SPEED, mpm | 550 | 550 | 550 | 550 | |
| WD RATIO | 1.45 | 1.45 | 1.45 | 1.30 | |
| WD TENSION, g | 49 | 49 | 46 | 39.5 | |
| WD TENSION, g/dd* | 1.26 | 1.26 | 1.18 | .91 | |
| WD TEMP, °C. | 60 | 60 | 60 | 60 | |
| OVERFEED, % | 5 | 5 | 5 | 5 | |
| HEATER TEMP, °C. | 130 | 160 | 190 | 130 | |
| RELAX TEMP, °C. | 118 | 143 | 169 | 118 | |
| DRAWN YARN PROPERTIES | | | | | |
| DENIER | 39 | 39 | 39 | 43.5 | |
| ELONGATION, % | 34 | 32.5 | 32 | 44 | |
| $RDR_D$ | 1.34 | 1.325 | 1.32 | 1.44 | |
| TENACITY, g/d | 4.3 | 4.4 | 4.5 | 3.8 | |
| MODULUS | N/A | N/A | N/A | N/A | |
| DVA, % CV | .31 | .40 | .33 | .39 | |
| USTER, % | N/A | N/A | N/A | N/A | |
| BOIL-OFF SHRINK, % | 6.2 | 6.1 | 5.7 | 5.9 | |

TABLE IV-continued

| | | | | |
|---|---|---|---|---|
| LMDR RATING | 5.4 | 5.2 | 4.8 | 7.2 |

*g/dd = DRAW TENSION (g)/DRAWN DENIER

EXAMPLE V

Example V also illustrates the effect of warp-drawing conditions on LMDR. The SOY feed yarn described in Example I—Part "J" above is warp drawn on the Barmag STF1 unit at various warp draw ratios and relaxation temperatures as indicated for items 1–8 in Table V. The resulting beams are warp knit into a 32 guage tricot fabric, dyed with C.I. Acid Blue 80 dye by the LMDR procedure, and rated for uniformity with the results shown in Table V.

TABLE V

| | | | | | |
|---|---|---|---|---|---|
| FEED YARN | I-J | I-J | I-J | I-J | I-J |
| DRAWN ITEM NO. | V-1 | V-2 | V-3 | V-4 | V-5 |
| WARP DRAW CONDITIONS | | | | | |
| WD SPEED, mpm | 550 | 550 | 550 | 550 | 550 |
| WD RATIO | 1.15 | 1.15 | 1.30 | 1.30 | 1.45 |
| WD TENSION, g | 80 | 53 | 92 | 90 | 120 |
| WD TENSION, g/dd* | 1.72 | 1.15 | 2.24 | 2.15 | 3.23 |
| WD TEMP, °C. | 60 | 60 | 60 | 60 | 60 |
| OVERFEED, % | 5 | 5 | 5 | 5 | 5 |
| HEATER TEMP, °C. | OFF | 160 | 160 | OFF | OFF |
| RELAX TEMP, °C. | 22 | 143 | 143 | 22 | 22 |
| DRAWN YARN PROPERTIES | | | | | |
| DENIER | 46.5 | 46.0 | 41.1 | 41.9 | 37.2 |
| ELONGATION | 47.0 | 58.9 | 39.1 | 41.6 | 29.5 |
| $(RDR)_D$ | 1.47 | 1.589 | 1.391 | 1.416 | 1.295 |
| TENACITY, g/d | 4.51 | 4.51 | 5.06 | 4.96 | 5.81 |
| MODULUS, g/d | 20.9 | 19.0 | 25.3 | 22.8 | 30.7 |
| DVA, % CV | .52 | .62 | .62 | .64 | .60 |
| USTER, % | .73 | .80 | .82 | .77 | .88 |
| BOIL-OFF SHRINK, % | 5.9 | 4.9 | 6.7 | 5.9 | 6.9 |
| LMDR RATING | 7.6 | 6.6 | 6.7 | 6.7 | 5.1 |

| | | | |
|---|---|---|---|
| FFED YARN | I-J | I-J | I-J |
| DRAWN ITEM NO. | V-6 | V-7 | V-8 |
| WARP DRAW CONDITIONS | | | |
| WD SPEED, mpm | 550 | 550 | 550 |
| WD RATIO | 1.45 | 1.35 | 1.35 |
| WD TENSION, g | 135 | 109 | 80 |
| WD TENSION, g/dd* | 3.67 | 2.71 | 2.00 |
| WD TEMP, °C. | 60 | 60 | 60 |
| OVERFEED, % | 5 | 5 | 5 |
| HEATER TEMP, °C. | 160 | OFF | 130 |
| RELAX TEMP, °C. | 143 | 22 | 118 |
| DRAWN YARN PROPERTIES | | | |
| DENIER | 36.8 | 40.2 | 40.0 |
| ELONGATION, % | 28.3 | 41.2 | 36.0 |
| $(RDR)_D$ | 1.283 | 1.412 | 1.36 |
| TENACITY, g/d | 6.06 | 5.31 | 5.27 |
| MODULUS, g/d | 28.6 | 23.4 | 26.0 |
| DVA, % CV | .63 | .59 | .61 |
| USTER, % | .96 | .85 | .82 |
| BOIL-OFF SHRINK, % | 7.2 | 6.4 | 6.9 |
| LMDR RATING | 4.5 | 6.5 | 5.3 |

*g/dd = DRAW TENSION(g)/DRAWN DENIER

EXAMPLE VI

Example VI also illustrates the effect of warp-drawing conditions on LMDR. The SOY feed yarn described in Example I—Part "K" above is warp drawn on the Barmag STF1 unit at various warp draw ratios and relaxation temperatures as indicated for items 1–7 in Table VI. The resulting beams are warp knit into a 32 guage tricot fabric, dyed with C. I. Acid Blue 80 dye by the LMDR procedure, and rated for uniformity with the results shown in Table VI.

TABLE VI

| FEED YARN DRAWN ITEM NO. | I-K VI-1 | I-K VI-2 | I-K VI-3 | I-K VI-4 |
|---|---|---|---|---|
| WARP DRAW CONDITIONS | | | | |
| WD SPEED, mpm | 550 | 550 | 550 | 550 |
| WD RATIO | 1.15 | 1.30 | 1.30 | 1.30 |
| WD TENSION, g | 50 | 85 | 80 | 80 |
| WD TENSION, g/dd* | 1.12 | 2.14 | 2.03 | 1.98 |
| WD TEMP, °C. | 60 | 60 | 60 | 60 |
| OVERFEED, % | 5 | 5 | 5 | 5 |
| HEATER TEMP, °C. | 160 | 160 | 130 | OFF |
| RELAX TEMP, °C. | 143 | 143 | 118 | 22 |
| DRAWN YARN PROPERTIES | | | | |
| DENIER | 44.7 | 39.8 | 39.5 | 40.5 |
| ELONGATION, % | 60.3 | 43.2 | 41.7 | 49.8 |
| $RDR_D$ | 1.603 | 1.432 | 1.417 | 1.498 |
| TENACITY, g/d | 4.69 | 5.29 | 5.27 | 5.15 |
| MODULUS, g/d | 18.4 | 23.5 | 21.8 | 21.8 |
| DVA, % CV | .46 | .48 | .45 | .42 |
| USTER, % | .75 | .76 | .73 | .71 |
| BOIL-OFF SHRINK, % | 5.9 | 7.6 | 7.5 | 6.9 |
| LMDR RATING | 7.7 | 5.7 | 7.6 | 5.8 |

| FFED YARN DRAWN ITEM NO. | I-K VI-5 | I-K VI-6 | I-K VI-7 |
|---|---|---|---|
| WARP DRAW CONDITIONS | | | |
| WD SPEED, mpm | 550 | 550 | 550 |
| WD RATIO | 1.45 | 1.45 | 1.45 |
| WD TENSION, g | 105 | 115 | 110 |
| WD TENSION, g/dd* | 2.88 | 3.23 | 2.87 |
| WD TEMP, °C. | 60 | 60 | 60 |
| OVERFEED, % | 5 | 5 | 5 |
| HEATER TEMP, °C. | OFF | 130 | 160 |
| RELAX TEMP, °C. | 22 | 118 | 143 |
| DRAWN YARN PROPERTIES | | | |
| DENIER | 36.5 | 35.6 | 35.4 |
| ELONGATION, % | 36.4 | 33.2 | 30.5 |
| $RDR_D$ | 1.364 | 1.332 | 1.305 |
| TENACITY, g/d | 5.86 | 6.13 | 6.17 |
| MODULUS, gd | 21.3 | 29.2 | 26.6 |
| DVA, % CV | .51 | .49 | .41 |
| USTER, % | .73 | .72 | .72 |
| BOIL-OFF SHRINK, % | 8.1 | 8.6 | 8.3 |
| LMDR RATING | 6.5 | 3.6 | 5.6 |

*g/dd = DRAW TENSION(g)/DRAWN DENIER

EXAMPLE VII

Example VII illustrates the effect of draw temperature on LMDR. The SOY feed yarn described in Example I—Part "J" above is warp drawn on the Barmag STF1 unit at various warp draw temperatures as indicated for items 1–8 in Table VII. The resulting beams are warp knit into a 32 gauge tricot fabric, dyed with C.I. Acid Blue 80 dye by the LMDR procedure, and rated for uniformity with the results shown in Table VII. A sharp deterioration in uniformity results at a yarn draw temperature of between 156 and 178° C.

TABLE VII

| FEED YARN DRAWN ITEM NO. | I-J VII-1 | I-J VII-2 | I-J VII-3 | I-J VII-4 | I-J VII-5 |
|---|---|---|---|---|---|
| WARP DRAW CONDITIONS | | | | | |
| WD SPEED, mpm | 550 | 550 | 550 | 550 | 550 |
| WD RATIO | 1.33 | 1.33 | 1.33 | 1.33 | 1.33 |
| WD TENSION, g | 88 | 86 | 82 | 74 | 75 |
| WD TENSION, g/dd* | 2.18 | 2.16 | 2.06 | 1.88 | 1.92 |
| WD HTR TEMP, °C. | 80 | 95 | 100 | 125 | 150 |
| WD YARN TEMP, °C. | 80 | 90 | 94 | 113 | 135 |
| OVERFEED, % | 5 | 5 | 5 | 5 | 2.5 |
| RELAX HTR TEMP, °C. | OFF | OFF | OFF | OFF | OFF |
| RELAX TEMP, °C. | 22 | 22 | 22 | 22 | 22 |
| DRAWN YARN PROPERTIES | | | | | |
| DENIER | 40.4 | 39.8 | 39.9 | 39.4 | 39.0 |
| ELONGATION, % | 42.1 | 42.5 | 40.6 | 38.6 | 36.9 |
| $(RDR)_D$ | 1.421 | 1.425 | 1.406 | 1.386 | 1.369 |
| TENACITY, g/d | 5.23 | 5.44 | 5.40 | 5.51 | 5.65 |
| MODULUS, g/d | 21.6 | 19.3 | 23.0 | 24.3 | 28.2 |
| DVA, % CV | .42 | .53 | .43 | .39 | .41 |
| USTER, % | N/A | N/A | N/A | N/A | N/A |
| BOIL-OFF SHRINK, % | 6.5 | 7.0 | 6.7 | 6.9 | 6.9 |
| LMDR RATING | 8.3 | 8.3 | 6.4 | 7.0 | 8.2 |

| FEED YARN DRAWN ITEM NO. | I-J VII-6 | I-J VII-7 | I-J VII-8 |
|---|---|---|---|
| WARP DRAW CONDITIONS | | | |
| WD SPEED, mpm | 550 | 550 | 550 |
| WD RATIO | 1.33 | 1.33 | 1.33 |
| WD TENSION, g | 75 | 60 | 65 |
| WD TENSION, g/dd* | 1.94 | 1.58 | 1.70 |
| WD HTR TEMP, °C. | 175 | 200 | 225 |
| WD YARN TEMP, °C. | 156 | 178 | 199 |
| OVERFEED, % | 2.0 | 1.7 | 0.2 |
| RELAX HTR TEMP, °C. | OFF | OFF | OFF |
| RELAX TEMP, °C. | 22 | 22 | 22 |
| DRAWN YARN PROPERTIES | | | |
| DENIER | 38.6 | 37.9 | 38.2 |
| ELONGATION, % | 35.0 | 33.3 | 32.2 |
| $(RDR)_D$ | 1.35 | 1.333 | 1.322 |
| TENACITY, g/d | 5.73 | 6.01 | 5.94 |
| MODULUS, g/d | 32.5 | 41.7 | 39.4 |
| DVA, % CV | .41 | .48 | .45 |
| USTER, % | N/A | N/A | N/A |
| BOIL-OFF SHRINK, % | 6.6 | 6.0 | 5.1 |
| LMDR RATING | 7.7 | 3.6 | 3.6 |

EXAMPLE VIII

Example VIII illustrates the feasibility of warp drawing yarns containing MPMD. Three SOY feed yarns were used. Item J is the same yarn as is described in Example I—Part "J". Item L was spun as described in Example I—Part "J", except that it contained 5% Me5-6, and Item M was also spun as described in Example I—Part "J" except that it contained 20% MPMD. These items were drawn on the Barmag STF1 unit at the same draw ratio, but at various relaxation temperatures and wound on a single-end winder. The resulting bobbins of yarn were knit into Lawson Tubing and all drawn items were dyed in the same dye bath with C.I. Acid Blue 122 using the LMDR dye procedure except that only relative dye Shade was evaluated.

TABLE VIII

| FEED YARN DRAWN ITEM NO. | L VIII-1 | L VIII-2 | L VIII-3 | M VIII-4 | M VIII-5 |
|---|---|---|---|---|---|
| SPIN SPEED, mpm | 5300 | 5300 | 5300 | 5300 | 5300 |
| SPIN DRAW RATIO | 1.00 | 1.00 | 1.00 | 1.00 | 1.00 |
| FEED YARN | | | | | |
| % MPMD | 5 | 5 | 5 | 20 | 20 |
| DENIER | 50.7 | 50.7 | 50.7 | 50.5 | 50.5 |
| FILAMENTS | 13 | 13 | 13 | 13 | 13 |
| RV | 66.4 | 66.4 | 66.4 | 66.8 | 66.8 |
| ELONGATION, % | 80.3 | 80.3 | 80.3 | 74.5 | 74.5 |

TABLE VIII-continued

| | | | | | |
|---|---|---|---|---|---|
| $(RDR)_F$ | 1.803 | 1.803 | 1.803 | 1.745 | 1.745 |
| $(RDR)_S$ | 1.803 | 1.803 | 1.803 | 1.745 | 1.745 |
| TENACITY, g/d | 3.84 | 3.84 | 3.84 | 3.58 | 3.58 |
| MODULUS, g/d | 11.6 | 11.6 | 11.6 | 10.9 | 10.9 |
| $DT_{33}$, g | 55.8. | 55.8 | 55.8 | 52.6 | 52.6 |
| $DT_{33}$, % CV | .79 | .79 | .79 | .46 | .46 |
| $DT_{33}$, g/d | 1.10 | 1.10 | 1.10 | 1.04 | 1.04 |
| DVA, % CV | .86 | .86 | .86 | N/A | N/A |
| WARP DRAW CONDITONS | | | | | |
| WD UNIT | BARMAG | BARMAG | BARMAG | BARMAG | BARMAG |
| WD SPEED, mpm | 550 | 550 | 550 | 550 | 550 |
| WD RATIO | 1.316 | 1.316 | 1.316 | 1.316 | 1.316 |
| WD TEMP, °C. | 60 | 60 | 60 | 60 | 60 |
| OVERFEED, % | 5 | 5 | 5 | 5 | 5 |
| HEATER TEMP, °C. | OFF | 105 | 130 | OFF | 95 |
| RELAX TEMP, °C. | 22 | 98 | 118 | 22 | 90 |
| WD TENSION, gms | 90 | 88 | 82 | 80 | 78 |
| WD TENSION, g/dd | 2.12 | 2.04 | 1.90 | 1.88 | 1.84 |
| DRAWN YARN PROPERTIES | | | | | |
| DENIER | 42.3 | 43.1 | 43.2 | 42.5 | 42.4 |
| ELONGATION, % | 46.3 | 45.2 | 44.8 | 37.5 | 39.3 |
| $(RDR)_D$ | 1.463 | 1.452 | 1.448 | 1.375 | 1.393 |
| TENACITY, g/d | 4.55 | 4.51 | 4.54 | 4.28 | 4.34 |
| MODULUS, g/d | 27.0 | 29.6 | 35.6 | 30.2 | 25.6 |
| DVA, % CV | .67 | .86 | .76 | .57 | .58 |
| BOIL-OFF SHRINK, % | 8.3 | 8.3 | 7.6 | 10.7 | 10.7 |
| RELATIVE DYE SHADE | MED | MED | MED | DARK | DARK |

| FEED YARN | M | I-J | I-J | I-J |
|---|---|---|---|---|
| DRAWN ITEM NO. | VIII-6 | VIII-7 | VIII-8 | VIII-9 |
| SPIN SPEED, mpm | 5300 | 5300 | 5300 | 5300 |
| SPIN DRAW RATIO | 1.00 | 1.00 | 1.00 | 1.00 |
| FEED YARN | | | | |
| % MPMD | 20 | 0 | 0 | 0 |
| DENIER | 50.7 | 50.5 | 50.5 | 50.5 |
| FILAMENTS | 13 | 13 | 13 | 13 |
| RV | 66.8 | 65 | 65 | 65 |
| ELONGATION, % | 74.5 | 73.5 | 73.5 | 73.5 |
| $(RDR)_F$ | 1.745 | 1.735 | 1.735 | 1.735 |
| $(RDR)_S$ | 1.745 | 1.735 | 1.735 | 1.735 |
| TENACITY, g/d | 3.58 | 4.23 | 4.23 | 4.23 |
| MODULUS, g/d | 10.9 | 14.3 | 14.3 | 14.3 |
| $DT_{33}$, g | 52.6 | 63.5 | 63.5 | 63.5 |
| $DT_{33}$, % CV | .46 | .39 | .39 | .39 |
| $DT_{33}$, g/d | 1.04 | 1.26 | 1.26 | 1.26 |
| DVA, % CV | N/A | .46 | .46 | .46 |
| WARP DRAW CONDITIONS | | | | |
| WD UNIT | BARMAG | BARMAG | BARMAG | BARMAG |
| WD SPEED, mpm | 550 | 550 | 550 | 550 |
| WD RATIO | 1.316 | 1.316 | 1.316 | 1.316 |
| WD TEMP, °C. | 60 | 60 | 60 | 60 |
| OVERFEED, % | 5 | 5 | 5 | 5 |
| HEATER TEMP, °C. | 120 | OFF | 95 | 120 |
| RELAX TEMP, °C. | 109 | 22 | 90 | 109 |
| WD TENSION, gms | 80 | 96 | 96 | 98 |
| WD TENSION, g/dd | 1.90 | 2.28 | 2.32 | 2.38 |
| DRAW YARN PROPERTIES | | | | |
| DENIER | 42.2 | 42.1 | 41.4 | 41.1 |
| ELONGATION, % | 42.1 | 36.5 | 35.8 | 34.1 |
| $RDR_D$ | 1.421 | 1.365 | 1.358 | 1.341 |
| TENACITY, g/d | 4.46 | 5.05 | 5.08 | 5.04 |
| MODULUS, g/d | 28.0 | 42.1 | 37.5 | 38.8 |
| DVA, % CV | .56 | .51 | .44 | .41 |
| BOIL-OFF SHRINK, % | 10.6 | 7.3 | 7.3 | 7.3 |
| RELATIVE DYE SHADE | DARK | LIGHT | LIGHT | LIGHT |

EXAMPLE IX

Example IX illustrates that when yarns lack certain physical properties which are imparted by drawing, poor fabric uniformity can result. Item IX-1 is a warp drawn "feed" yarn of nylon 66 containing 5% by weight of nylon 6, which is similar to item K in Table I, except that the cross-section of the filaments in Item IX-1 is trilobal. Item IX-1 was beamed by normal beaming procedures, without drawing or heat setting. Item IX-2 was draw beamed using item IX-1 as the "feed" yarn. Both items were then knit and dyed by several procedures to analyze fabric uniformity. Procedure "8" is identical to the LMDR procedure except that the dye is Pontamine Fast Turquoise 8GL. Procedure "4" is identical to the LMDR procedure except that the surfactant Merpol DA is omitted. Procedures "4" and "8" are both structure sensitive and procedure "4" is even more sensitive to fine structure variations (that is, to variations in structure openess) than the LMDR procedure. Procedure "2" is a procedure in which the fabric is dyed for 60 minutes at 100° C. in a bath containing 0.5% C.I. Disperse Blue 3, which is a leveling dye.

Procedure "2" is used to identify configurational causes of dyed fabric non-uniformity; that is, non-uniformities which are caused by physical differences in the yarn and not differences in dye uptake (that is, dye rate and/or $T_{DYE}$). From comparison of the fabric dye ratings (procedures "2", "4" and "8") for Items IX-1 (feed, undrawn yarn) and of item IX-2 (warp drawn yarn), shows that Item IX-2 is more uniform than the corresponding beamed, undrawn feed yarn Item IX-1. It may be concluded that the non-uniformities in procedures and "8" are caused by the configuration of dye non-uniformities (as seen in Procedure "2") super-imposed upon any non-uniformities caused by variations in fiber structure. The poorer fabric uniformity of Item IX-1 is attributed, in part, to the lower initial tensile modulus (12.2 g/d) versus the higher initial modulus (21.3 g/d) of Item IX-2. Yarns having an initial modulus less than about 15 g/d are found to be susceptible to being non-uniformly stretched in normal beaming and knitting leading to poor configurational dyed fabric uniformity. Warp drawing of uniform feed yarns to increase their initial modulus to values greater than about 15 g/d improves dyed fabric uniformity by reducing the possibility of imparting configurational defects during fabric making. However, drawing said feeds to initial moduli greater than about 15 g/d does not insure LMDR greater than 6 unless the feed yarns are drawn and heat set according to the invention described herein.

TABLE IX

| FEED YARN<br>DRAWN ITEM NO. | IX-1<br>IX-1 | IX-1<br>IX-2 |
|---|---|---|
| FEED YARN PROPERTIES | | |
| NYLON POLYMER TYPE | 95%/5% 66/6 | |
| DENIER | 51.2 | 51.2 |
| FILAMENTS | 13 | 13 |
| RV | 65 | 65 |
| ELONGATION, % | 68 | 68 |
| $(RDR)_F$ | 1.68 | 1.68 |
| $(RDR)_S$ | 1.68 | 1.68 |
| TENACITY, g/d | 3.9 | 3.9 |
| MODULUS, g/d | 12.1 | 12.1 |
| $DT_{33}$, g | 63.7 | 63.7 |
| $DT_{33}$, % CV | 0.38 | 0.38 |
| $DT_{33}$, g/d | 1.26 | 1.26 |
| DVA, % CV | 0.30 | 0.30 |
| WARP DRAW CONDITIONS | | |

TABLE IX-continued

| FEED YARN<br>DRAWN ITEM NO. | IX-1<br>IX-1 | IX-1<br>IX-2 |
|---|---|---|
| WD SPEED, mpm | 273 | 550 |
| WD RATIO | 1.0 | 1.30 |
| WD TENSION, g | N/A | 72 |
| WD TENSION, g/dd* | N/A | 1.70 |
| WD HTR TEMP, °C. | N/A | 80 |
| OVERFEED, % | N/A | 4 |
| RELAX HTR TEMP, °C. | N/A | OFF |
| RELAX TEMP, °C. | N/A | 22 |
| DRAWN YARN PROPERTIES | | |
| DENIER | 51.2 | 42.4 |
| ELONGATION, % | 66 | 36 |
| $(RDR)_D$ | 1.66 | 1.36 |
| TENACITY, g/d | 3.90 | 4.39 |
| MODULUS, g/d | 12.2 | 21.3 |
| DVA, % CV | 0.34 | 0.34 |
| BOIL-OFF SHRINK, % | 4.9 | 7.7 |
| PROC. 8 UNIFORMITY RATING | 4.7 | 6.9 |
| PROC. 4 UNIFORMITY RATING | 4.9 | 6.4 |
| PROC. 2 UNIFORMITY RATING | 4.3 | 7.0 |

EXAMPLE X

In Table X fiber structural properties are summarized for drawn yarns formed by dry drawing and dry relaxing various spun feed yarns representative of low oriented yarns (FIG. 17, region I, <2000 mpm), medium oriented yarns (FIG. 17, region II, 2000–4000 mpm), and high oriented yarns (FIG. 17, region III, >4000 mpm). Feed yarns used to prepare drawn yarns X-15, 16 and 21 through 24 are representative of region I feed yarns. Feed yarns used to prepare drawn yarns X-2 through 13, 18 and 19 are representative of region II feed yarns. Feed yarns used to prepare drawn yarns X-26 through 29, 31, 32, and 34 are representative of region III feed yarns. The apparent pore mobility (APM), derived from amorphous orientation, and the apparent pore volume (APV), derived from wide-angle x-ray were determined for the drawn yarns prepared with varying draw ratios (DR), draw temperatures ($T_D$, and relaxation temperatures ($T_R$). In FIG. 26 the values for APM and APV are plotted. Drawn yarns providing LMDR>6 and dye transition temperatures ($T_{DYE}$) less than about 65° C. are found to have an APM greater than about ($5-0.37\times10^{-4}$ APV), preferably greater than about 2, for an APV greater than about $4\times10^4$ cubic angstroms.

TABLE X

| ITEM | DR | $T_g$ °C. | $T_g$ °C. | LMFR | DYE RATE | EB, % | Density g/cm$^2$ | $X_v$ | $X_v$ | CPI/100 |
|---|---|---|---|---|---|---|---|---|---|---|
| X-1 | — | — | — | — | 135 | 76.1 | 1.1444 | .532 | .576 | .596 |
| X-2 | 1.15 | 60 | OFF | >6 | — | 63.1 | 1.1289 | .428 | .463 | .649 |
| X-3 | 1.15 | 60 | 160 | >6 | — | 60.2 | 1.1359 | .476 | .511 | .588 |
| X-4 | 1.30 | 60 | OFF | >6 | — | 44.1 | 1.1376 | .487 | .522 | .683 |
| X-5 | 1.30 | 60 | 130 | >6 | 69.7 | 39.3 | 1.1365 | .480 | .515 | .622 |
| X-6 | 1.30 | 60 | 160 | <6 | — | 39.0 | 1.1372 | .485 | .520 | .614 |
| X-7 | 1.45 | 60 | OFF | >6 | — | 33.8 | 1.1385 | .493 | .528 | .656 |
| X-8 | 1.45 | 60 | 100 | >6 | — | 32.0 | 1.1366 | .481 | .517 | .631 |
| X-9 | 1.45 | 60 | 130 | <6 | — | 29.6 | 1.1360 | .477 | .512 | .608 |
| X-10 | 1.45 | 60 | 160 | <6 | — | 31.1 | 1.1374 | .486 | .521 | .589 |
| X-11 | 1.45 | 60 | 190 | <6 | — | 28.6 | 1.1375 | .486 | .521 | .579 |
| X-12 | 1.60 | 60 | OFF | <6 | — | 17.6 | 1.1380 | .490 | .525 | .539 |
| X-13 | 1.60 | 60 | 160 | <6 | — | 18.6 | 1.1360 | .476 | .511 | .548 |
| X-14 | — | — | — | <6 | 45.4 | 60.0 | 1.1370 | .483 | .518 | .661 |
| X-15 | 1.20 | 60 | 130 | <6 | 28.9 | 35.4 | 1.1407 | .508 | .543 | .690 |
| X-16 | 1.30 | 60 | 130 | <6 | 15.5 | 25.2 | 1.1413 | .512 | .547 | .697 |
| X-17 | — | — | — | >6 | 81.4 | 56.1 | 1.1377 | .488 | .523 | .687 |
| X-18 | 1.15 | 60 | 130 | >6 | 65.9 | 37.4 | 1.1422 | .518 | .553 | .717 |
| X-19 | 1.30 | 60 | 130 | >6 | 39.6 | 25.1 | 1.1369 | .482 | .517 | .699 |
| X-20 | — | — | — | <6 | — | 50.7 | 1.1377 | .488 | .523 | .693 |
| X-21 | 1.50 | 60 | OFF | <6 | — | 11.4 | 1.1360 | .477 | .512 | .636 |
| X-22 | 1.50 | 150 | OFF | <6 | — | 11.3 | 1.1373 | .485 | .520 | .604 |
| X-23 | 1.50 | 150 | 100 | <6 | — | 11.2 | 1.1395 | .500 | .535 | .621 |

TABLE X-continued

| | | | | | | | | | | |
|---|---|---|---|---|---|---|---|---|---|---|
| X-24 | 1.50 | 250 | 100 | <6 | — | 17.2 | 1.1458 | .542 | .577 | .746 |
| X-25 | — | — | — | >6 | — | — | 1.1356 | .474 | .509 | — |
| X-26 | 1.325 | 60 | OFF | >6 | — | 36.4 | 1.1399 | .502 | .537 | .745 |
| X-27 | 1.325 | 60 | 130 | >6 | — | 32.7 | 1.1371 | .484 | .519 | .670 |
| X-28 | 1.325 | 60 | 160 | >6 | — | 33.6 | 1.1385 | .493 | .528 | .674 |
| X-29 | 1.40 | 60 | 130 | <6 | — | 22.2 | 1.1395 | .500 | .535 | .663 |
| X-30 | — | — | — | >6 | — | — | 1.1367 | .481 | .517 | — |
| X-31 | 1.20 | 60 | 130 | >6 | — | 35.2 | 1.1375 | .487 | .522 | .673 |
| X-32 | 1.40 | 60 | 130 | <6 | — | 33.6 | 1.1373 | .485 | .520 | .628 |
| X-33 | — | — | — | >6 | — | — | 1.1430 | .523 | .558 | — |
| X-34 | 1.40 | 60 | 130 | >6 | — | 33.6 | 1.1389 | .495 | .530 | .786 |

| ITEM | ACS (100) | ACS (010) | ACV × $10^4$ | LPS | APV × $10^4$ | Orientation fc | favq | fa | APM | Ms g/d |
|---|---|---|---|---|---|---|---|---|---|---|
| X-1 | 56.0 | 37.2 | 9.51 | 77 | 5.67 | .788 | .487 | .093 | 9.75 | 40.8 |
| X-2 | 56.3 | 39.1 | 10.33 | 81 | 6.70 | .856 | .576 | .335 | 1.99 | 49.3 |
| X-3 | 50.5 | 38.6 | 8.61 | 79 | 5.06 | .816 | .567 | .307 | 2.26 | 48.3 |
| X-4 | 58.4 | 39.7 | 11.16 | 85 | 7.63 | .843 | .584 | .301 | 2.32 | 50.3 |
| X-5 | 54.4 | 38.7 | 9.66 | 81 | 6.01 | .899 | .593 | .268 | 2.73 | 56.6 |
| X-6 | 53.8 | 40.2 | 10.06 | 82 | 6.18 | .851 | .597 | .322 | 2.11 | 51.9 |
| X-7 | 51.1 | 37.5 | 8.39 | 87 | 5.50 | .877 | .627 | .347 | 1.88 | 56.0 |
| X-8 | 51.1 | 38.2 | 8.62 | 87 | 5.44 | .901 | .628 | .336 | 1.98 | 56.2 |
| X-9 | 50.4 | 37.8 | 8.32 | 81 | 5.06 | .871 | .632 | .381 | 1.63 | 55.3 |
| X-10 | 51.2 | 39.4 | 9.06 | 84 | 5.34 | .882 | .622 | .339 | 1.95 | 57.7 |
| X-11 | 53.2 | 35.1 | 8.07 | 85 | 4.67 | .890 | .638 | .364 | 1.74 | 61.0 |
| X-12 | 46.5 | 35.1 | 6.59 | 89 | 3.55 | .911 | .657 | .376 | 1.66 | 59.9 |
| X-13 | 46.7 | 36.3 | 6.98 | 88 | 3.83 | .910 | .660 | .399 | 1.41 | 61.5 |
| X-14 | 46.4 | 29.3 | 5.01 | 68 | 3.31 | .872 | .587 | .281 | 2.56 | 50.6 |
| X-15 | 51.3 | 33.2 | 7.03 | 70 | 4.85 | .918 | .644 | .318 | 2.15 | 58.8 |
| X-16 | 49.4 | 35.3 | 7.28 | 74 | 5.07 | .932 | .657 | .325 | 2.08 | 61.1 |
| X-17 | 50.8 | 30.5 | 6.10 | 67 | 4.19 | .871 | .598 | .299 | 2.35 | 52.0 |
| X-18 | 50.5 | 33.7 | 7.02 | 73 | 5.03 | .900 | .631 | .298 | 2.36 | 56.7 |
| X-19 | 52.5 | 33.5 | 7.38 | 75 | 5.16 | .929 | .639 | .329 | 2.04 | 57.9 |
| X-20 | 53.0 | 34.9 | 7.96 | 80 | 5.52 | .893 | .627 | .335 | 1.99 | 56.0 |
| X-21 | 45.6 | 31.4 | 5.42 | 97 | 3.45 | .934 | .626 | .303 | 2.30 | 55.9 |
| X-22 | 49.6 | 31.7 | 6.23 | 98 | 3.77 | .951 | .659 | .345 | 1.90 | 61.2 |
| X-23 | 50.8 | 32.7 | 6.77 | 94 | 4.20 | .949 | .727 | .471 | 1.12 | 76.5 |
| X-24 | 58.4 | 38.8 | 10.79 | 101 | 8.05 | .947 | .756 | .495 | 1.02 | 85.7 |
| X-25 | — | — | — | — | — | .818 | .555 | .280 | 2.57 | 47.0 |
| X-26 | 62.7 | 40.3 | 12.70 | 91 | 9.46 | .885 | .608 | .287 | 2.48 | 53.3 |
| X-27 | 56.7 | 38.0 | 10.00 | 88 | 6.70 | .891 | .602 | .290 | 2.45 | 52.6 |
| X-28 | 57.0 | 41.1 | 11.34 | 89 | 7.64 | .898 | .628 | .326 | 2.07 | 56.3 |
| X-29 | 58.4 | 39.1 | 10.91 | 88 | 7.23 | .903 | .632 | .320 | 2.13 | 56.9 |
| X-30 | — | — | — | — | — | .791 | .513 | .215 | 3.65 | 42.9 |
| X-31 | 51.0 | 35.3 | 7.64 | 84 | 5.14 | .922 | .590 | .227 | 3.41 | 51.0 |
| X-32 | 45.5 | 34.6 | 6.25 | 89 | 3.93 | .932 | .609 | .259 | 2.86 | 53.5 |
| X-33 | — | — | — | — | — | .818 | .584 | .289 | 2.46 | 50.3 |
| X-34 | 65.7 | 43.3 | 15.17 | 94 | 8.31 | .878 | .604 | .295 | 2.39 | 52.8 |

We claim:

1. A flat multifilament apparel yarn of nylon 66 polyamide polymer, wherein said polymer, having a melting point ($T_M$) between about 245° C. and about 265° C., is of relative viscosity (RV) between about 50 and about 80 with about 30 to about 70 equivalent NH2-ends per $10^6$ grams of polymer, and wherein said multifilament apparel yarn is further characterized by a residual draw ratio $(RDR)_D$ between about 1.25 and about 1.55 with an initial modulus greater than about 15 g/d, a boil-off shrinkage (S) between about 3% and about 10%; a C.I. Acid Blue 122 dye transition temperature ($T_{dye}$) less than about 65° C., a C.I. Acid Blue 40 apparent dye diffusion coefficient ($D_A$), measured at 25° C., of at least about $20\times10^{-10}$ cm²/sec, and an apparent pore mobility (APM) greater than about $[5-0.37\times10^{-4}$ APV], wherein the apparent pore volume (APV) is greater than about $4\times10^4$ cubic angstroms.

2. A flat multifilament apparel yarn as set forth in claim 1 wherein said apparent pore mobility is greater than about 2.

3. A flat multifilament apparel yarn as set forth in claim 1 or claim 2, wherein said nylon 66 polyamide polymer contains an amount of bifunctional polyamide comonomer units or non-reactive additive capable of hydrogen-bonding with the nylon 66 polymer.

4. A flat multifilament apparel yarn as set forth in claim 3, wherein said bifunctional polyamide comonomer units are comprised at least in part of epsilon-caproamide comonomer units.

5. A flat multifilament apparel yarn as set forth in claim 3, wherein said bifunctional polyamide comonomer units are comprised at least in part of 2-methyl-pentamethylene adipamide comonomer units.

6. A warp sheet of multifilament apparel yarns comprised in at least part of said yarns as set forth in claim 1.

* * * * *